US010258942B2

(12) United States Patent
Kenreck, Jr. et al.

(10) Patent No.: US 10,258,942 B2
(45) Date of Patent: Apr. 16, 2019

(54) INJECTION QUILL DESIGNS AND METHODS OF USE

(71) Applicant: General Electric Company, Schenectady, NY (US)

(72) Inventors: Glenn Vernon Kenreck, Jr., Spring, TX (US); Jayaprakash Sandhala Radhakrishnan, Karnataka (IN); Manish Joshi, Karnataka (IN); Siva Kumar Kota, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 292 days.

(21) Appl. No.: 15/032,844

(22) PCT Filed: Oct. 31, 2013

(86) PCT No.: PCT/US2013/067678

§ 371 (c)(1),
(2) Date: Apr. 28, 2016

(87) PCT Pub. No.: WO2015/065405

PCT Pub. Date: May 7, 2015

(65) Prior Publication Data

US 2016/0263537 A1 Sep. 15, 2016

(51) Int. Cl.

| | |
|---|---|
| ***B01F 5/04*** | (2006.01) |
| ***B01F 3/08*** | (2006.01) |
| ***C10G 75/00*** | (2006.01) |

(52) U.S. Cl.

CPC ..... *B01F 5/0463* (2013.01); *B01F 3/0865* (2013.01); *B01F 5/0461* (2013.01);
(Continued)

(58) Field of Classification Search

CPC ..... B01F 5/0463
(Continued)

(56) References Cited

U.S. PATENT DOCUMENTS 84,901 A * 12/1868 Pease ..... B01F 3/04531 366/170.3
3,332,442 A * 7/1967 Reed ..... B01F 5/045 137/896

(Continued)

FOREIGN PATENT DOCUMENTS

DE 102007055905 A1 6/2009
EP 1975381 A1 10/2008

(Continued)

OTHER PUBLICATIONS

PCT Search Report and Written Opinion issued in connection with corresponding PCT Application No. PCT/US13/067678 dated Oct. 23, 2014.

(Continued)

*Primary Examiner* — David L Sorkin
(74) *Attorney, Agent, or Firm* — Wegman, Hessler & Vanderburg; Michelle Fabry

(57) ABSTRACT

An injection quill design and methods of use for injecting a first fluid into a second fluid. The injection quill may comprise a hollow stem having a closed end and a sidewall, the stem having a curved cross-section defined by a major axis, and a minor axis, and at least one orifice for injecting the first fluid into the second fluid, wherein the major axis is greater than the minor axis and/or the orifice extends through the sidewall and/or the orifice has an internal chamfer with a chamfer angle ranging from less than 0° but greater than 90°.

17 Claims, 58 Drawing Sheets

(52) U.S. Cl.
CPC ..... *C10G 75/00* (2013.01); *B01F 2215/0404* (2013.01); *B01F 2215/0422* (2013.01); *B01F 2215/0431* (2013.01)

(58) Field of Classification Search
USPC ..... 366/167.1, 173.1, 173.2, 174.1, 175.2
See application file for complete search history.

(56) References Cited

U.S. PATENT DOCUMENTS

| | | | | |
|---|---|---|---|---|
| 3,342,193 | A * | 9/1967 | Ballard | B01F 5/0206 137/3 |
| 5,277,250 | A | 1/1994 | Dela | |
| 6,238,557 | B1 | 5/2001 | Ziemer et al. | |
| 7,137,569 | B1 | 11/2006 | Miller et al. | |
| 2005/0056313 | A1 | 3/2005 | Hagen et al. | |
| 2011/0075507 | A1 * | 3/2011 | Wootan | B01F 3/0807 366/124 |
| 2012/0230895 | A1 | 9/2012 | Seyoum | |

FOREIGN PATENT DOCUMENTS

| | | | |
|---|---|---|---|
| EP | 2657634 | A1 | 10/2013 |
| JP | 6369606 | A | 3/1988 |

OTHER PUBLICATIONS

Moncla, Wayne, "Tool Holder Angles—Chamfer and Bevel Angles", MSI Manufacturing Solutions, Inc. http://www.msi-tx/blog/bid/66584/Tool-Holder-Angles-Chamfer-and-Bevel-Angles, Aug. 15, 2011, 7 pages.

Ellipse, Wikipedia, http://en.wikipedia.org/wiki/Ellipse, Apr. 5, 2013, 17 pages.

* cited by examiner

INJECTION QUILL DESIGNS AND METHODS OF USE

BACKGROUND

Field of the Invention

The subject matter disclosed herein generally relates to an apparatus for injecting a first fluid into a second fluid. More specifically, an injection quill design and methods of use are disclosed.

Description of Related Art

In refineries, water treatment facilities, and other process industries, chemical treatments are used to reduce or deactivate harmful species in process streams and protect processing equipment from corrosion and fouling. This involves injecting the treatment chemical into the process stream. Both the treatment chemical and process stream may be oil-soluble, water-soluble or a mixture thereof. The treatment chemicals and process streams may be a liquid, gas, or a mixture thereof. Uniform and maximum dispersion of the treatment chemical through the process stream may increase the effectiveness of the treatment chemical and may even reduce treatment costs. Likewise, uniform and maximum volume fraction of the treatment chemical on process equipment surfaces may increase the effectiveness of the treatment chemical and may even reduce treatment costs. For many injection applications, an injection quill may be used to inject the treatment chemical into the process stream. Examples of injection applications where an injection quill may be used, include, but are not limited to, injecting a $H_2S$ scavenger, a neutralizer, corrosion inhibitor, or a filmer into a hydrocarbon stream at a hydrocarbon processing facility.

Currently, injection quills and their use are developed based on trial and error by people with experience in the field. This current method may be sub-optimal, leading to uneven distribution of treatment chemicals or uneven coverage of processing equipment surfaces. In the cases where the treatment chemical is a corrosion inhibitor, such uneven coverage may lead to severe corrosion of exposed pipe surfaces, as witnessed in the field. The injection design must then be altered, often more than once, until corrosion is minimized. This trial and error process is inefficient and costly. In addition, injection quills obstruct the flow of the process stream being treated. The obstruction may be enough to cause a pressure drop in the process stream being treated.

BRIEF DESCRIPTION

Embodiments of the present invention provide an injection quill design. The methodology used to develop the quill design was Computational Fluid Dynamics ("CFD") to simulate the effects of various design modifications on the flow characteristics of a treatment chemical and process stream. CFD is a technique of numerically solving fluid mechanics and related phenomena in a fluid system. CFD was used to estimate the volume fraction of filmer, or anti-corrosion chemical, on a pipe wall using different injection quill designs. CFD was also used to estimate the dispersion of a $H_2S$ scavenger in natural gas using different injection quill designs. The information obtained from the simulations was used to develop injection quill designs for injecting a first fluid into a second fluid.

The injection quill designs may be used to coat a pipe wall with a filmer or to disperse a chemical treatment, such as a scavenger, in a hydrocarbon stream. When coating a pipe wall or other processing equipment, the coating process may be improved by increasing the volume fraction of the filmer ("treatment chemical" or "first fluid") on the pipe walls along the length of the pipe. The dispersion process may be improved by inducing homogeneous mixing of the treatment chemical with the process stream. This may be achieved by a combination of various means, such as increasing the turbulence of the process stream, adjusting the particle size distribution of the treatment chemical, increasing the coverage area of the treatment chemical, etc. Injecting the treatment chemical in regions of high velocity regions of the fluid being treated ("process stream" or "second fluid") also aids in homogenous mixing as the process stream can act as a carrier to carry the treatment chemical farther and faster. In some cases, decreasing the average droplet size of the chemical treatment may also improve the chemical treatment's efficiency. The disclosed designs may be used to coat a pipe wall with a filmer, or disperse a treatment chemical, such as a scavenger, in a hydrocarbon stream. It was also surprisingly discovered that the injection quill designs increase the volume fraction of the first fluid along the length of a pipe, while at the same time, minimize the pressure drop in the process stream being treated.

Accordingly, in one embodiment, an injection quill for injecting a first fluid into a second fluid is disclosed. The injection quill may comprise a hollow stem having a closed end and a sidewall. The stem may have a curved cross-section defined by a major axis (A), and a minor axis (B), and at least on orifice for injecting the first fluid into the second fluid. The major axis A may be greater than or equal to the minor axis B i.e., $A \geq B$ and/or the orifice may extend through the sidewall and/or the orifice may have an internal chamfer with a chamfer angle ($\alpha$) ranging from $0° \leq \alpha < 90°$. In another embodiment, the orifice may extend through the sidewall. In yet another embodiment, A may be greater than B ($A > B$).

In another embodiment, the stem may be made of metal. In yet another embodiment, the injection quill may further comprise first couplings to connect the quill to a pipe. The couplings may optionally be flanged or threaded.

In one embodiment, the ratio of A to B may range from about 1.1:1 to about 4:1. In another embodiment, the injection quill orifice may have an internal chamfer with a chamfer angle ($\alpha$) ranging from $0° \leq \alpha < 90°$. In another embodiment, the chamfer angle may range from $7° \leq \alpha \leq 75°$. Alternatively, the chamfer angle may range from $30° \leq \alpha \leq 60°$.

In another embodiment, the injections quill stem may comprise at least two orifices. At least one of the orifices may be located at a location angle ($\theta$), wherein an origin of the location angle ($\theta$) is measured from the major axis (A) and wherein $-90° < \theta < 90°$. The inner diameter of the orifice may range from 1/32 to 3/8 inches. In yet another embodiment of the injection quill, the orifice may have an inner diameter from 1/32 to 1/4 inch in length.

In another embodiment, a method of injecting a first fluid into a second fluid using an injection quill is disclosed. The injection quill may comprise a hollow stem having a closed end and a sidewall. The stem may have a curved cross-section defined by a major axis (A), and a minor axis (B), and at least on orifice for injecting the first fluid into the second fluid. The major axis A may be greater than or equal to the minor axis B i.e., $A \geq B$ and/or the orifice may extend through the sidewall and/or the orifice may have an internal chamfer with a chamfer angle ($\alpha$) ranging from $0° \leq \alpha < 90°$.

In another method embodiment, the major axis of the stem may be substantially parallel to a direction of flow of the second fluid. In another embodiment, the orifice may extend through the sidewall. In yet another embodiment, A may be greater than B (A>B). In yet another embodiment, the ratio of A to B may range from about 1.1:1 to about 4:1.

In another method embodiment, the injection quill orifice may have an internal chamfer with a chamfer angle ($\alpha$) ranging from $0° \leq \alpha < 90°$. In another embodiment, the chamfer angle may range from $7° \leq \alpha \leq 75°$. Alternatively, the chamfer angle may range from $30° \leq \alpha \leq 60°$.

In another embodiment, the injections quill stem may comprise at least two orifices. At least one of the orifices may be located at a location angle ($\theta$), wherein an origin of the location angle ($\theta$) is measured from the major axis (A) and wherein $-90° \leq \theta < 90°$.

In yet another embodiment of the method, the second fluid may move from an upstream direction to a downstream direction relative to the stem. The orifice may be on a hemispherical portion of the sidewall which faces in the downstream direction. The inner diameter of the orifice may range from 1/32 to 3/8 inches. In yet another method, the orifice may have an inner diameter from 1/32 to 1/4 inch in length.

DETAILED DESCRIPTION

Figure 1:
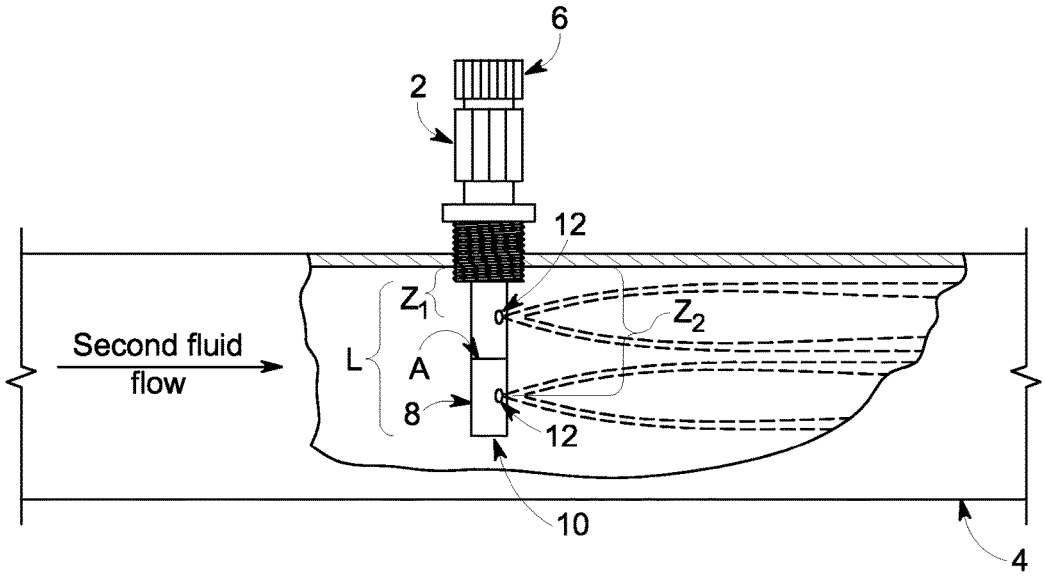
FIG. 1 shows a side view of an injection quill mounted in a pipe.

FIG. 1 shows an embodiment of the injection quill design, wherein the quill assembly (2) extends through the wall of a pipe or conduit (4). Although the FIG. 1 depicts a pipe (4), the injection quill may extend through any surface or any type fluid containment wall. The body (6) of the injection quill may have couplings to connect the quill to the pipe (4) as well as couplings to connect the injection quill to a delivery device for the first fluid. The body (6) may also include a check valve to prevent fluid from leaving the pipe (4) through the quill. Such couplings, delivery devices, and check valves are well known in the art. Therefore detailed descriptions such features have been excluded for the sake of brevity.

The stem (8) of the injection quill may be a hollow elliptical cylinder, such that the major axis (A) is greater than the minor axis (B). The major axis may be orientated such that it is parallel with the direction of flow of the second fluid. The injection quill's interference with the second fluid's flow is minimized when the major axis (A) is orientated parallel with the direction of the second fluid's flow. This aids in maintaining the pressure of the second fluid's flow. The stem has a length (L) and the end of the stem (10) is closed. The end (10) may be closed at a right angle (shown) or closed at an incline, rounded or semi-spherical, beveled, etc. Although a right elliptical cylinder with a sidewall of constant elliptical cross-section is shown in FIG. 1, the sidewall may have varying elliptical cross-sections. For example, the stem may be tapered along the length of the stem such that the elliptical cross-sections of the cylinder become gradually smaller down the length of the stem. The stem may even have a rhomboid or deltoid cross-section with a major diagonal ($X_{major}$), and a minor diagonal ($X_{minor}$), wherein the major diagonal is greater than the minor diagonal. The stem (8) has at least one orifice (12).

The orifice (12) may be located at any distance (z) along the length (L) of the stem (8). In one embodiment, distance (z) may be at a distance from the fluid containment wall where the frictional forces from the wall surface on the fluid are the least and the second fluid velocity is the greatest. If the fluid containment wall is a pipe, distance (z) may be the center of the diameter of the pipe. In another embodiment, the distance (z) may be slightly above the center of the diameter of the pipe. In another embodiment, the distance (z) is about ⅜ inch to about ½ inch above the center of the pipe diameter.

Figure 2:
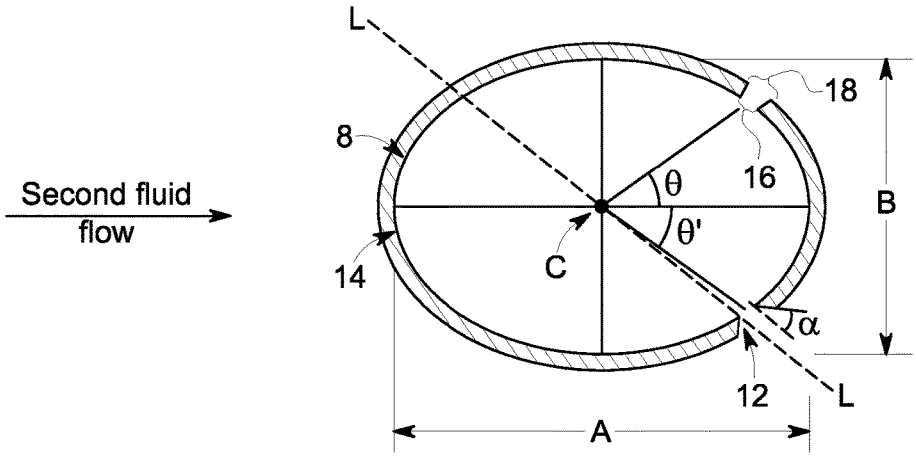
FIG. 2 shows a cross-sectional view of an injection quill stem.

Turning to FIG. 2, the orifice (12) may be located anywhere along the length (L) of the stem (8) such that the first fluid is injected in the general direction of the second fluid's flow. Although FIG. 2 shows an elliptical-shaped stem, the orifices described below may be used with any stem shape (circular, triangular, rhomboid, deltoid, etc.). The orifice (12) may be a circular-shaped hole with an inner diameter (16) and an outer diameter (18). The inner diameter (16) may be selected to control the mean particle size of the first fluid as it passes through the orifice. In one embodiment, the inner diameter (16) may be selected such that the mean particle size of the first fluid after it passes through the orifice is 50 microns. The inner diameter of the orifice may range from 1/32 to ⅜ inches. In one embodiment, the inner diameter may range from about 1/16 inch to about ¼ inch. In yet another embodiment, the inner diameter may be ⅛ inch.

In another embodiment, the orifice (12) may have an internal chamfer such that the inner diameter (16) is smaller than the outer diameter (18). The chamfer length may be greater than or equal to the sidewall thickness. If the chamfer extends through the entire sidewall, the chamfer will be the entire wall thickness. Alternatively, the chamfer length may be less than or equal to the entire sidewall (14) thickness. In one embodiment, the chamfer length is greater than or equal to the entire wall thickness. As shown in FIG. 2, the internal chamfer may have a chamfer angle (α) ranging from $0° \leq \alpha < 90°$. The internal chamfer may be used to control the spray angle of the first fluid. The spray angle may be defined as the angle of the cone of spray formed by the first fluid as it exits the orifice.

In another embodiment, the orifice may be located at a location angle (θ) wherein the origin is at the center of the ellipse (C) and the location angle (θ) is measured from the major axis (A) in the direction of the second fluid's flow. Thus, if the orifice location angle is 0°, the first fluid is injected in the same direction of flow as the second fluid. In another embodiment, at least one orifice is located at a location angle θ, wherein an origin of the location angle, θ is measured from the major axis A and wherein $-180°<\theta<180°$. In other words, θ can be $-90°<\theta<90°$ as potentially measured from a vertex which is located along the major axis A in either of two positions. The two positions may be the two intersections between major axis A and the circumference defined by the cross-section of the stem. Accordingly, in one embodiment, θ may range from $-90°<\theta<90°$. In another embodiment, there may be a second orifice located at a location angle (θ') wherein the origin is at the center of the ellipse (C) and the location angle (θ') is measured from the major axis (A) in the direction of the second fluid's flow. Accordingly, in one embodiment, θ' may also range from $-90°<\theta'<90°$. Location angles θ and θ' may be the same or different. Those of ordinary skill in the art will anticipate that if location angles θ and θ' are the same; the orifices will be at different distances (z) on the length (L) of the stem (8). In one embodiment, θ may range from $0°\leq\theta<90°$ and θ' may range from $-90°<\theta'\leq 0°$. In another embodiment, the ranges may be $7°\leq\theta\leq 75°$ and $-75°\leq\theta'\leq -7°$. Alternatively, the ranges may be $30°\leq\theta\leq 60°$ and $-60°\leq\theta'\leq -30°$. In yet another embodiment, θ and θ' may be congruent but on opposite sides of major axis (A). Accordingly, in another embodiment, the magnitude of θ may equal the magnitude of θ'. In yet another embodiment, θ=30° and θ'=−30°.

In another embodiment, the stem may have three or more orifices. In yet another embodiment, the stem may have two pairs of orifices for a total of four orifices. The first orifice pair may have location angles ($\theta^1$ and $\theta^{1'}$) that are congruent but on opposite sides of major axis (A). The second orifice pair may have congruent location angles, ($\theta^2$ and $\theta^{2'}$). The congruent location angles of the first and second orifice pair may be the same or different.

In another embodiment, the congruent injection angles of the first and second pair may be the same with each orifice pair at different distances ($z_1$) and ($z_2$) respectively, on the length (L) of the stem (8) (FIG. 2). In yet another embodiment, $z_2$ is at a distance that is equal to the center diameter of the pipe to which the injection quill is mounted. In another embodiment, the pipe has a 24-inch diameter and distance ($z_1$) is six inches from the pipe wall and distance ($z_2$) is 12 inches from the pipe wall. In yet another embodiment, the distance ($z_2$) may be slightly above the center of the diameter of the pipe. In another embodiment, the distance ($z_2$) is about ⅜ inch to about ½ inch above the center of the pipe diameter. Thus, for a 24-inch diameter pipe, $z_2$ may be about 11⅝ to about 11½ inches from where the injection quill extends through the pipe wall. In another embodiment, the quill may protrude to about 75% of the tube diameter. The orifices may be places slightly above the centerline at about ⅜ inches to about ½" from the center line.

The injection quill, or quill, may be used in any application where it is desirable to inject a first fluid into a second fluid. Examples include, but are not limited to, injecting a $H_2S$ scavenger, a corrosion inhibitor, a filmer or a neutralizer into a hydrocarbon stream at a hydrocarbon processing facility. The first and second fluids may be the same or different, and may be a liquid, gas, or a mixture thereof. The first fluid may be a chemical treatment comprising oil-soluble or water-soluble chemicals that deactivate harmful, corroding, or fouling species in the second fluid. Accordingly, injection quill designs for coating a pipe wall with a filmer or dispersing a chemical treatment, such as a scavenger, in a hydrocarbon stream are disclosed. It was also surprisingly discovered that the injection quill designs increase the volume fraction of the first fluid along the length of a pipe, while at the same time, minimize the pressure drop in the process stream being treated.

The injection quill may comprise a stem that is a hollow cylinder. The stem may have a closed end and a sidewall with curved cross-section, a major axis (A), and a minor axis (B), wherein the major axis (A) is greater than or equal to the minor axis (B) i.e., A≥B. The stem may have at least one orifice extending through the stem sidewall for injecting the first fluid. In one embodiment, the stem may be a hollow elliptical cylinder having a sidewall with an elliptical cross-section wherein A>B. In another embodiment, the ratio of A to B may range from about 1.1:1 to about 4:1. Alternatively, the ratio of A to B may be about 2:1.

In another embodiment, the injection quill orifice may have an internal chamfer with a chamfer angle (α) ranging from $0°\leq\alpha<90°$. In another embodiment, the chamfer angle may range from $7°\leq\alpha\leq 75°$. Alternatively, the chamfer angle may range from $30°\leq\alpha\leq 60°$.

In another embodiment, the injections quill stem may comprise at least two orifices. Each orifice may have an internal chamfer with a chamfer angle (α) $0°\leq\alpha<90°$. In another embodiment, at least one chamfer angle may range from $7°\leq\alpha\leq 75°$. Alternatively, at least one chamfer angle may range from $30°\leq\alpha\leq 60°$.

At least one of the orifices may be located at a location angle (θ), wherein an origin of the location angle (θ) is measured from the major axis (A) and wherein $-90°<\theta<90°$. In yet another embodiment, at least one of the orifices may be located at location angle (θ'), wherein an origin of the location angle (θ') is measured from the major axis (A) and wherein $-90°<\theta<90°$. In yet another embodiment, θ and θ' may be congruent on opposite sides of major axis (A). In another embodiment, the injection quill may have a total of four orifices. The injection quill may have a first pair of orifices with congruent location angles (θ) and (θ') located at a first distance ($z_1$) and a second pair of orifices with congruent location angles (θ) and (θ') located at a second distance ($z_2$).

In yet another embodiment, the major axis (A) of the injection quill is parallel to a direction of flow of the second fluid.

In another embodiment, the injection quill for injecting a first fluid into a second fluid may have a hollow stem with a closed end and a sidewall and at least one orifice extending though the sidewall. The orifice may have an internal chamfer with a chamfer angle (α) $0°\leq\alpha<90°$. In another embodiment, the chamfer angle may range from $7°\leq\alpha\leq 75°$. Alternatively, the chamfer angle may range from $30°\leq\alpha\leq 60°$.

In another embodiment, a method of injecting a first fluid into a second fluid using an injection quill is disclosed. The method comprises using an injection quill with a stem that is a hollow elliptical cylinder. The stem may have a closed end and sidewall with an elliptical cross-section and a major axis (A) and a minor axis (B), wherein A≥B. The major axis (A) of the stem may be parallel to a direction of flow of the second fluid. The stem may have at least one orifice extending through the sidewall for injecting the first fluid. If the stem has a rhomboid or deltoid cross-section with a major diagonal ($X_{major}$), and a minor diagonal ($X_{minor}$), wherein $X_{major}>X_{minor}$, the major diagonal may be parallel to a direction of floor of the second fluid.

In another method at least one orifice may be located at a location angle (θ), wherein an origin of the location angle is measured from the major axis (A). The location angle may range from $-90°<\theta<90°$.

In yet another method, the injection quill orifice may have an internal chamfer with a chamfer angle (α) ranging from $0°\leq\alpha<90°$. In another embodiment, the chamfer angle may range from $7°\leq\alpha\leq75°$. Alternatively, the chamfer angle may range from $30°\leq\alpha\leq60°$.

In one embodiment, the injection quill may be an elliptical injection quill for use with a 24-inch diameter pipe. The stem may be a hollow elliptical cylinder with a closed end and a sidewall. The closed end may be flat or have a semi-spherical shape. The sidewall (14) may have a thickness of ⅛ inch. The stem may have an elliptical cross-section with a major axis (A), and a minor axis (B), wherein A is ½ inch and B ¼ inch. The injection quill may be inserted into a pipe. The injection quill may protrude into the pipe to about 75% of the pipe's diameter. If the injection quill is inserted in a 24-inch diameter pipe, the injection quill stem length (L) may range from about 13 to about 18 inches, such that the orifices are about 12 inches from the pipe wall. The injection quill may have two orifices located at a distance (z) on the stem that is about ⅜ inch to about ½ inch above the center of the pipe diameter. Thus, for a 24-inch diameter pipe, z may be about 11⅝ to about 11½ inches from where the injection quill extends through the pipe wall. The orifices may have congruent location angles, θ and θ', on opposite sides of major axis (A). The location angles may be $\theta=30°$ and $\theta'=-30°$. Both orifices may have an internal chamfer with a chamfer angle (α) of 60°. The chamfer length may extend through the entire thickness of the sidewall, such that the chamfer length is ⅛ inch.

In one embodiment, an injection quill for injecting a first fluid into a second fluid is disclosed. The injection quill may comprise a hollow stem having a closed end and a sidewall. The stem may have a curved cross-section defined by a major axis (A), and a minor axis (B), and at least on orifice for injecting the first fluid into the second fluid. The major axis A may be greater than or equal to the minor axis B i.e., $A\geq B$ and/or the orifice may extend through the sidewall and/or the orifice may have an internal chamfer with a chamfer angle (α) ranging from $0°\leq\alpha<90°$. In another embodiment, the orifice may extend through the sidewall. In yet another embodiment, A may be greater than B (A>B).

In another embodiment, the stem may be made of metal. In yet another embodiment, the injection quill may further comprise first couplings to connect the quill to a pipe. The couplings may optionally be flanged or threaded.

In one embodiment, the ratio of A to B may range from about 1.1:1 to about 4:1. In another embodiment, the injection quill orifice may have an internal chamfer with a chamfer angle (α) ranging from $0°\leq\alpha<90°$. In another embodiment, the chamfer angle may range from $7°\leq\alpha\leq75°$. Alternatively, the chamfer angle may range from $30°\leq\alpha\leq60°$.

In another embodiment, the injections quill stem may comprise at least two orifices. At least one of the orifices may be located at a location angle (θ), wherein an origin of the location angle (θ) is measured from the major axis (A) and wherein $-90°<\theta<90°$. The inner diameter of the orifice may range from 1/32 to ⅜ inches. In yet another embodiment of the injection quill, the orifice may have an inner diameter from 1/32 to ¼ inch in length.

In another embodiment, a method of injecting a first fluid into a second fluid using an injection quill is disclosed. The injection quill may comprise a hollow stem having a closed end and a sidewall. The stem may have a curved cross-section defined by a major axis (A), and a minor axis (B), and at least on orifice for injecting the first fluid into the second fluid. The major axis A may be greater than or equal to the minor axis B i.e., $A\geq B$ and/or the orifice may extend through the sidewall and/or the orifice may have an internal chamfer with a chamfer angle (α) ranging from $0°\leq\alpha<90°$.

In another method embodiment, the major axis of the stem may be substantially parallel to a direction of flow of the second fluid. In another embodiment, the orifice may extend through the sidewall. In yet another embodiment, A may be greater than B (A>B). In yet another embodiment, the ratio of A to B may range from about 1.1:1 to about 4:1.

In another method embodiment, the injection quill orifice may have an internal chamfer with a chamfer angle (α) ranging from $0°\leq\alpha<90°$. In another embodiment, the chamfer angle may range from $7°\leq\alpha\leq75°$. Alternatively, the chamfer angle may range from $30°\leq\alpha\leq60°$.

In another embodiment, the injections quill stem may comprise at least two orifices. At least one of the orifices may be located at a location angle (θ), wherein an origin of the location angle (θ) is measured from the major axis (A) and wherein $-90°<\theta<90°$.

In yet another embodiment of the method, the second fluid may move from an upstream direction to a downstream direction relative to the stem. The orifice may be on a hemispherical portion of the sidewall which faces in the downstream direction. The inner diameter of the orifice may range from 1/32 to ⅜ inches. In yet another method, the orifice may have an inner diameter from 1/32 to ¼ inch in length.

The injection quill designs may be used to coat a pipe wall with a filmer or to disperse a chemical treatment, such as a scavenger, in a hydrocarbon stream. When coating a pipe wall or other processing equipment, the coating process may be improved by increasing the volume fraction of the filmer ("treatment chemical" or "first fluid") on the pipe walls along the length of the pipe. The dispersion process may be improved by inducing homogeneous mixing of the treatment chemical with the process stream. This may be achieved by a combination of various means, such as increasing the turbulence of the process stream, adjusting the particle size distribution of the treatment chemical, increasing the coverage area of the treatment chemical, etc. Injecting the treatment chemical in regions of high velocity regions of the fluid being treated ("process stream" or "second fluid") also aids in homogenous mixing as the process stream can act as a carrier to carry the treatment chemical farther and faster. In some cases, decreasing the average droplet size of the chemical treatment may also improve the chemical treatment's efficiency. The disclosed designs may be used to coat a pipe wall with a filmer, or disperse a treatment chemical, such as a scavenger, in a hydrocarbon stream. It was also surprisingly discovered that the injection quill designs increase the volume fraction of the first fluid along the length of a pipe, while at the same time, minimize the pressure drop in the process stream being treated.

Comparative Example

For the Comparative Example, the volume fraction and fluid velocity of a system using a prior art quill were simulated using Computational Fluid Dynamics ("CFD") model. Multiphase fluid systems were developed for the CFD models. Simulations were performed using a bulk multiphase method and an individual particle tracking method to analyze the behavior of the injected particles. The system used was a HP Work station Z400 computer using FLUENT® 14.0 software, ANSYS-CFX 14.0 software (ANSYS, Inc. Canonsburg, Pa.) and HyperMesh 10.0 (HyperWorks, Altair, Inc. Troy, Mich.).

The fluid system was modeled after a naphtha-natural gas (liquid in gas) system. The first fluid was liquid naphtha with a density of 780 kg/m$^3$, an average particle diameter of 50 microns. The second fluid was natural gas (primarily methane) with a density of 0.717 kg/m$^3$. The fluid containment system was a pipe with a diameter (D) of 24 inches and a total length 15D. The injection quill extended through the pipe wall at the length 5D.

Figure 3A:
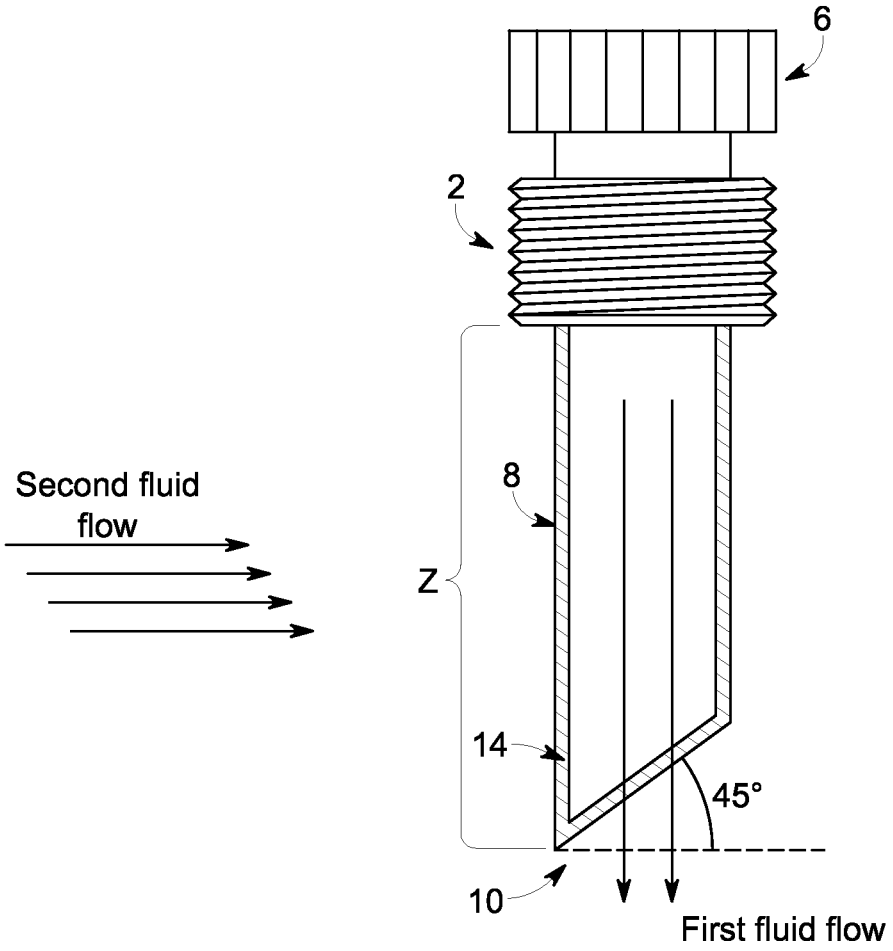
FIG. 3A PRIOR ART
FIG. 3A shows a cross-sectional view of a prior art injection quill.
Figure 3B:
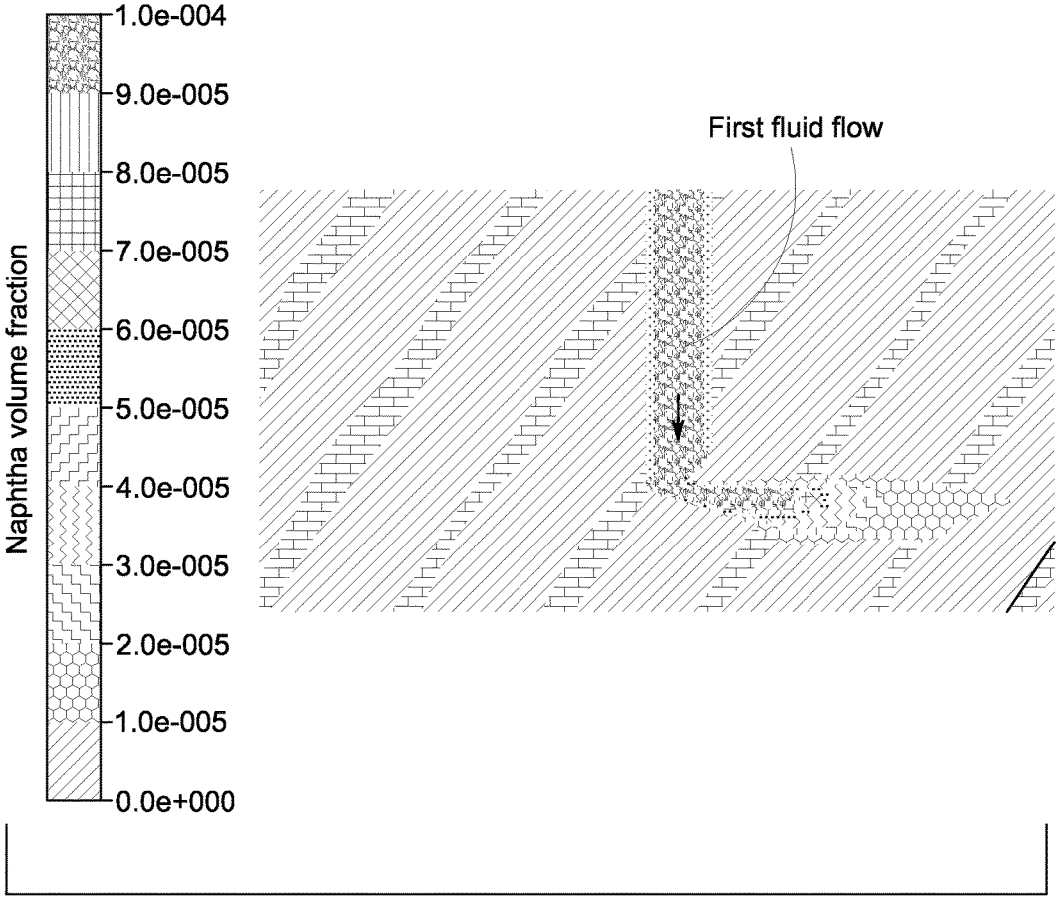
FIG. 3B PRIOR ART
FIG. 3B shows the naphtha volume fraction in a pipe using a prior art injection quill.
Figure 3C:
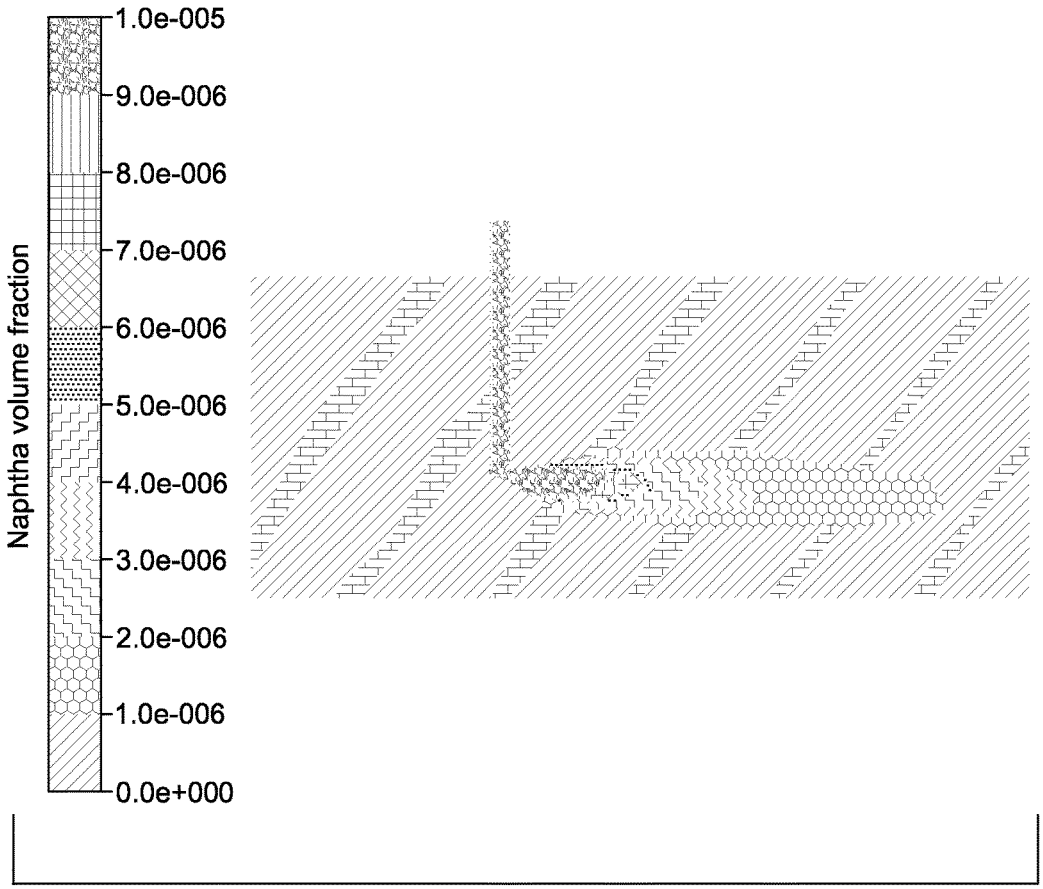
FIG. 3C PRIOR ART
FIG. 3C shows the naphtha volume fraction in a pipe using a prior art injection quill.

For the Comparative Example, the system was modeled after a prior art injection quill design with a circular stem with an inner diameter of ⅛". Turning to FIG. 3A, the end (10) of the quill stem (8) was open and served as an outlet for the first fluid. The end (10) was also beveled at a 45° angle in the direction of the first fluid's flow. The length (L) of the stem was 12" such that the open-ended quill injected the first fluid out the bottom of the stem into center of the diameter of the pipe. The naphtha flow rate was 60 kg/day and average droplet size distribution was 50 μm. The natural gas flow rate was 20 m/s. FIGS. 3B-3C show the naphtha volume fraction (VF) down the length of the pipe in the x-direction using the prior art injection quill design.

EXAMPLES

The injection quill designs may be used to coat a pipe wall with a filmer or to disperse a chemical treatment, such as a scavenger, in a hydrocarbon stream. When coating a pipe wall or other processing equipment, the coating process may be improved by increasing the volume fraction of the filmer ("first fluid") on the pipe walls along the length of the pipe. Thus, the volume fraction (VF) of naphtha was evaluated using different quill designs. When dispersing a chemical treatment throughout a process stream, the dispersion process may be improved by minimizing the decrease in velocity of the process stream being treated ("second fluid") caused by the stem and when injecting the first fluid. Thus, the fluid velocity was also evaluated using different quill designs.

For the examples, the effects of location angle θ, the chamfer angle (α), and the number of orifices, on volume fraction and fluid velocity were simulated using Computational Fluid Dynamics ("CFD") model. Multiphase fluid systems were developed for the CFD models. Simulations were performed using a bulk multiphase method and an individual particle tracking method to analyze the behavior of the injected particles.

The system used was a HP Work station Z400 computer using FLUENT® 14.0 software, ANSYS-CFX 14.0 software (ANSYS, Inc. Canonsburg, Pa.) and HyperMesh 10.0 (HyperWorks, Altair, Inc. Troy, Mich.). The fluid system was modeled after a naphtha-natural gas (liquid in gas) system. The first fluid was liquid naphtha with a density of 780 kg/m$^3$. The average droplet size distribution of the treatment chemical may also improve the treatment chemical's efficiency, thus the naphtha average particle diameter was set to 50 μm. The second fluid was natural gas (primarily methane) with a density of 0.717 kg/m$^3$. The fluid containment system was a pipe with a diameter (D) of 24 inches and a total length 15D. The injection quill extended through the pipe wall at the length 5D. The stem (8) of the injection quill had a major axis (A) with a diameter of ¾" and a minor axis (B) with a diameter of ⅜".

Example Set 1

Number of Orifices

Example Set 1 shows the effects of the number of orifices on the volume fraction of naphtha and velocity of the fluid in the pipe. The effects were simulated for a stem with two orifices and compared with a stem with four orifices. The inner diameter (16) of the orifice was ⅛". The chamfer angle (α) was 60° and the chamfer length was 0.226", the entire thickness of the stem sidewall (14). The orifice location angles θ and θ' were 75° and −75° respectively for all the simulations in Example Set 1.

For the simulations with two orifices, the distance (z) for the two orifices was 12" from the pipe wall. For the simulations with four orifices, the distance ($z_1$) for the first orifice pair was six inches from the pipe wall and the distance ($z_2$) for the second orifice pair was 12 inches from the pipe wall. The data for the two-orifice and four-orifice simulations are summarized in Table 1 below.

TABLE 1

| location (m) | naphtha VF | natural gas velocity (m/s) | naphtha FR (kg/s) | natural gas FR (kg/s) | volumetric flow ratio (naphtha/natural gas) |
|---|---|---|---|---|---|
| TWO ORIFICES - Naphtha Volume Fraction on Pipe Wall = 1.98E−11 | | | | | |
| x = 3.07 | 7.10E−07 | 19.1 | 4.58E−09 | 5.00E−04 | 8.42E−09 |
| x = 4 | 1.85E−07 | 18.9 | 6.63E−07 | 1.10E−03 | 5.54E−07 |
| x = 5 | 1.81E−07 | 19.0 | 9.26E−07 | 1.90E−03 | 4.48E−07 |
| x = 6 | 1.79E−07 | 18.9 | 2.04E−06 | 5.40E−03 | 3.47E−07 |
| x = 7 | 1.78E−07 | 18.9 | 2.19E−06 | 7.00E−03 | 2.88E−07 |
| x = 8 | 1.78E−07 | 18.9 | 2.10E−06 | 7.10E−03 | 2.72E−07 |
| x = 9 | 1.76E−07 | 19.0 | 2.19E−06 | 8.00E−03 | 2.52E−07 |
| FOUR ORIFICES - Naphtha Volume Fraction on Pipe Wall = 6.58E−10 | | | | | |
| x = 3.07 | 6.37E−07 | 19.1 | 5.39E−09 | 5.50E−04 | 9.01E−09 |
| x = 4 | 1.86E−07 | 18.9 | 4.85E−07 | 1.10E−03 | 4.05E−07 |
| x = 5 | 1.84E−07 | 19.0 | 8.14E−07 | 2.00E−03 | 3.74E−07 |
| x = 6 | 1.80E−07 | 18.9 | 1.63E−06 | 4.80E−03 | 3.12E−07 |
| x = 7 | 1.79E−07 | 18.9 | 1.85E−06 | 5.50E−03 | 3.09E−07 |
| x = 8 | 1.79E−07 | 18.9 | 1.36E−06 | 5.00E−03 | 2.50E−07 |
| x = 9 | 1.77E−07 | 19.0 | 1.73E−06 | 6.50E−03 | 2.45E−07 |

* VF = Volume Fraction; FR—Mass Flow Rate

Figure 4A:
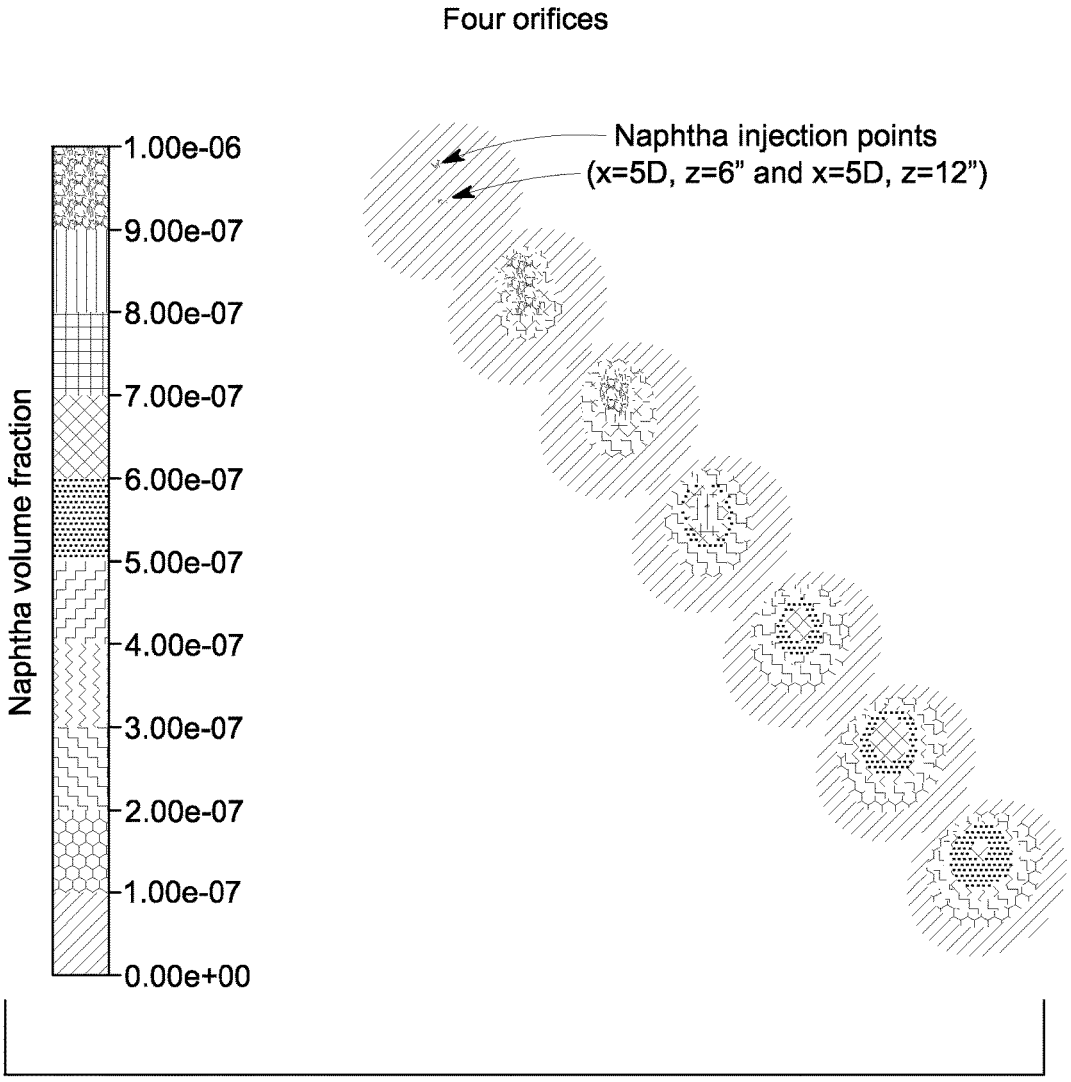
FIG. 4A is a cross-sectional view perpendicular to the direction of flow and shows the naphtha volume fraction using an injection quill with four orifices.
Figure 4B:
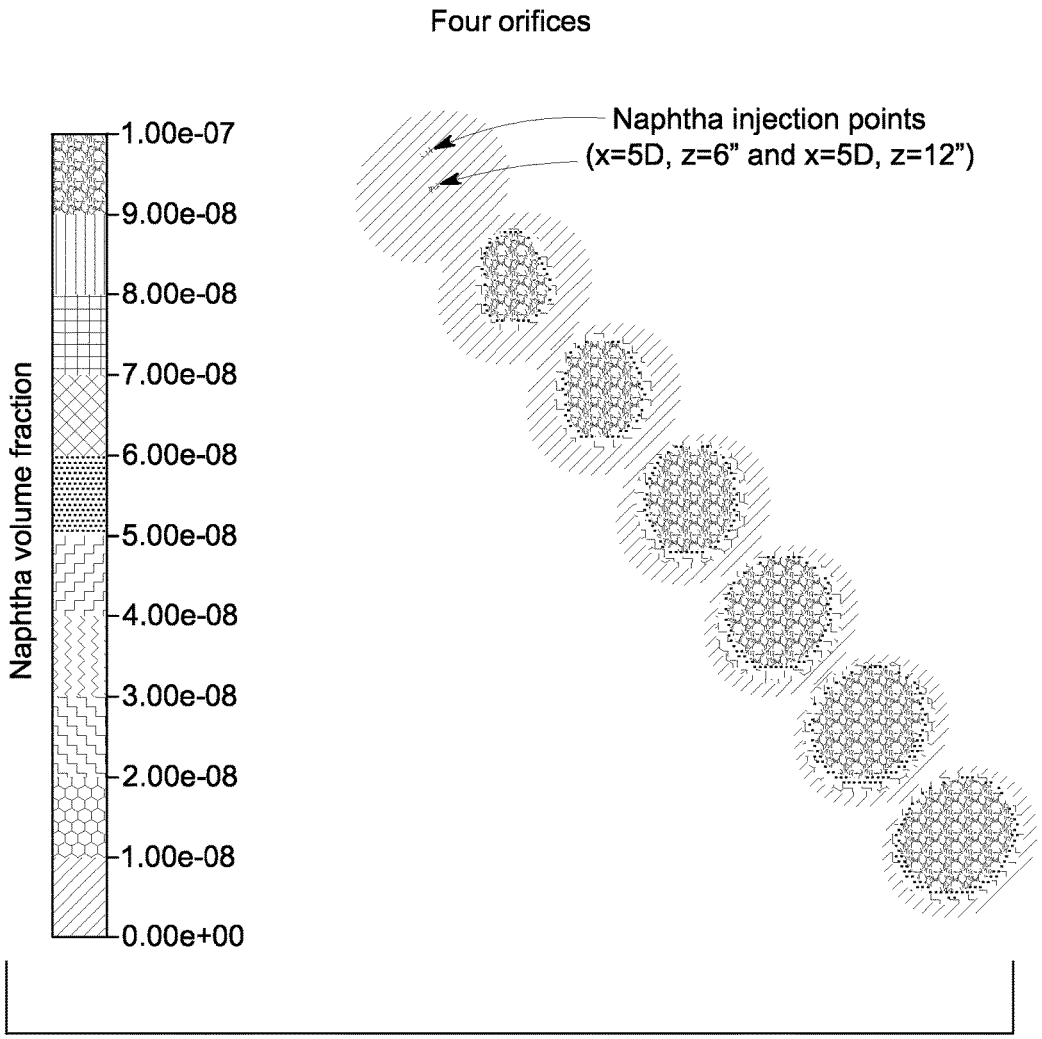
FIG. 4B is a cross-sectional view perpendicular to the direction of flow and shows the naphtha volume fraction using an injection quill with four orifices.
Figure 4C:
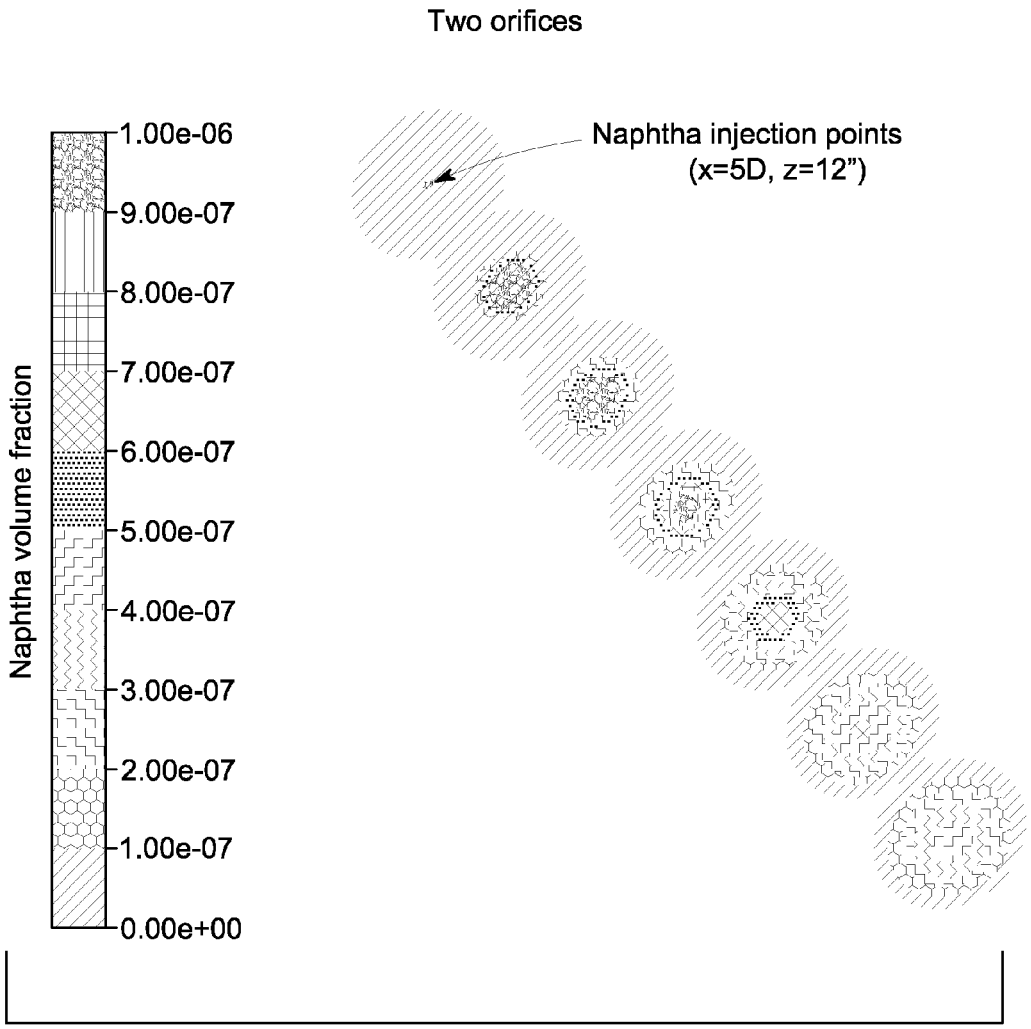
FIG. 4C is a cross-sectional view perpendicular to the direction of flow and shows the naphtha volume fraction using an injection quill with two orifices.
Figure 4D:
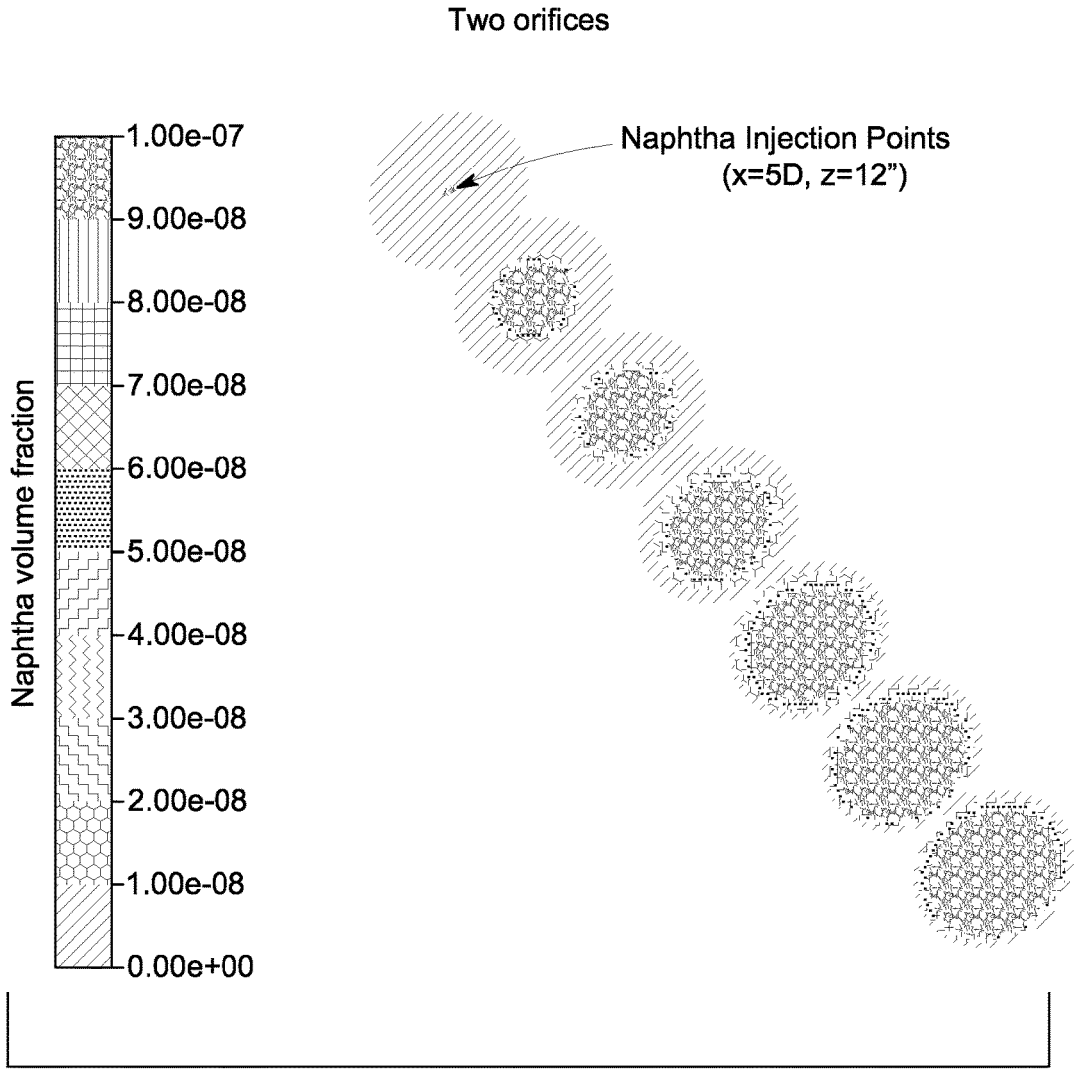
FIG. 4D is a cross-sectional view perpendicular to the direction of flow and shows the naphtha volume fraction using an injection quill with two orifices.
Figure 5A:
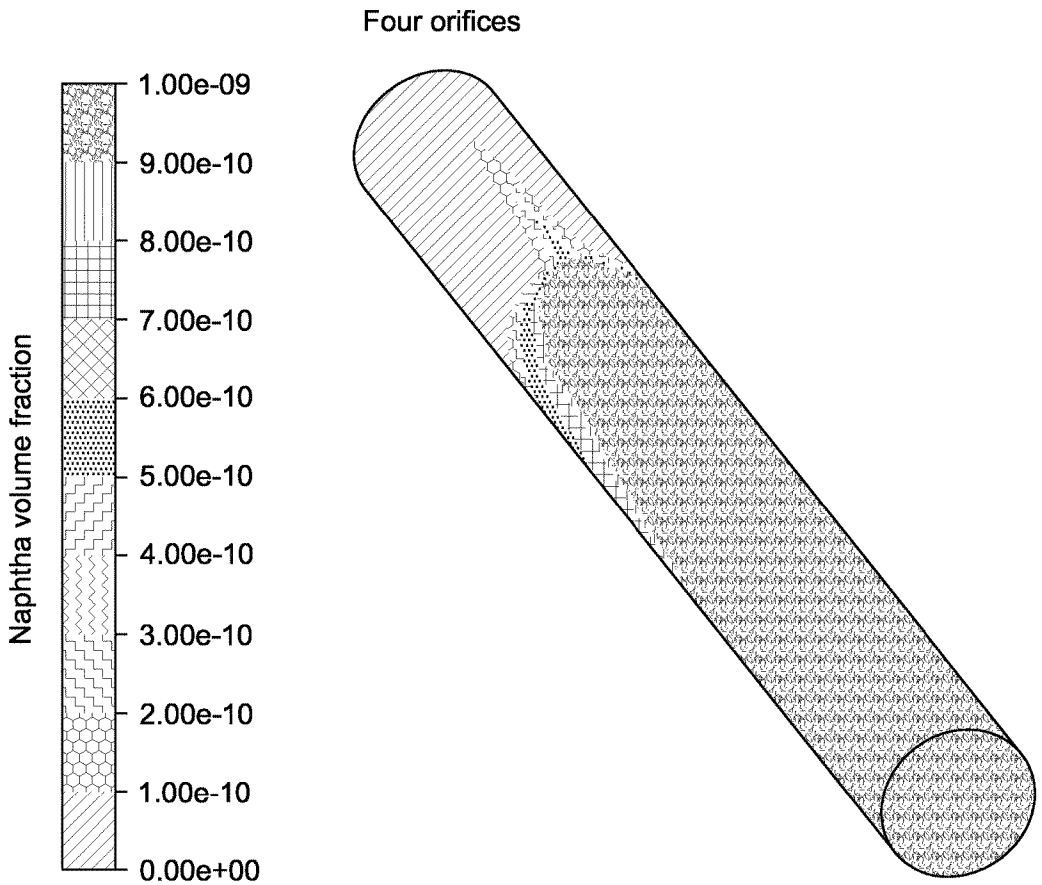
FIG. 5A shows a three-dimensional view of the naphtha volume fraction using an injection quill with four orifices.
Figure 5B:
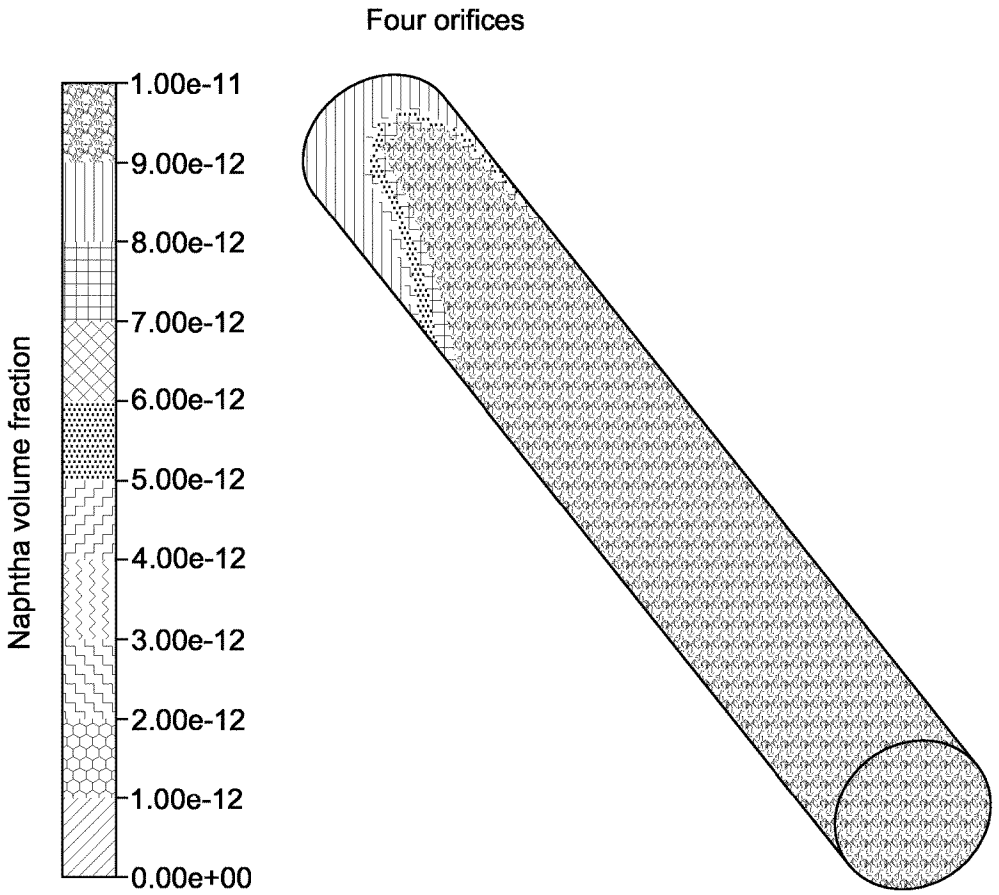
FIG. 5B shows a three-dimensional view of the naphtha volume fraction using an injection quill with four orifices.
Figure 5C:
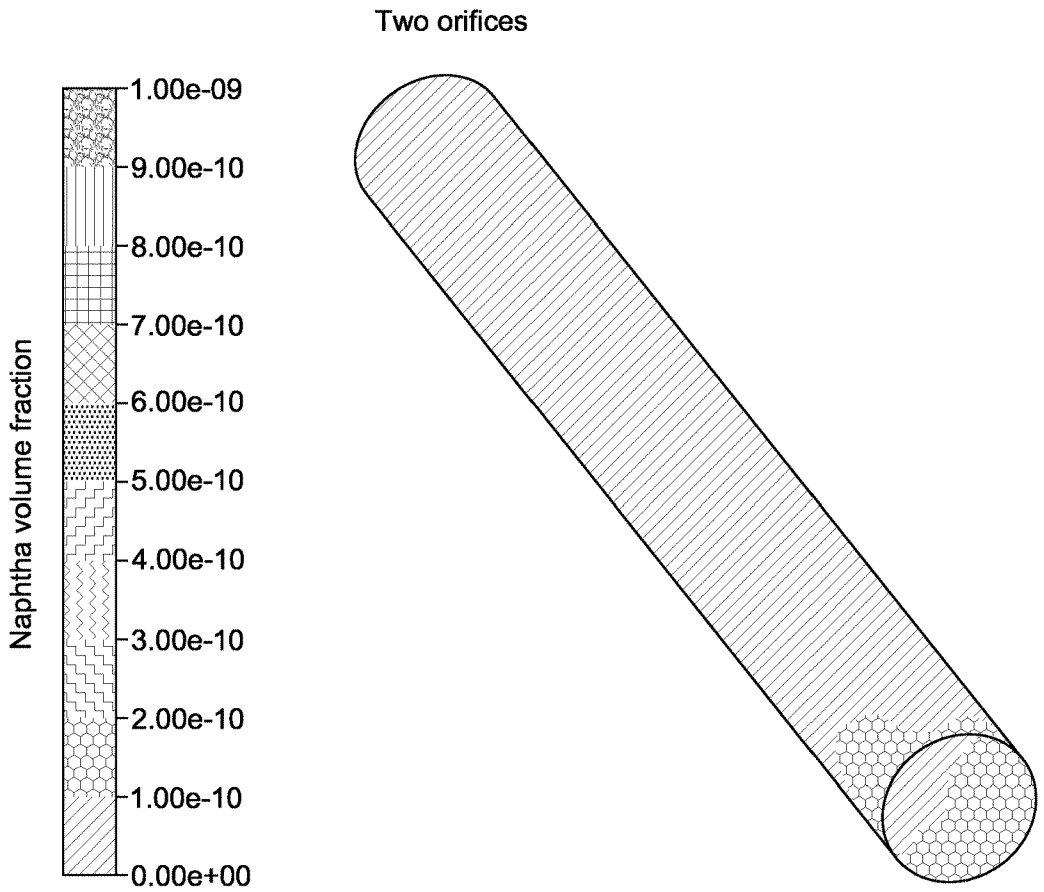
FIG. 5C shows a three-dimensional view of the naphtha volume fraction using an injection quill with two orifices.
Figure 5D:
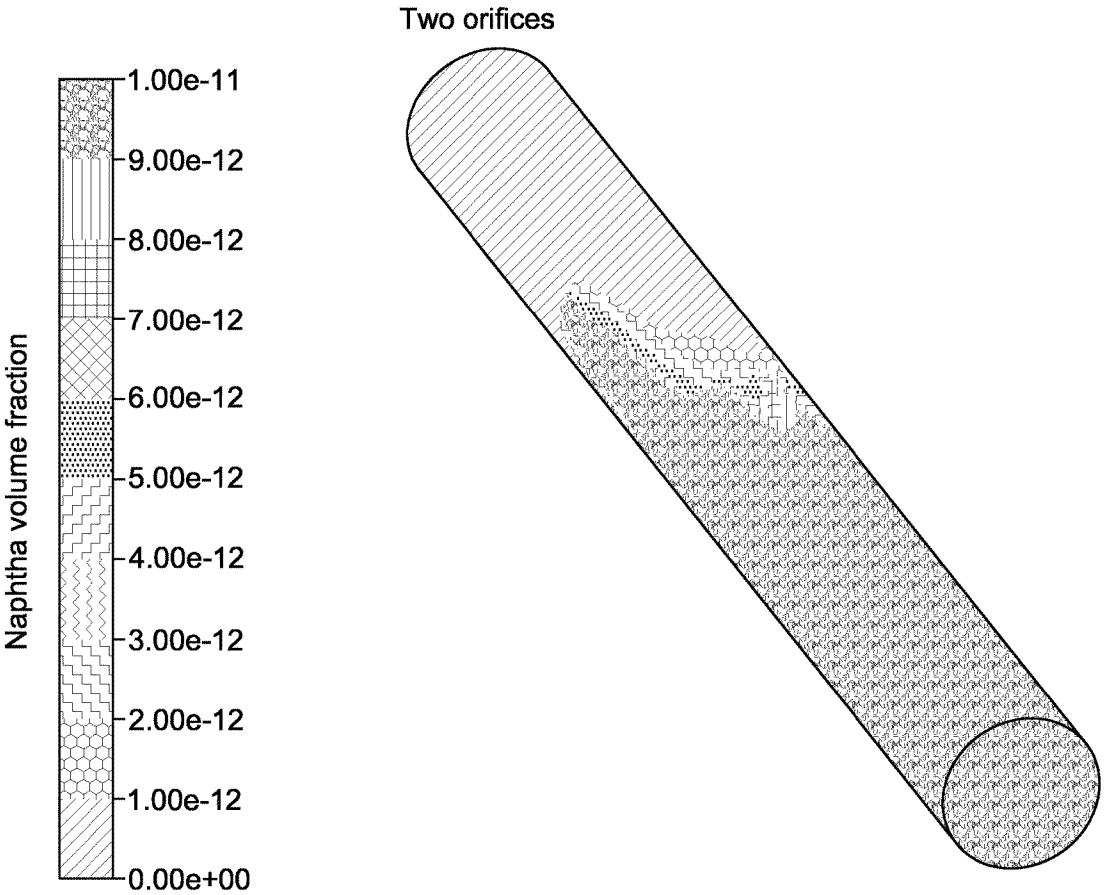
FIG. 5D shows a three-dimensional view of the naphtha volume fraction using an injection quill with two orifices.
Figure 6A:
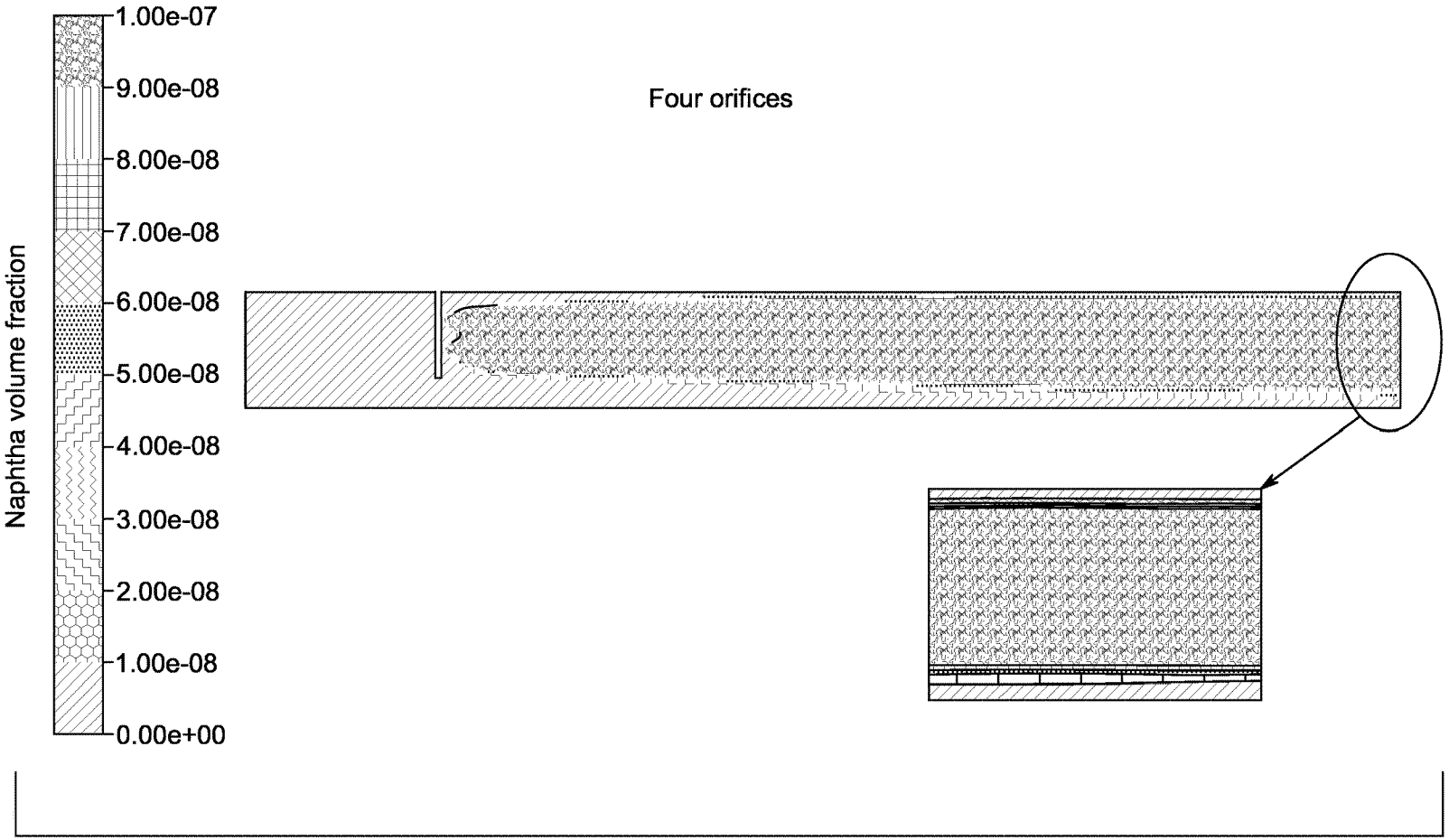
FIG. 6A is a cross-sectional view parallel to the direction of flow and shows the naphtha volume fraction using an injection quill with four orifices.
Figure 6B:
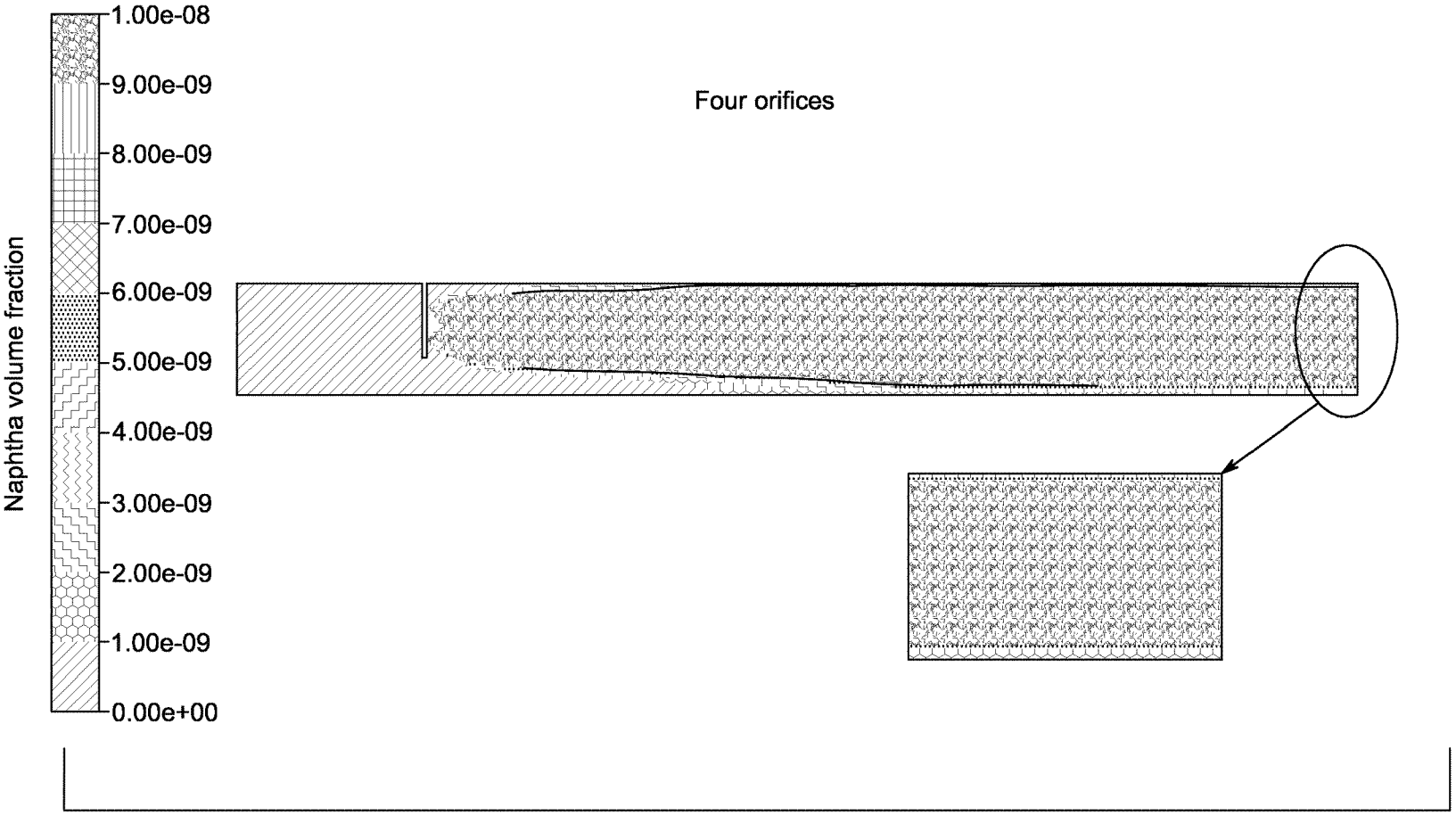
FIG. 6B is a cross-sectional view parallel to the direction of flow and shows the naphtha volume fraction using an injection quill with four orifices.
Figure 6C:
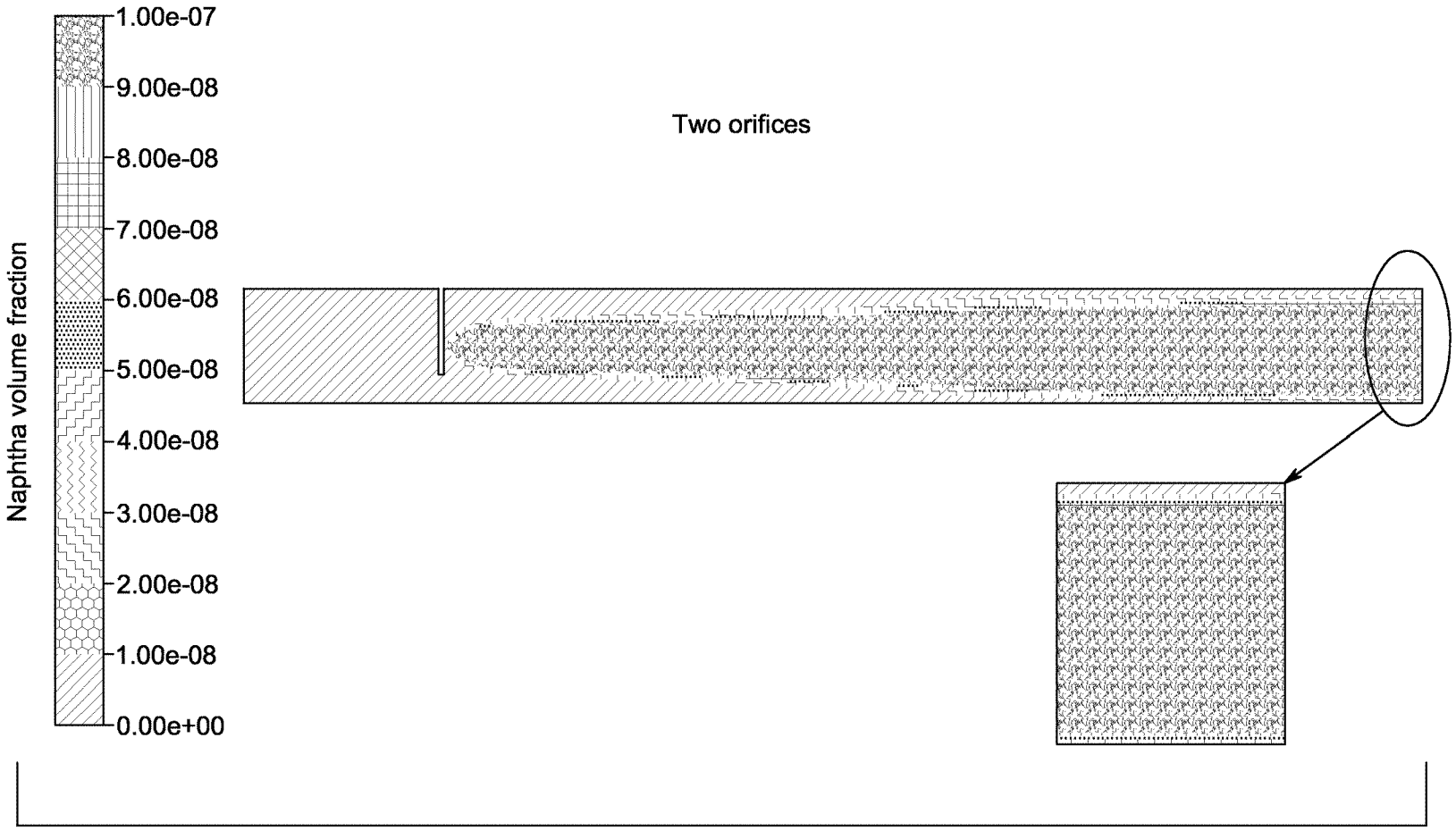
FIG. 6C is a cross-sectional view parallel to the direction of flow and shows the naphtha volume fraction using an injection quill with two orifices.
Figure 6D:
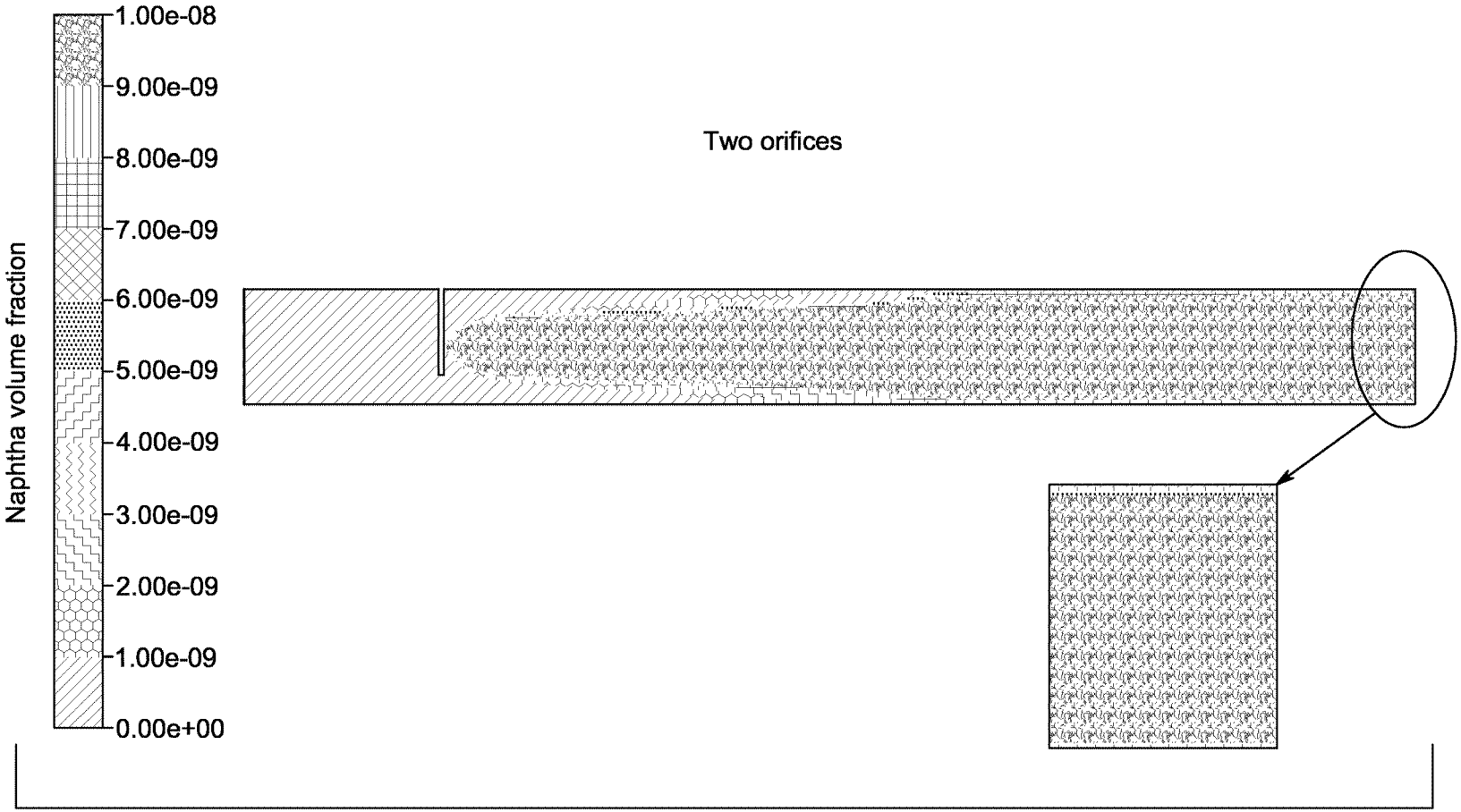
FIG. 6D is a cross-sectional view parallel to the direction of flow and shows the naphtha volume fraction using an injection quill with two orifices.
Figure 7:
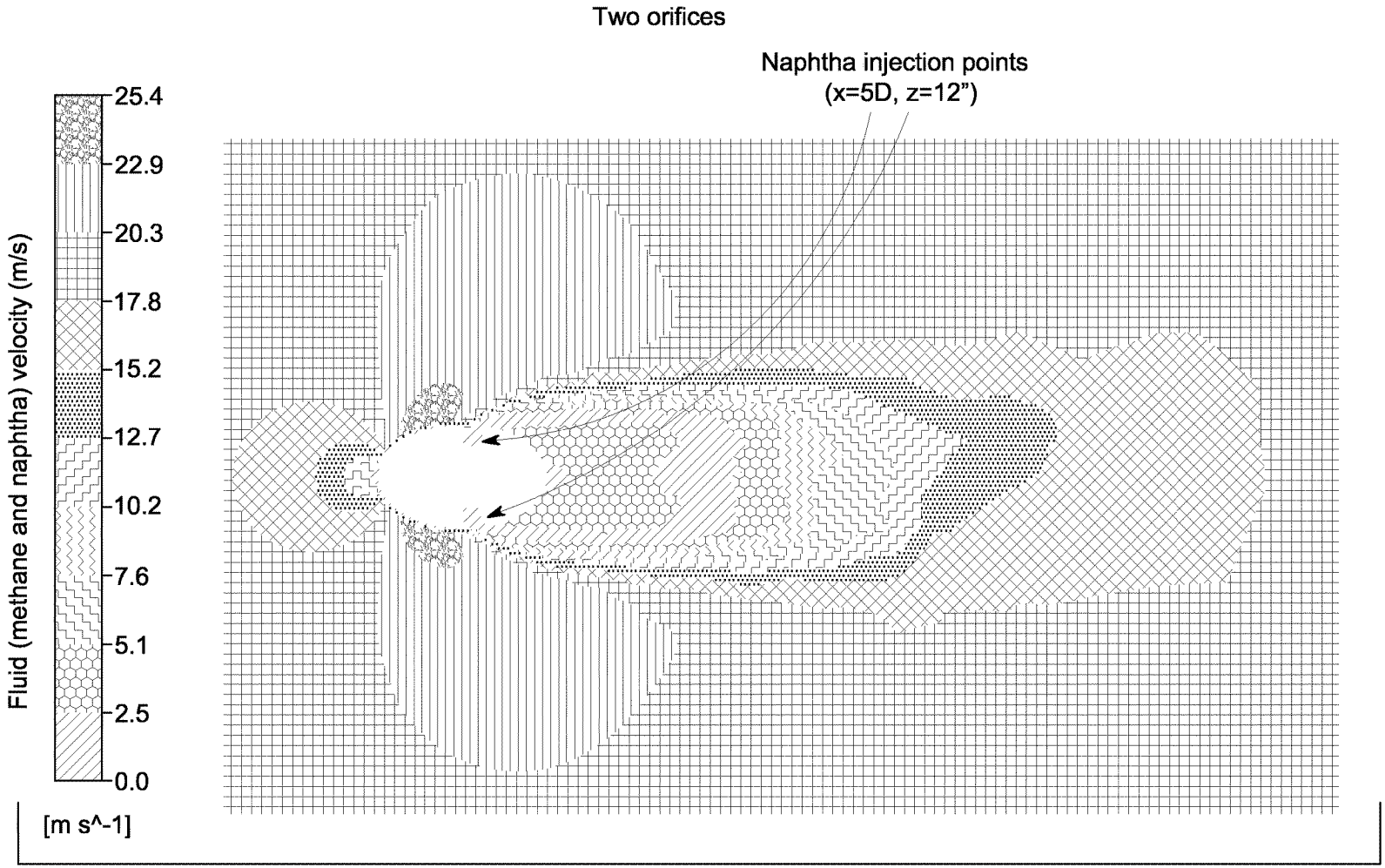
FIG. 7 is a cross-sectional view of an injection quill with two orifices that shows the fluid velocity profile.
Figure 8:
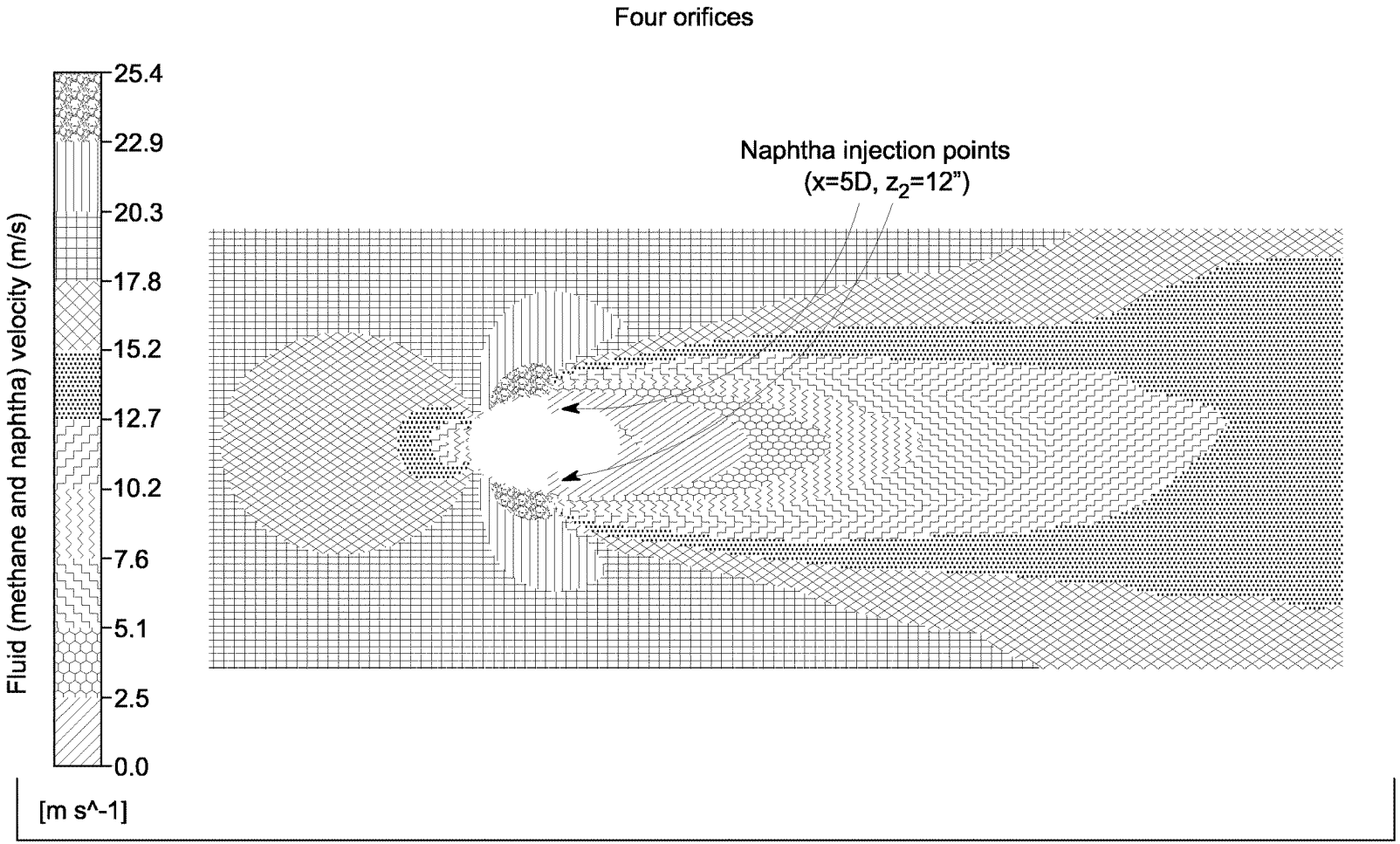
FIG. 8 is a cross-sectional view of the second pair of orifices ($z_2$=12") of injection quill with four orifices and shows the fluid velocity profile.
Figure 9:
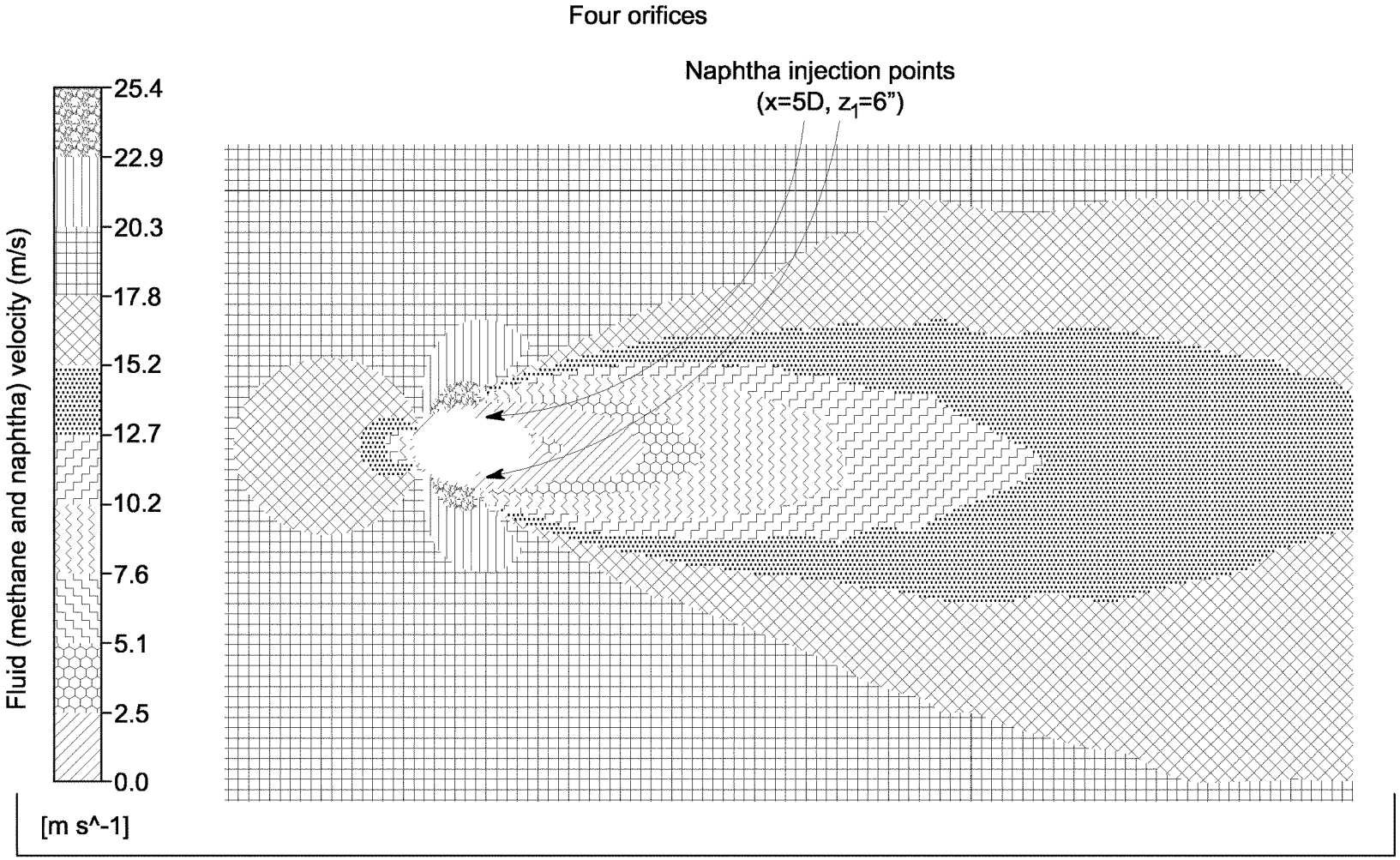
FIG. 9 is a cross-sectional view of the first pair of orifices ($z_1$=6") of injection quill with four orifices and shows the fluid velocity profile.
Figure 10:
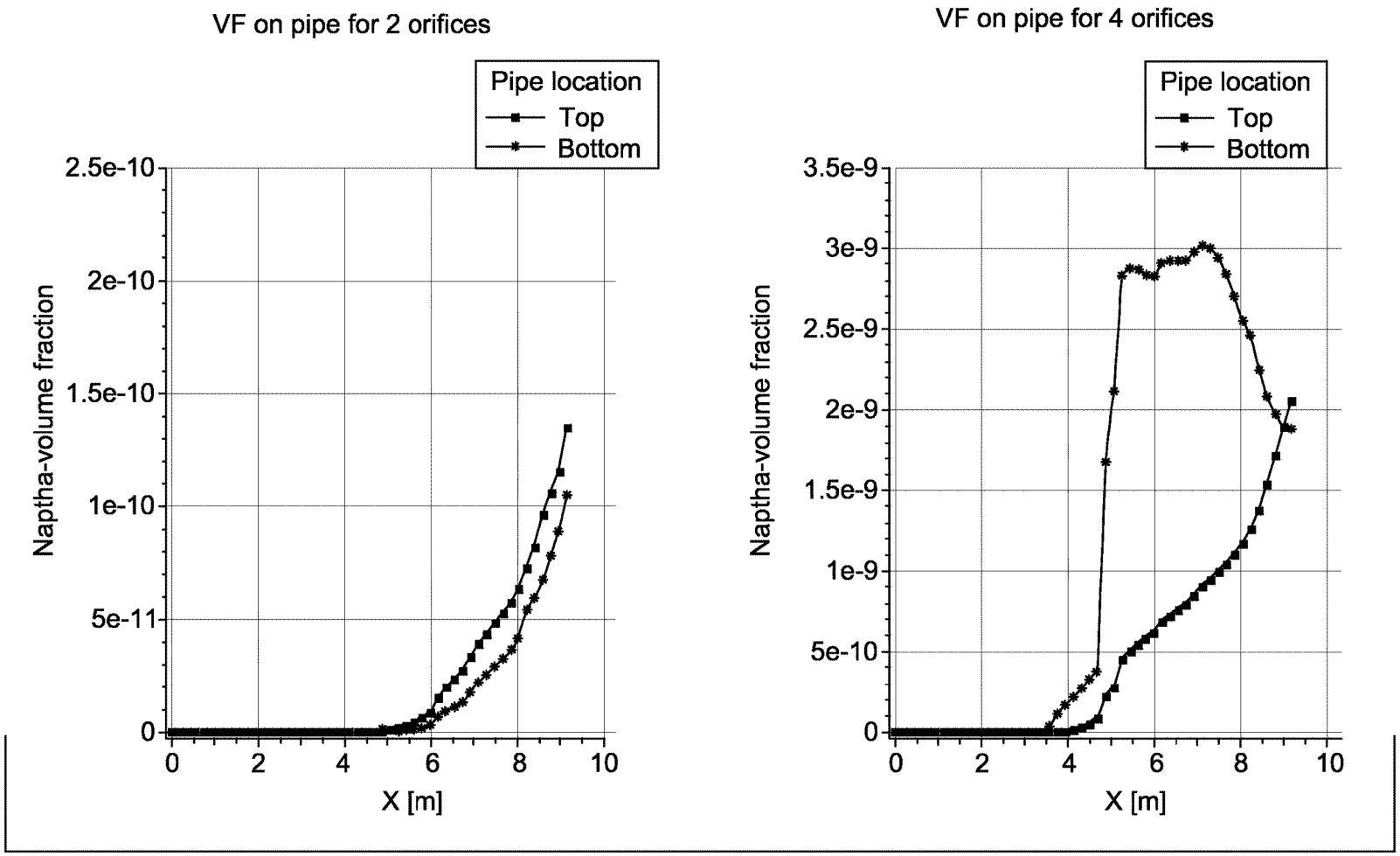
FIG. 10 shows two graphs of the naphtha volume fraction (VF) on a pipe wall. The graph on the left shows the naphtha VF for two orifices and the graph on the right shows the naphtha VF for four orifices.

FIGS. 4A and 4B are cross-sectional views perpendicular to the second fluid's direction of flow and show the effect four orifices have on the naphtha volume fraction (VF) down the length of the pipe in the x-direction. FIGS. 4C and 4D are cross-sectional views perpendicular to the second fluid's direction of flow and show the effect two orifices have on the naphtha volume fraction (VF) down the length of the pipe in the x-direction. FIGS. 5A and 5B are three-dimensional representations of the effect four orifices have on the naphtha volume fraction (VF) down the length of the pipe in the x-direction. FIGS. 5C and 5D are three-dimensional representations and show the effect two orifices have on the naphtha volume fraction (VF) down the length of the pipe in the x-direction. FIGS. 6A and 6B are cross-sectional views parallel to the second fluid's direction of flow and show the effect four orifices have on the naphtha volume fraction (VF)

down the length of the pipe. FIGS. 6C and 6D are cross-sectional views parallel to the second fluid's direction of flow and show the effect two orifices have on the naphtha volume fraction (VF) down the length of the pipe. FIG. 7 is a cross-sectional view of a quill stem with two orifices that shows the velocity profile of the fluids (natural gas and naphtha) down the length of the pipe in the x-direction. The orifices in FIG. 7 are located at z=12" (center of the pipe diameter). FIG. 8 is a cross-sectional view of a quill stem with four orifices that shows the velocity profile of the fluids (natural gas and naphtha) down the length of the pipe in the x-direction. The orifices in FIG. 8 are located at $z_2$=12" (center of the pipe diameter). FIG. 9 is a cross-sectional view of a quill stem with four orifices that shows the velocity profile of the fluids (natural gas and naphtha) around the orifices located at $z_1$=6" down the length of the pipe in the x-direction. FIG. 10 shows two line graphs of the naphtha VF at the top and the bottom of the pipe for an injection quill with two orifices and four orifices respectively.

Example Set 2

Chamfer Angle

Example Set 2 shows the effects of the chamfer angle (α) on the volume fraction (VF) of naphtha and velocity of the fluid in the pipe. The effects were simulated for a stem with one orifice located at θ=0° and z=12". The inner diameter (16) of the orifice was ⅛" and stem sidewall (14) thickness was 0.226". The chamfer length was the entire thickness of the stem sidewall, i.e., 0.226". The chamfer angles (α) tested were 7.3°, 30°, 60°, and 70°. The data for the chamfer angle simulations are summarized in Table 2 below.

TABLE 2

| location (m) | naphtha VF | natural gas velocity (m/s) | naphtha FR (kg/s) | natural gas FR (kg/s) | volumetric flow ratio (naphtha/natural gas) |
|---|---|---|---|---|---|
| α = 7.3°; Naphtha Volume Fraction on Pipe Wall = 1.97E−11 | | | | | |
| x = 3.07 | 3.15E−06 | 19.1 | 1.95E−09 | 5.30E−04 | 3.386E−09 |
| x = 4 | 1.79E−07 | 18.9 | 6.36E−07 | 1.10E−03 | 5.31E−07 |
| x = 5 | 1.77E−07 | 19.0 | 8.81E−07 | 2.00E−03 | 4.05E−07 |
| x = 6 | 1.74E−07 | 18.9 | 2.07E−06 | 5.70E−03 | 3.34E−07 |
| x = 7 | 1.73E−07 | 18.9 | 2.03E−06 | 6.80E−03 | 2.74E−07 |
| x = 8 | 1.72E−07 | 18.9 | 2.29E−06 | 7.80E−03 | 2.70E−07 |
| x = 9 | 1.72E−07 | 19.0 | 1.95E−06 | 7.60E−03 | 2.36E−07 |
| α = 30°; Naphtha Volume Fraction on Pipe Wall = 2.42E−11 | | | | | |
| x = 3.07 | 2.64E−06 | 19.0 | 2.12E−09 | 5.00E−04 | 3.90E−09 |
| x = 4 | 1.80E−07 | 18.9 | 6.35E−07 | 1.10E−03 | 5.31E−07 |
| x = 5 | 1.77E−07 | 19.0 | 9.27E−07 | 2.00E−03 | 4.26E−07 |
| x = 6 | 1.73E−07 | 18.9 | 1.79E−06 | 5.00E−03 | 3.29E−07 |
| x = 7 | 1.76E−07 | 18.9 | 2.10E−06 | 6.80E−03 | 2.84E−07 |
| x = 8 | 1.69E−07 | 18.9 | 2.22E−06 | 7.90E−03 | 2.58E−07 |
| x = 9 | 1.31E−07 | 19.0 | 1.37E−06 | 7.30E−03 | 1.73E−07 |
| α = 60°; Naphtha Volume Fraction on Pipe Wall = 3.04E−11 | | | | | |
| x = 3.07 | 7.18E−06 | 19.0 | 3.42E−09 | 5.00E−04 | 6.29E−09 |
| x = 4 | 2.96E−07 | 18.9 | 1.06E−07 | 1.10E−03 | 8.86E−07 |
| x = 5 | 2.93E−07 | 19.0 | 1.50E−07 | 1.90E−03 | 7.26E−07 |
| x = 6 | 2.88E−07 | 18.9 | 2.84E−06 | 5.10E−03 | 5.12E−07 |
| x = 7 | 2.85E−07 | 18.9 | 3.26E−06 | 6.70E−03 | 4.47E−07 |
| x = 8 | 2.84E−07 | 18.9 | 3.36E−06 | 7.10E−03 | 4.35E−07 |
| x = 9 | 2.84E−07 | 19.0 | 3.25E−06 | 7.70E−03 | 3.88E−07 |

TABLE 2-continued

| location (m) | naphtha VF | natural gas velocity (m/s) | naphtha FR (kg/s) | natural gas FR (kg/s) | volumetric flow ratio (naphtha/natural gas) |
|---|---|---|---|---|---|
| α = 75°; Naphtha Volume Fraction on Pipe Wall = 1.99E−11 | | | | | |
| x = 3.07 | 2.66E−06 | 19.1 | 2.42E−09 | 5.10E−04 | 4.36E−09 |
| x = 4 | 1.79E−07 | 18.9 | 6.20E−07 | 1.10E−03 | 5.18E−07 |
| x = 5 | 1.77E−07 | 19.0 | 9.17E−07 | 2.00E−03 | 4.21E−07 |
| x = 6 | 1.74E−07 | 18.9 | 1.87E−06 | 5.40E−03 | 3.18E−07 |
| x = 7 | 1.74E−07 | 18.9 | 2.01E−06 | 6.70E−03 | 2.76E−07 |
| x = 8 | 1.73E−07 | 18.9 | 1.94E−06 | 6.90E−03 | 2.58E−07 |
| x = 9 | 1.73E−07 | 19.0 | 2.01E−06 | 7.70E−03 | 2.40E−07 |

* VF = Volume Fraction; FR—Mass Flow Rate

Figure 11A:
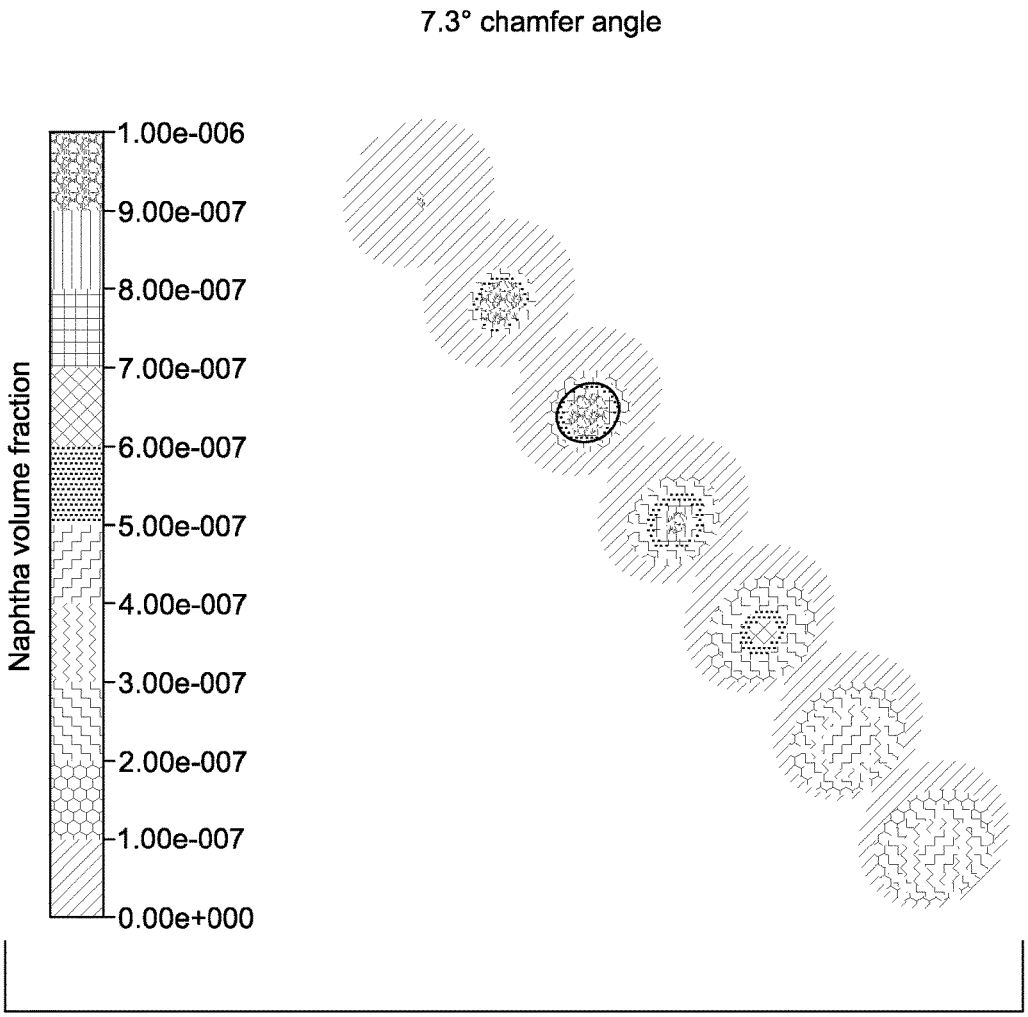
FIG. 11A is a cross-sectional view perpendicular to the direction of flow and shows the naphtha volume fraction when the orifice has a chamfer angle of 7.3°.
Figure 11B:
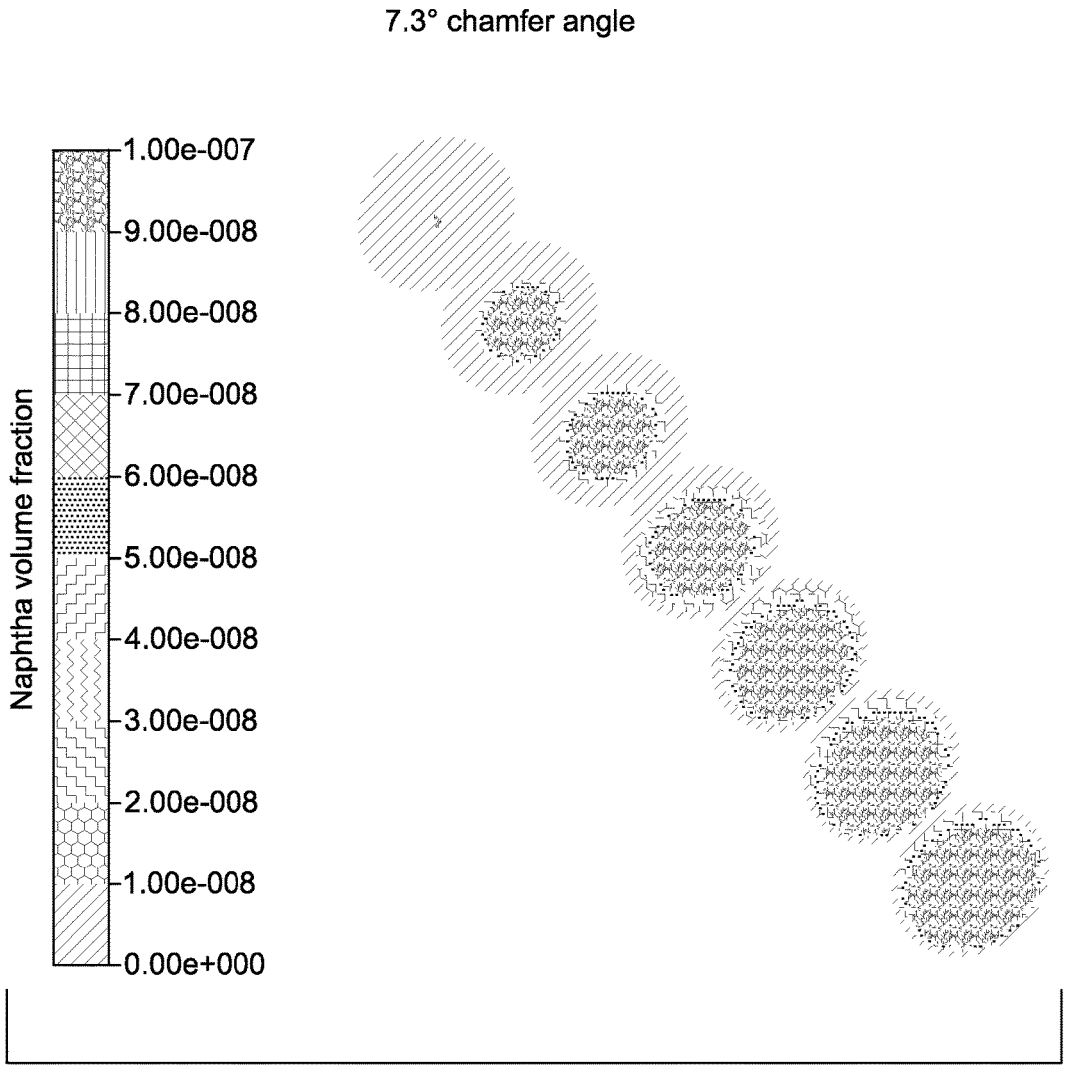
FIG. 11B is a cross-sectional view perpendicular to the direction of flow and shows the naphtha volume fraction when the orifice has a chamfer angle of 7.3°.
Figure 11C:
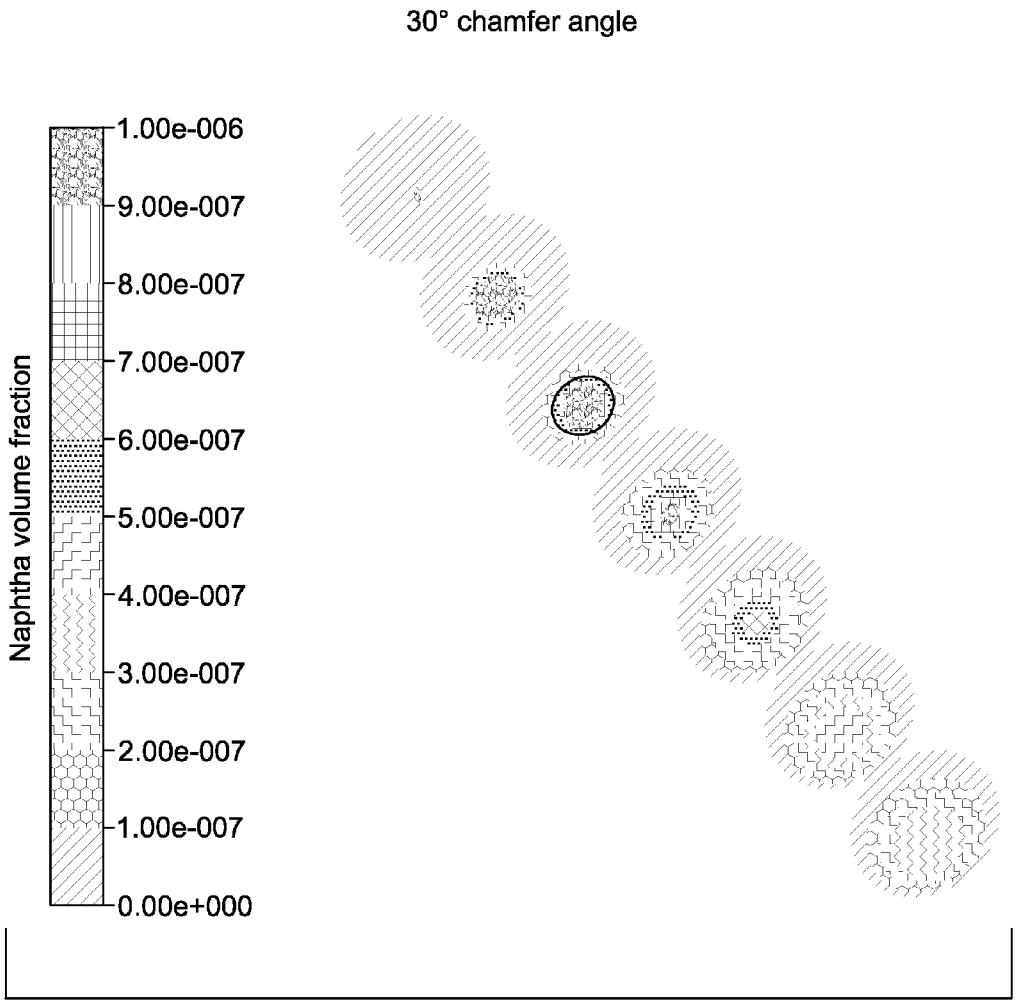
FIG. 11C is a cross-sectional view perpendicular to the direction of flow and shows the naphtha volume fraction when the orifice has a chamfer angle of 30°.
Figure 11D:
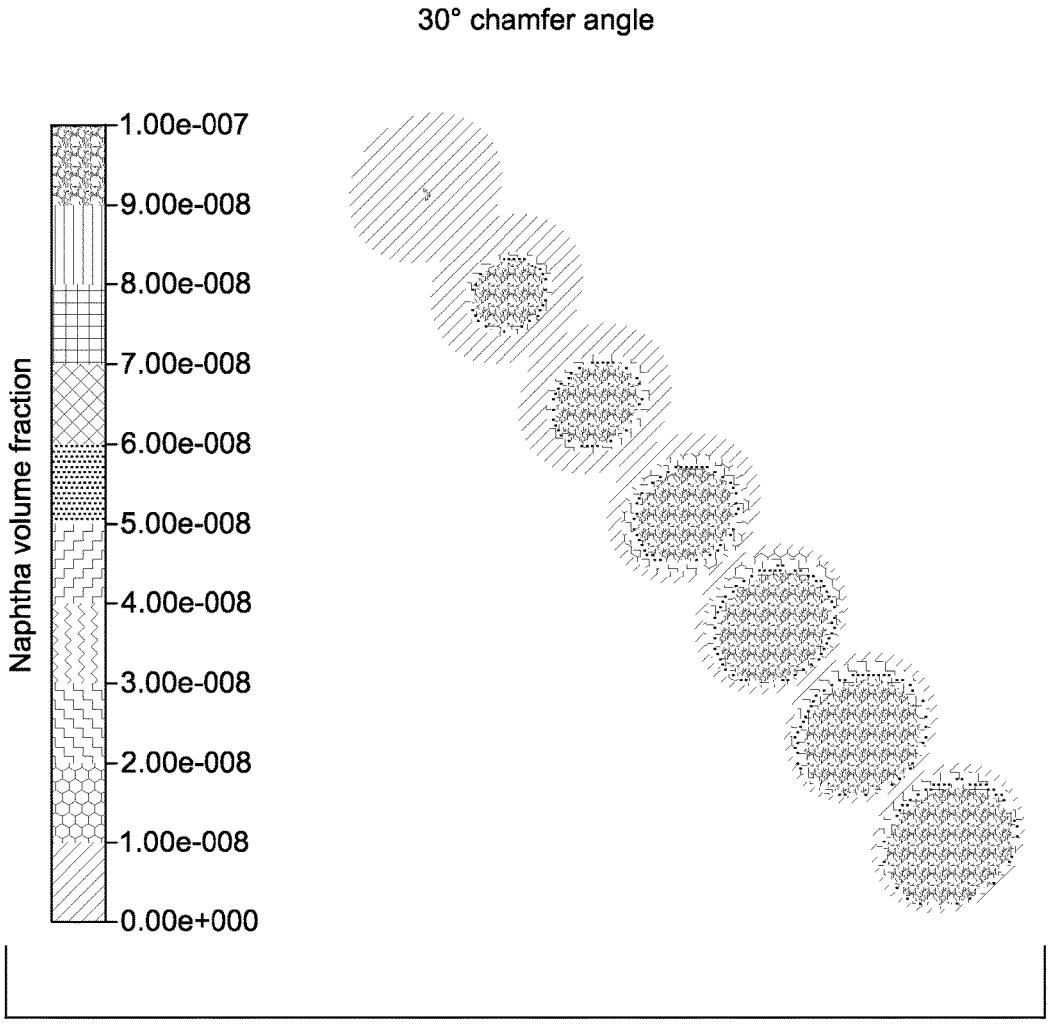
FIG. 11D is a cross-sectional view perpendicular to the direction of flow and shows the naphtha volume fraction when the orifice has a chamfer angle of 30°.
Figure 12A:
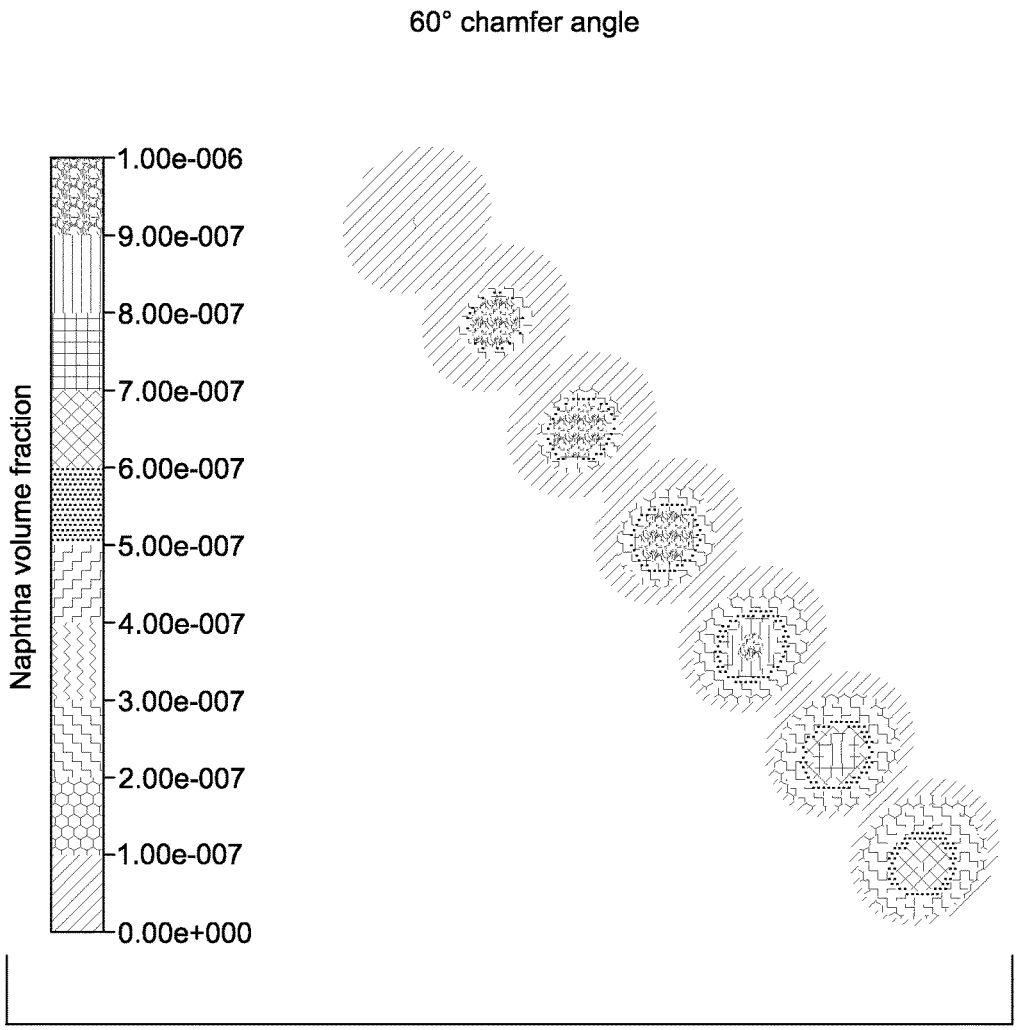
FIG. 12A is a cross-sectional view perpendicular to the direction of flow and shows the naphtha volume fraction when the orifice has a chamfer angle of 60°.
Figure 12B:
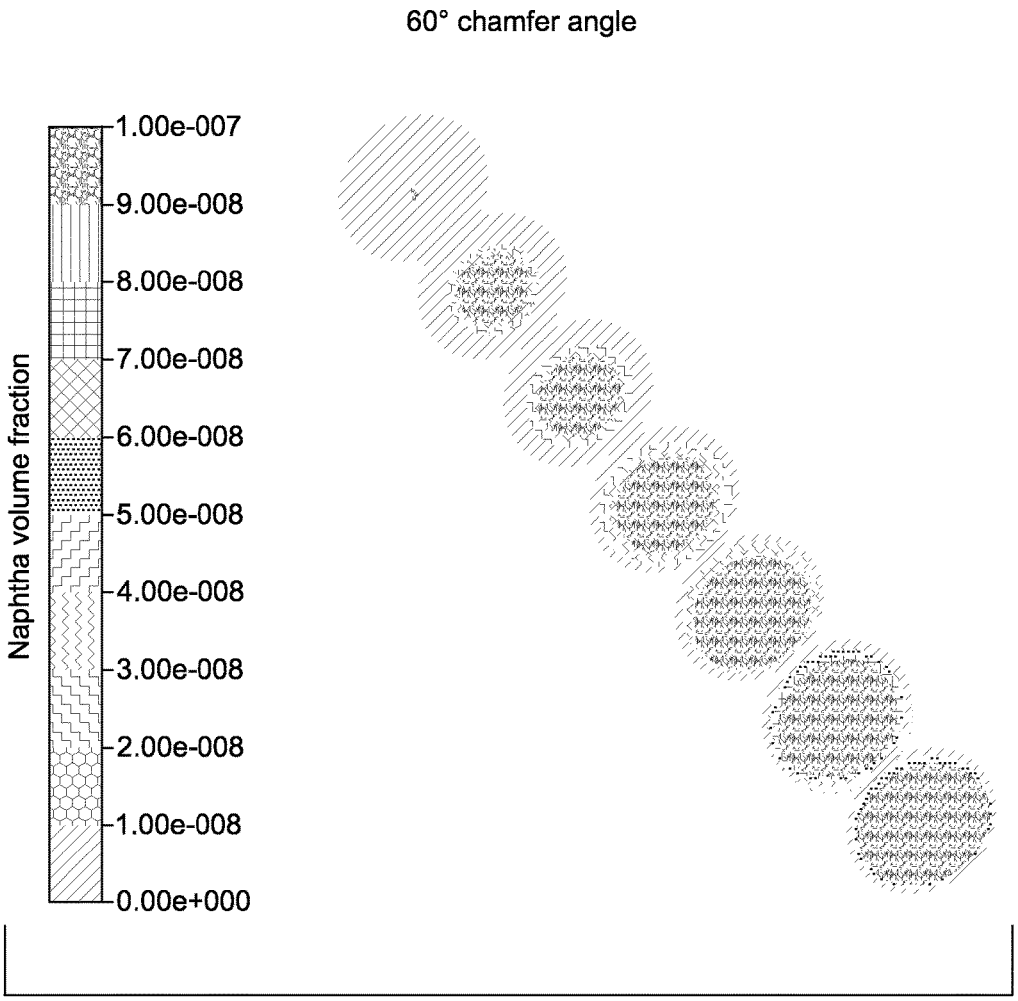
FIG. 12B is a cross-sectional view perpendicular to the direction of flow and shows the naphtha volume fraction when the orifice has a chamfer angle of 60°.
Figure 12C:
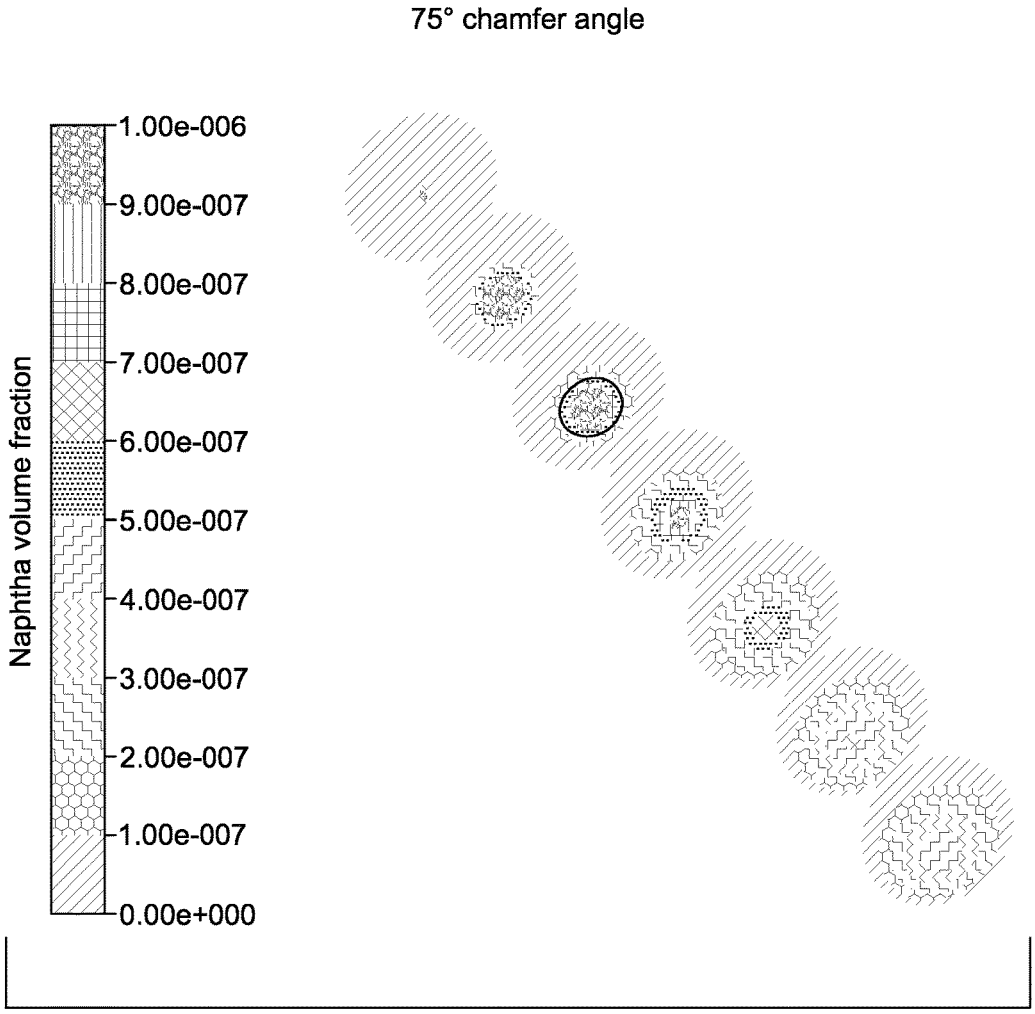
FIG. 12C is a cross-sectional view perpendicular to the direction of flow and shows the naphtha volume fraction when the orifice has a chamfer angle of 75°.
Figure 12D:
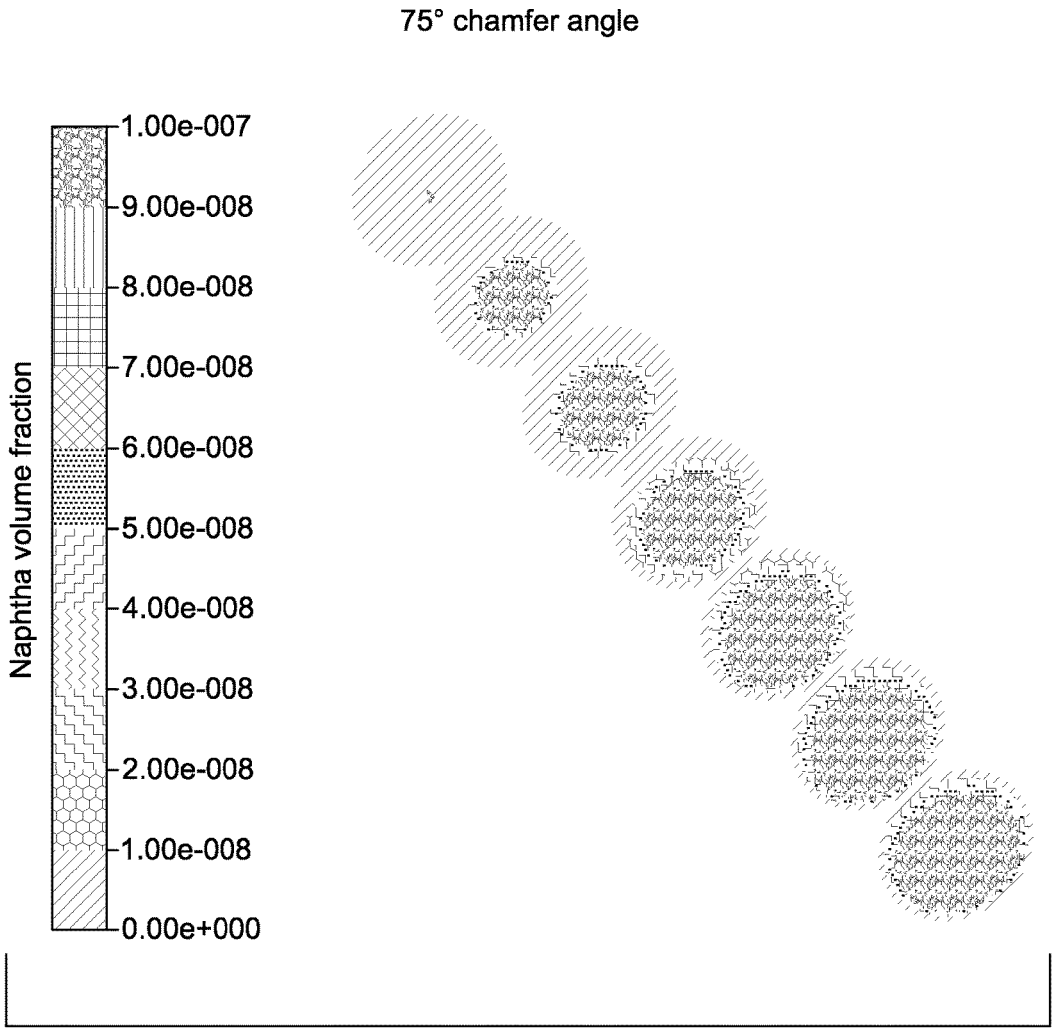
FIG. 12D is a cross-sectional view perpendicular to the direction of flow and shows the naphtha volume fraction when the orifice has a chamfer angle of 75°.
Figure 13A:
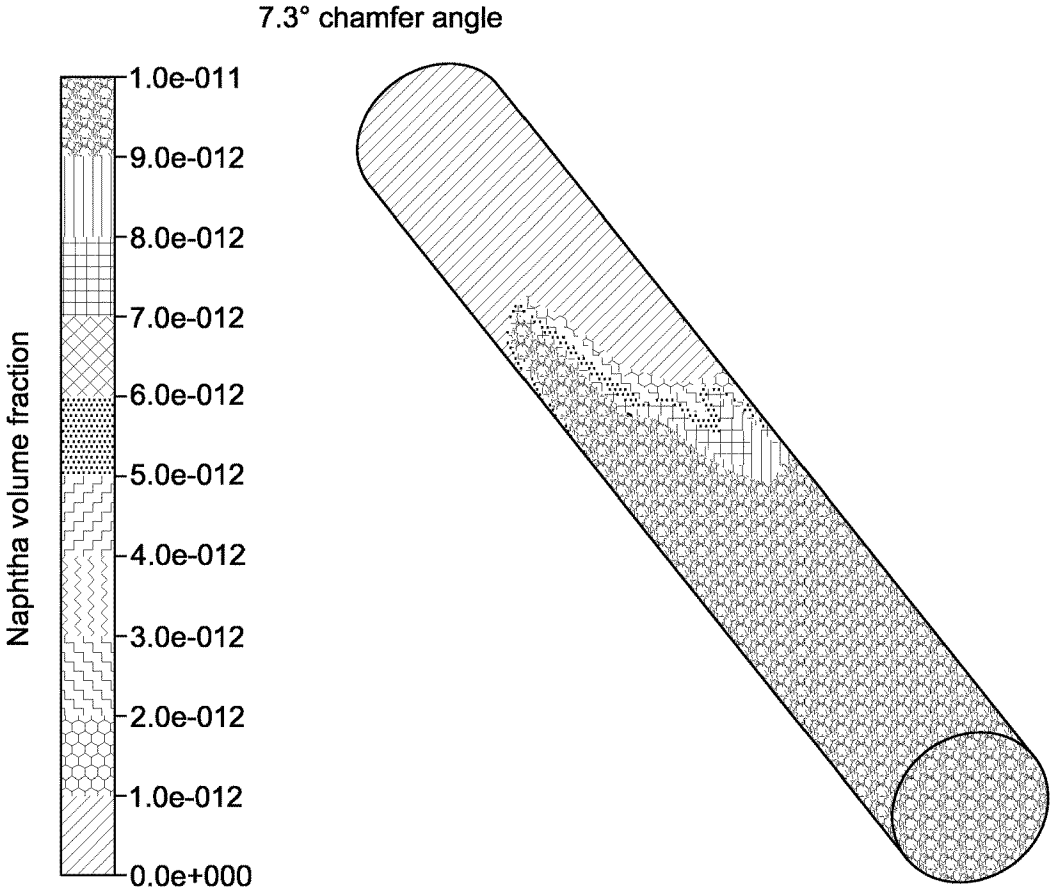
FIG. 13A is a three-dimensional view showing the naphtha volume fraction when the orifice has a chamfer angle of 7.3°.
Figure 13B:
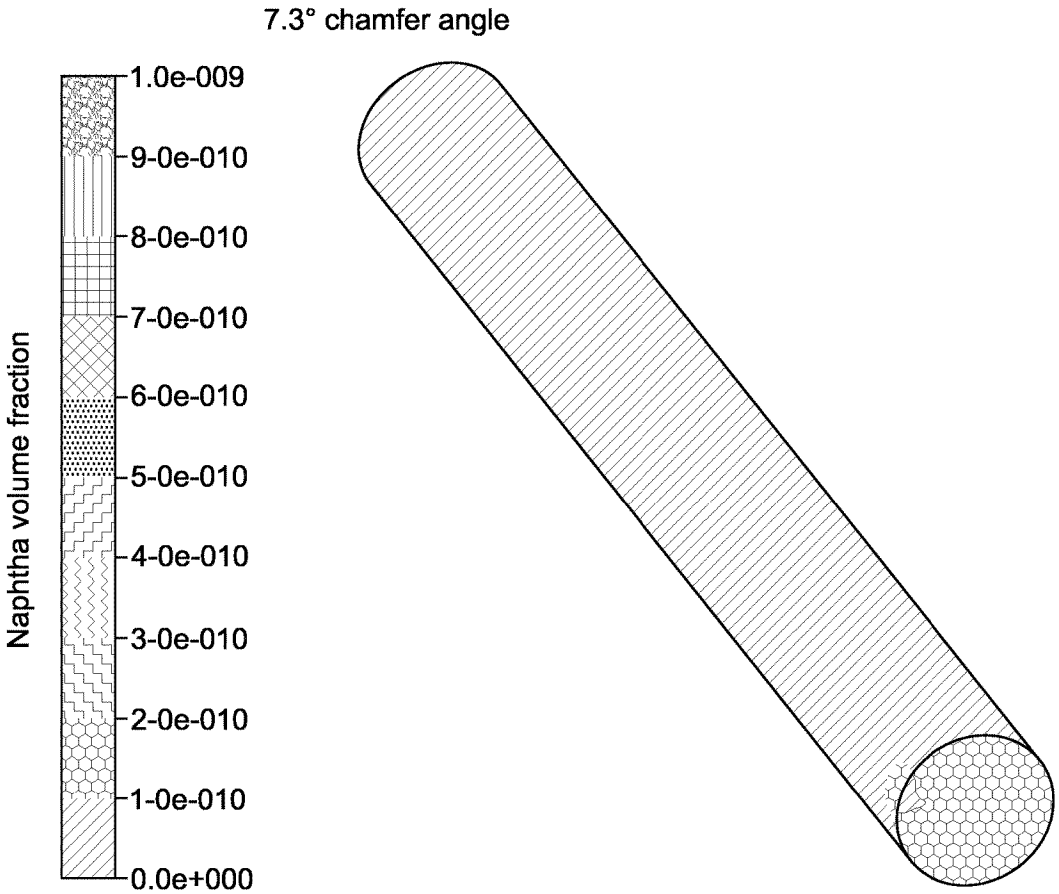
FIG. 13B is a three-dimensional view showing the naphtha volume fraction when the orifice has a chamfer angle of 7.3°.
Figure 13C:
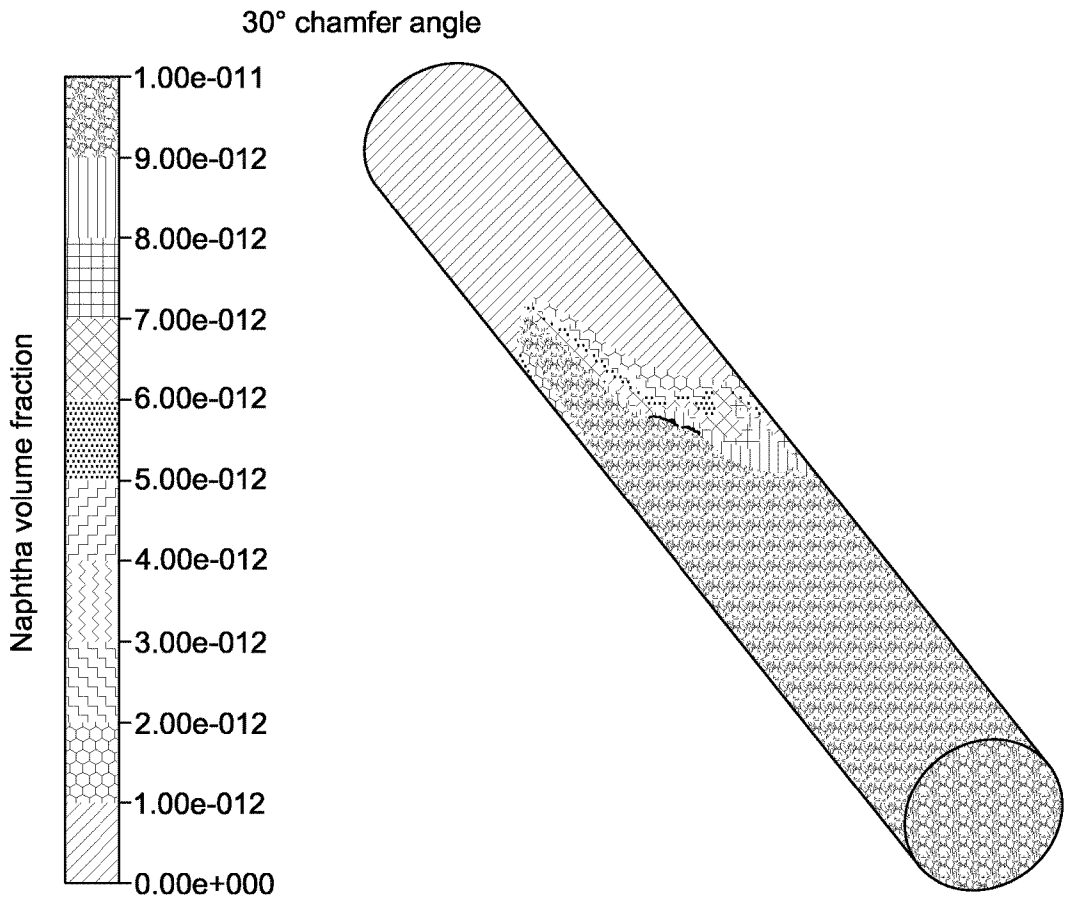
FIG. 13C is a three-dimensional view showing the naphtha volume fraction when the orifice has a chamfer angle of 30°.
Figure 13D:
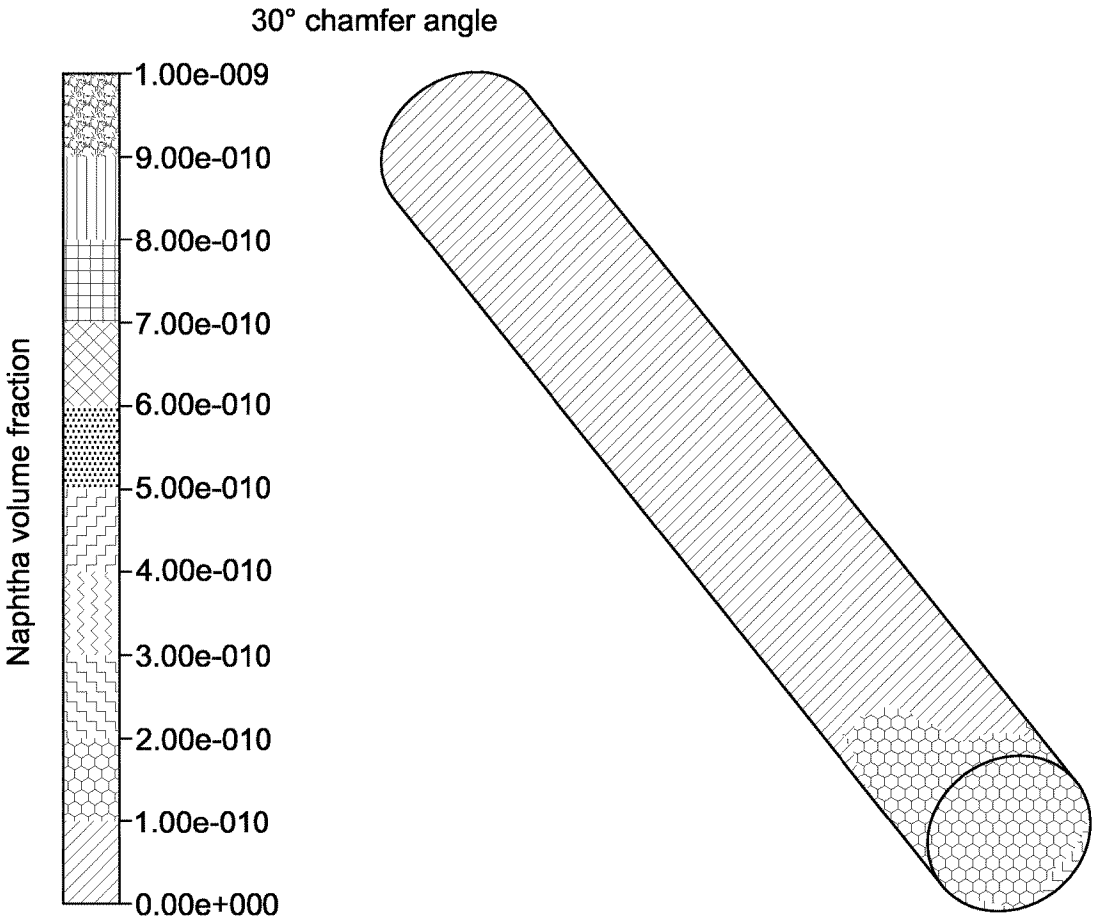
FIG. 13D is a three-dimensional view showing the naphtha volume fraction when the orifice has a chamfer angle of 30°.
Figure 14A:
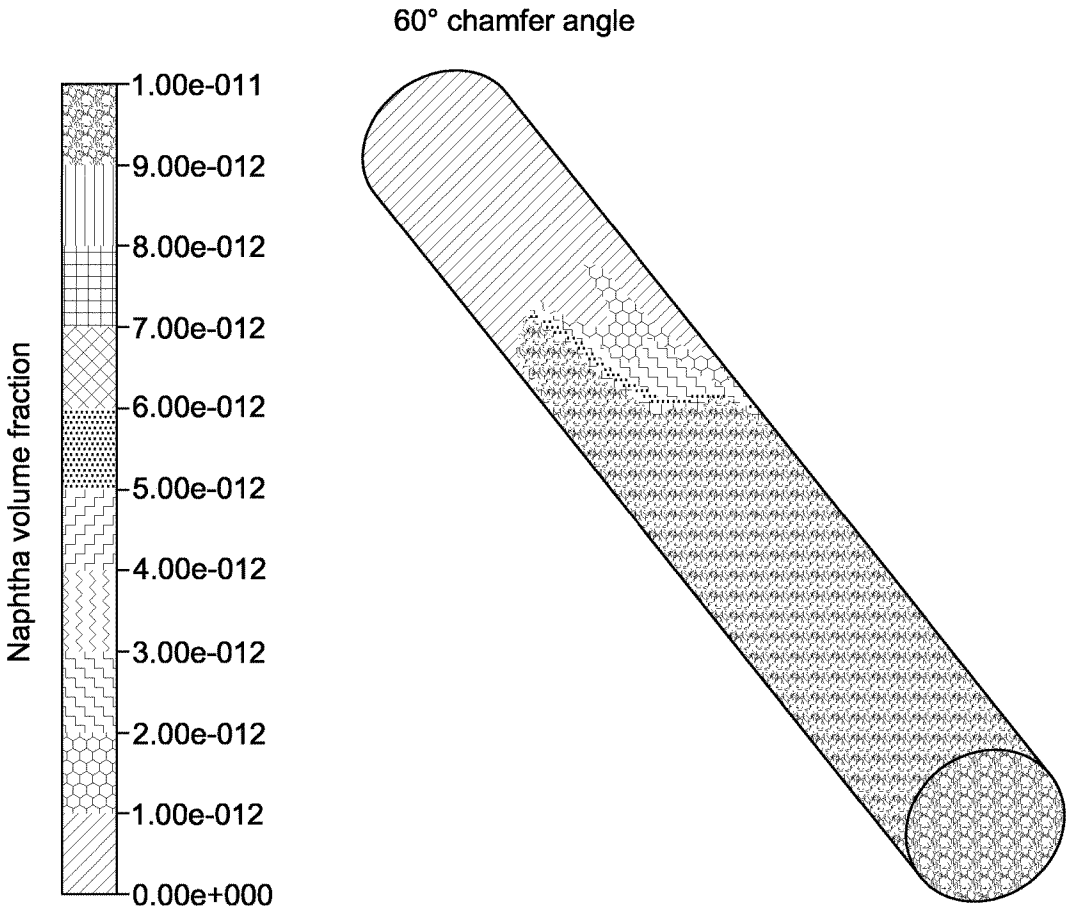
FIG. 14A is a three-dimensional view showing the naphtha volume fraction when the orifice has a chamfer angle of 60°.
Figure 14B:
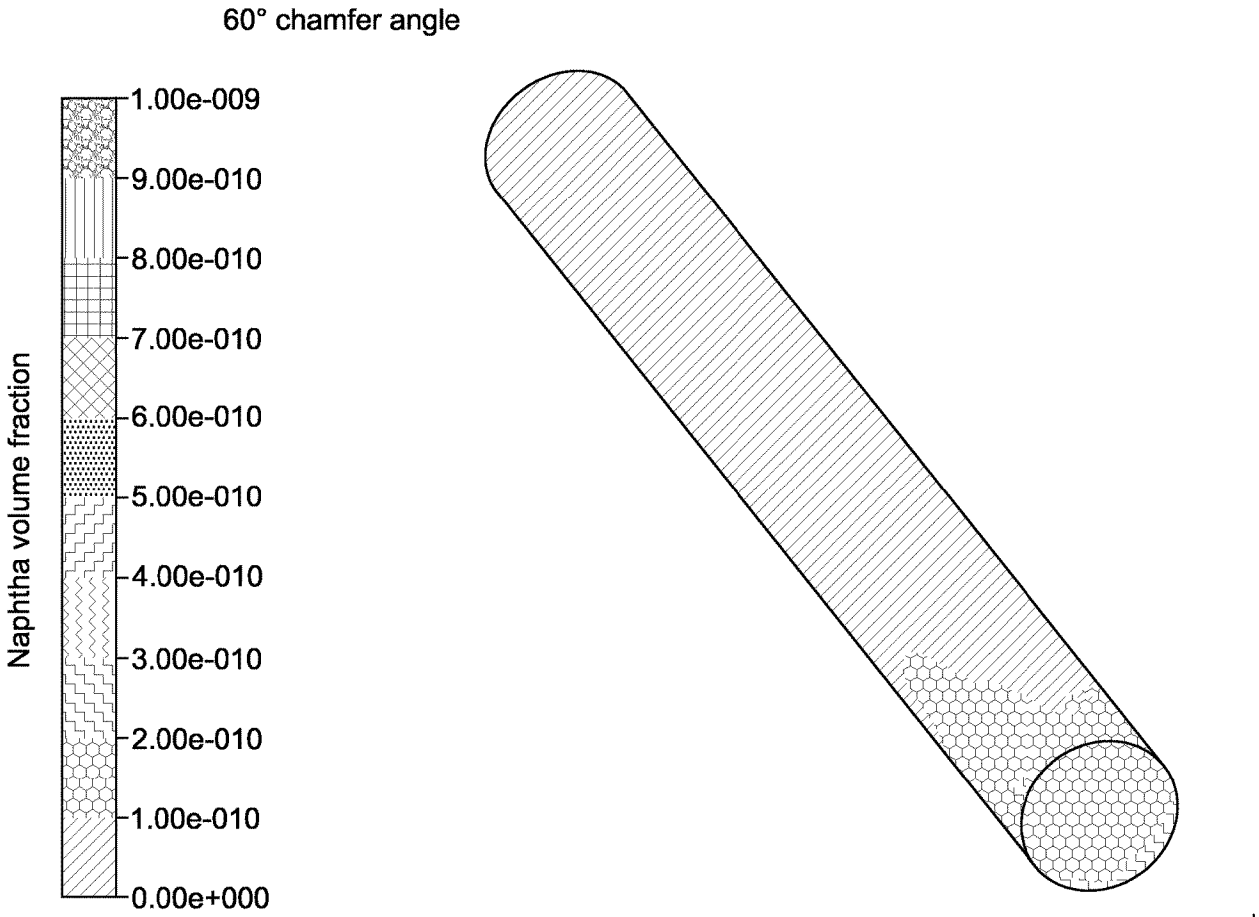
FIG. 14B is a three-dimensional view showing the naphtha volume fraction when the orifice has a chamfer angle of 60°.
Figure 14C:
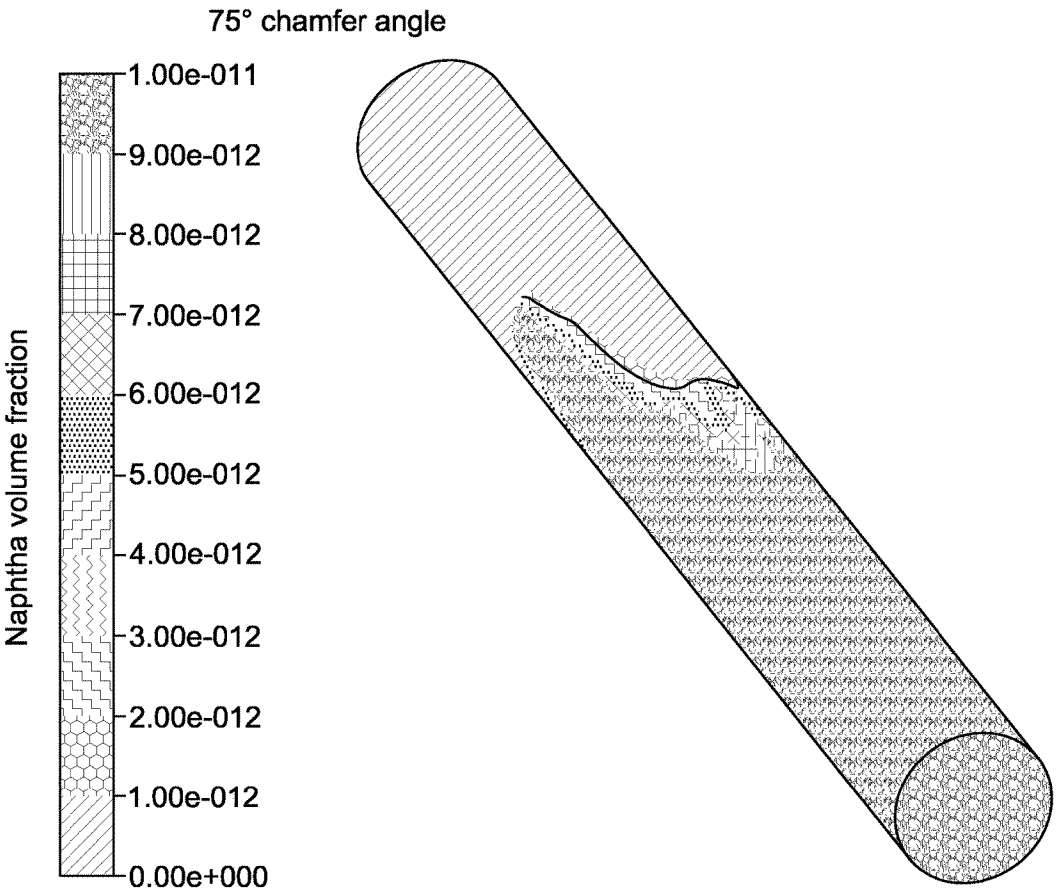
FIG. 14C is a three-dimensional view showing the naphtha volume fraction when the orifice has a chamfer angle of 75°.
Figure 14D:
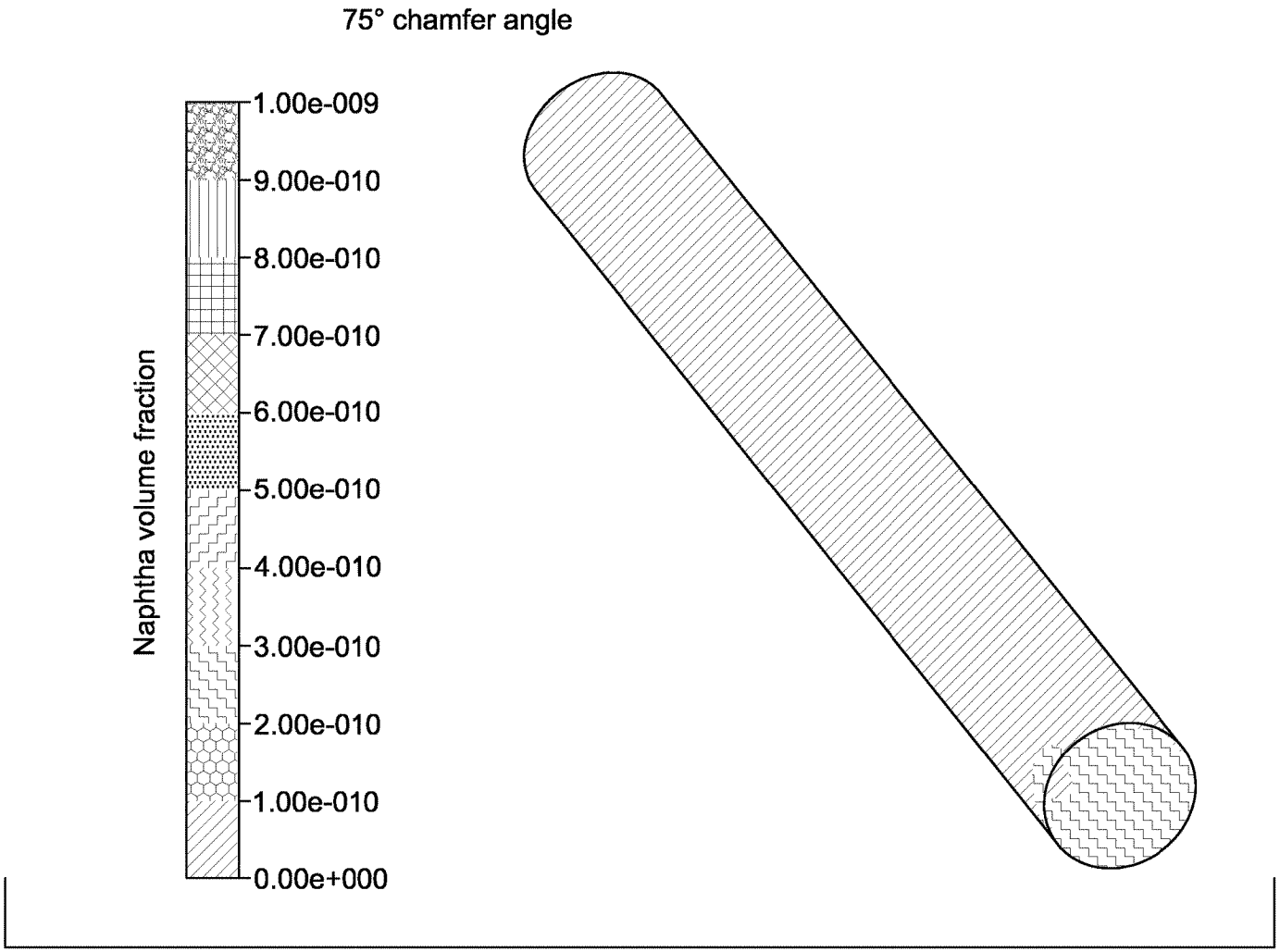
FIG. 14D is a three-dimensional view showing the naphtha volume fraction when the orifice has a chamfer angle of 75°.

FIGS. 11A and 11B are cross-sectional views perpendicular to the second fluid's direction of flow and show the effects of a chamfer angle (α) of 7.3° on the naphtha volume fraction (VF) down the length of the pipe in the x-direction. FIGS. 11C and 11D show the effects of a 30° chamfer angle on naphtha VF. FIGS. 12A and 12B are cross-sectional views perpendicular to the second fluid's direction of flow and show the effects of chamfer angle (α) of 60° on the naphtha volume fraction (VF) down the length of the pipe in the x-direction. FIGS. 12C and 12D show the effects of a 75° chamfer angle on naphtha VF. FIGS. 13A and 13B are three-dimensional representations of the effects of a chamfer angle (α) of 7.3° on the naphtha volume fraction (VF) down the length of the pipe in the x-direction. FIGS. 13C and 13D are three-dimensional representations showing the effects of a 30° chamfer angle on naphtha VF. FIGS. 14A and 14B are three-dimensional representations of the effects of a chamfer angle (α) of 60° on the naphtha volume fraction (VF) down the length of the pipe in the x-direction. FIGS. 14C and 14D are three-dimensional representations showing the effects of a 75° chamfer angle on naphtha VF.

Figure 15A:
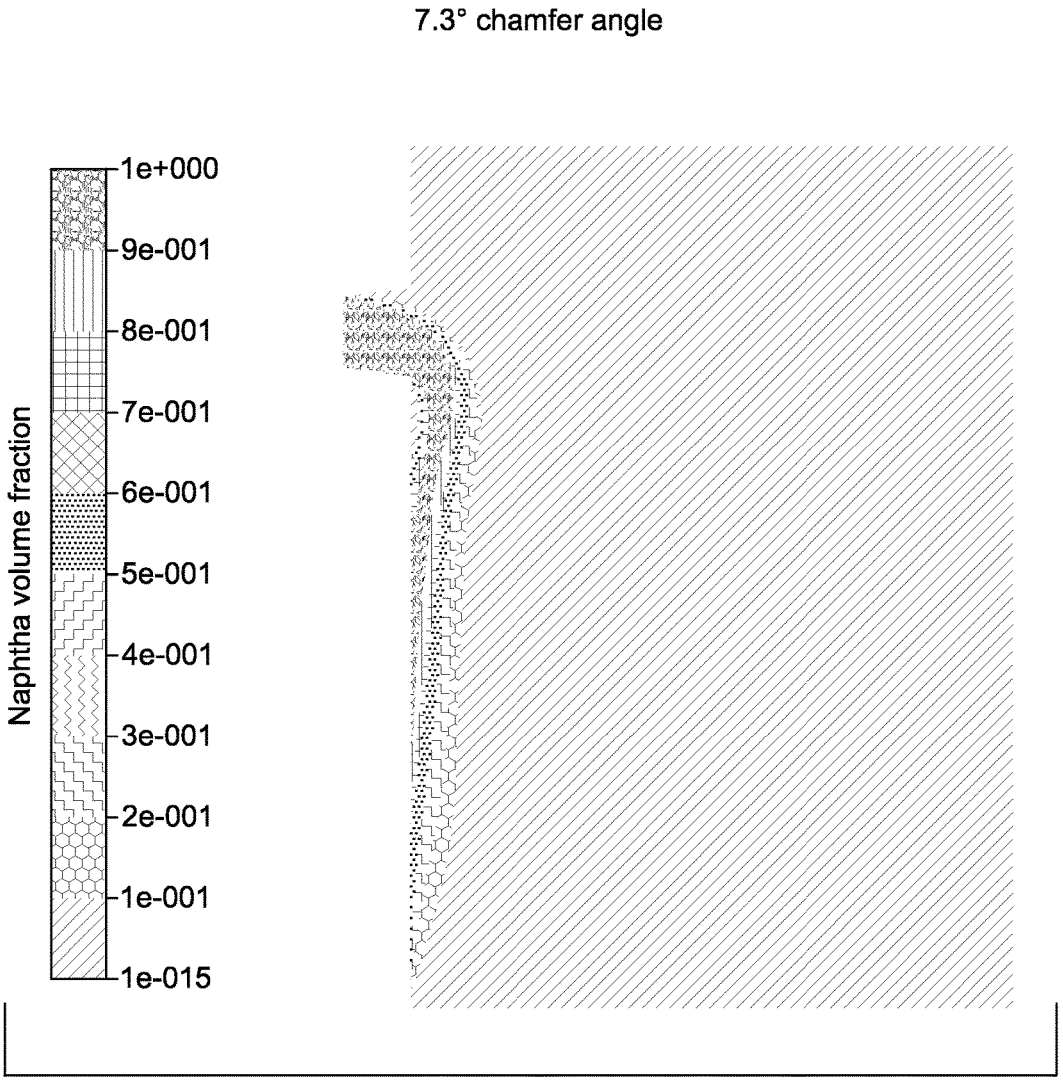
FIG. 15A is a cross-sectional view of an injection quill stem bisecting the stem along the length (L) and shows the effects of a chamfer angle ($\alpha$) of 7.3° on the naphtha volume fraction (VF).
Figure 15B:
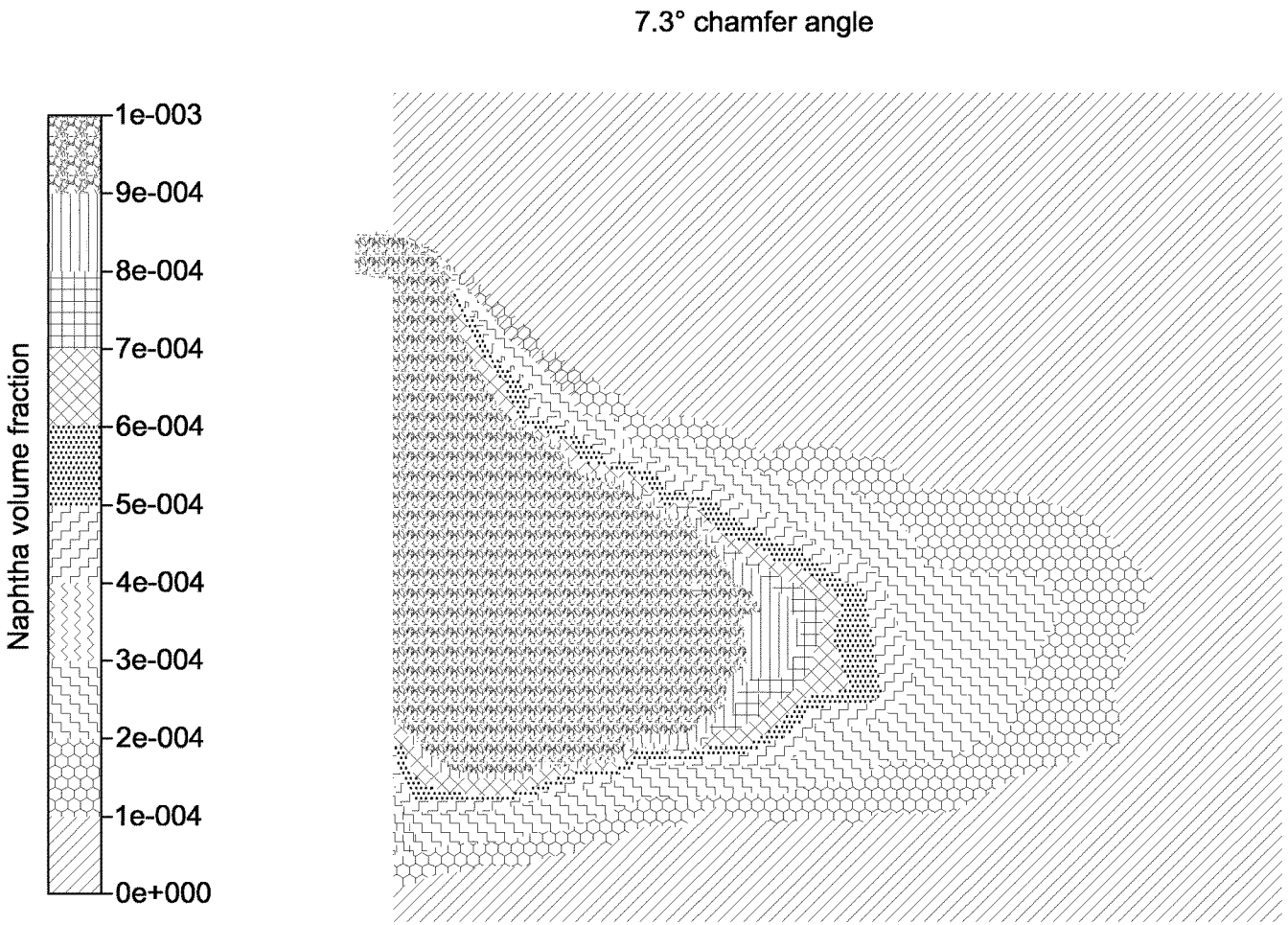
FIG. 15B is a cross-sectional view of an injection quill stem bisecting the stem along the length (L) and shows the effects of a chamfer angle ($\alpha$) of 7.3° on the naphtha VF.
Figure 15C:
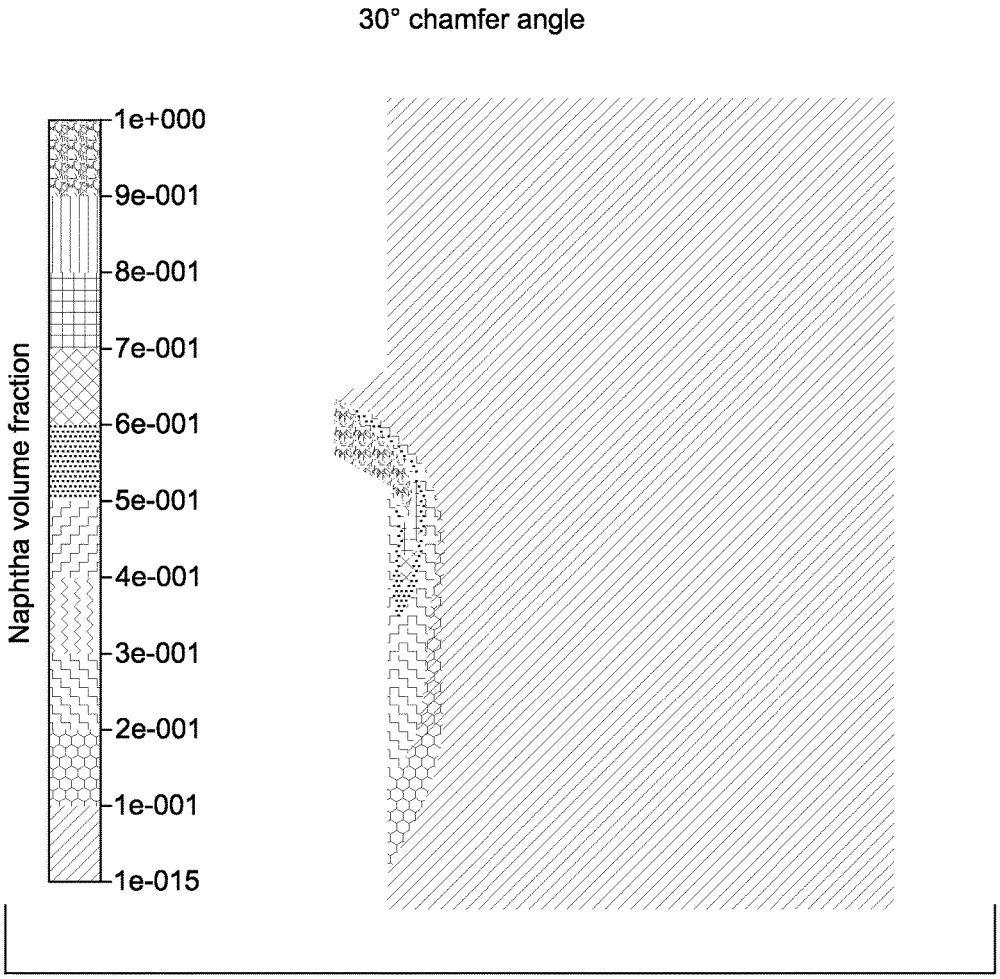
FIG. 15C is a cross-sectional view of an injection quill stem bisecting the stem along the length (L) and shows the effects of a chamfer angle (α) of 30° on the naphtha VF.
Figure 15D:
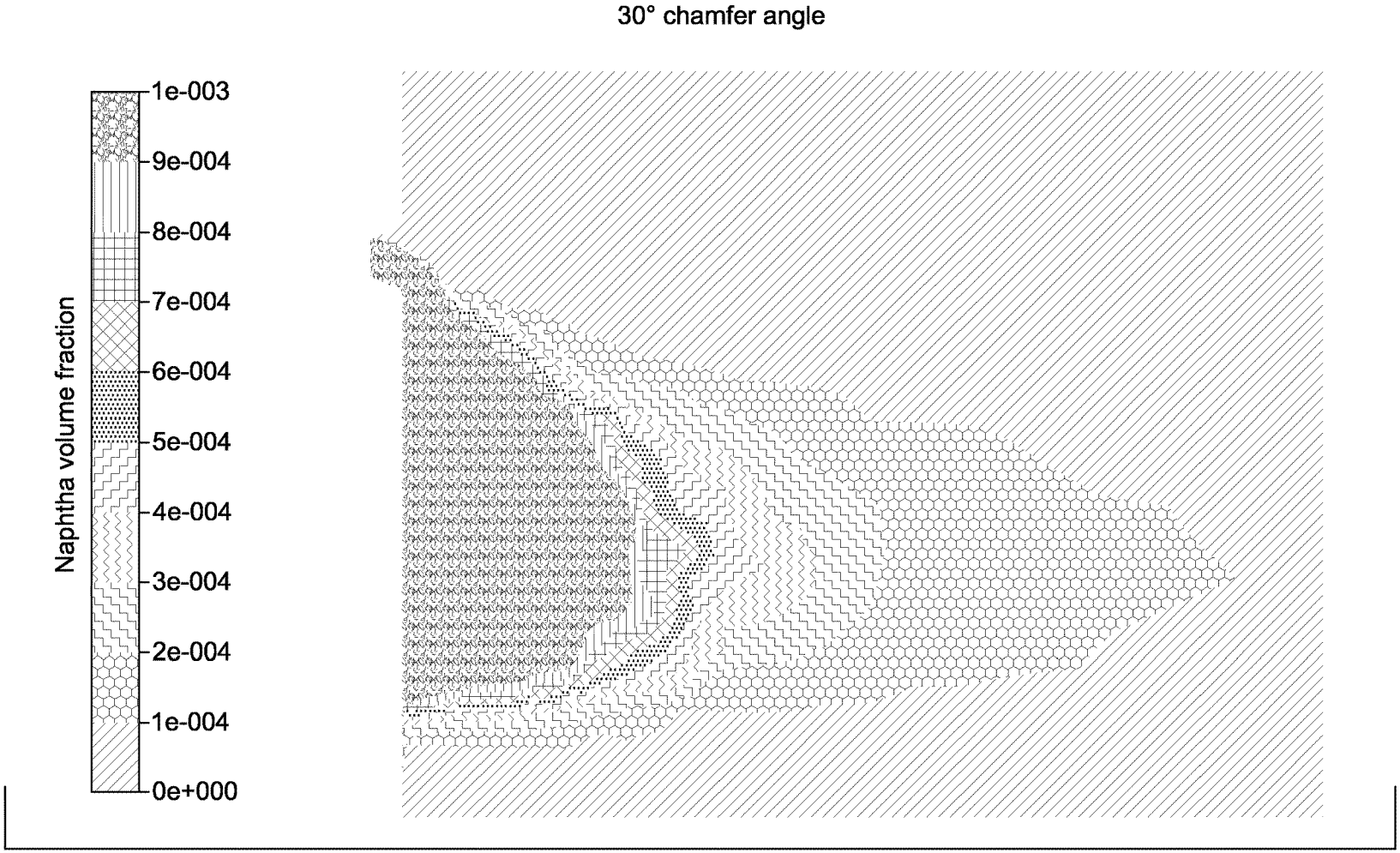
FIG. 15D is a cross-sectional view of an injection quill stem bisecting the stem along the length (L) and shows the effects of a chamfer angle (α) of 30° on the naphtha VF.
Figure 16A:
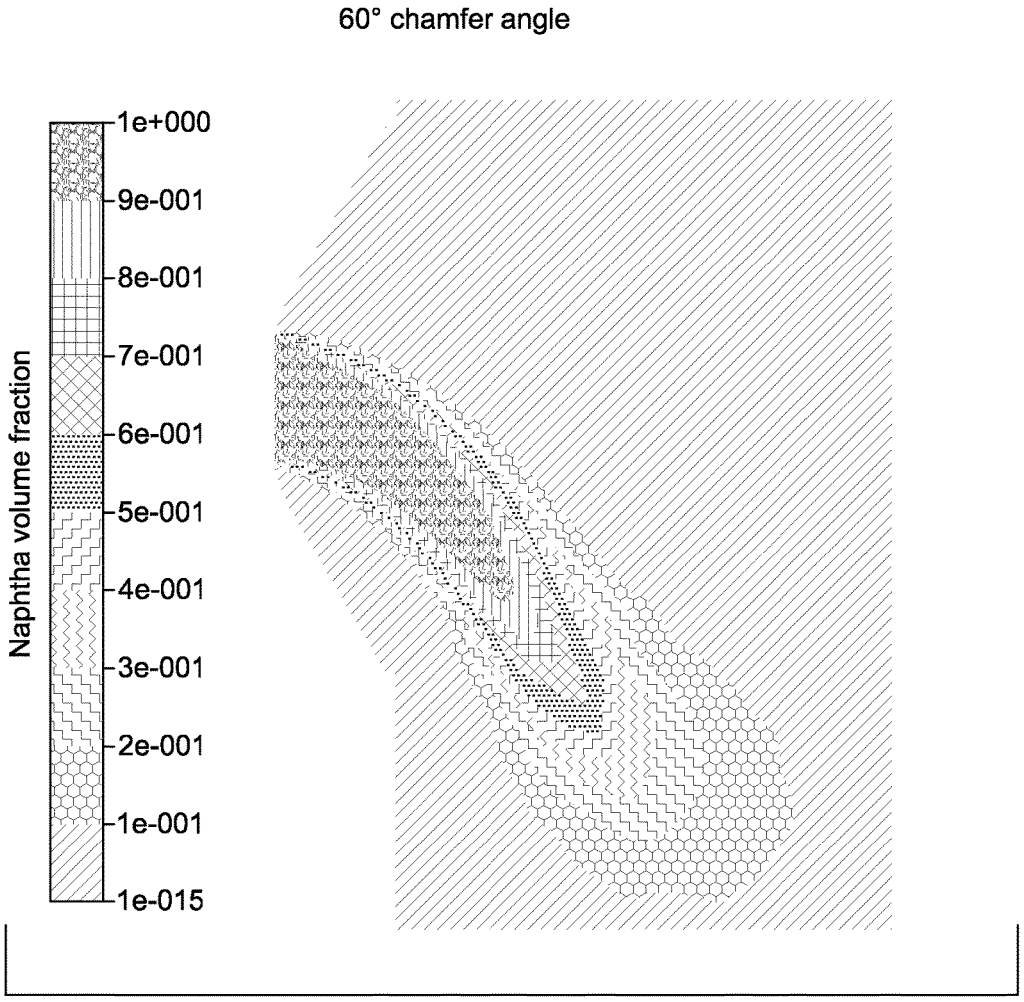
FIG. 16A is a cross-sectional view of an injection quill stem bisecting the stem along the length (L) and shows the effects of a chamfer angle (α) of 60° on the naphtha volume fraction (VF).
Figure 16B:
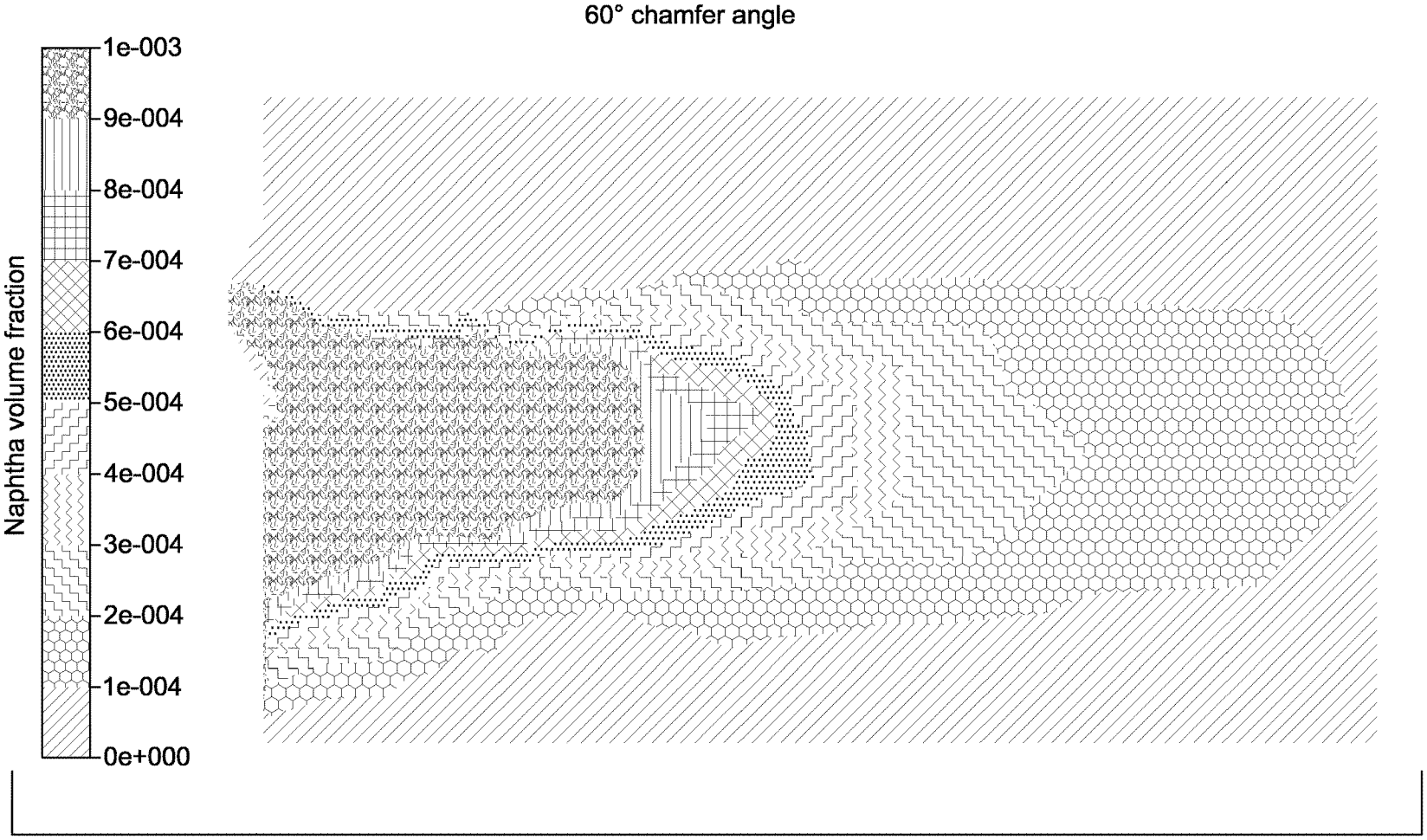
FIG. 16B is a cross-sectional view of an injection quill stem bisecting the stem along the length (L) and shows the effects of a chamfer angle (α) of 60° on the naphtha VF.
Figure 16C:
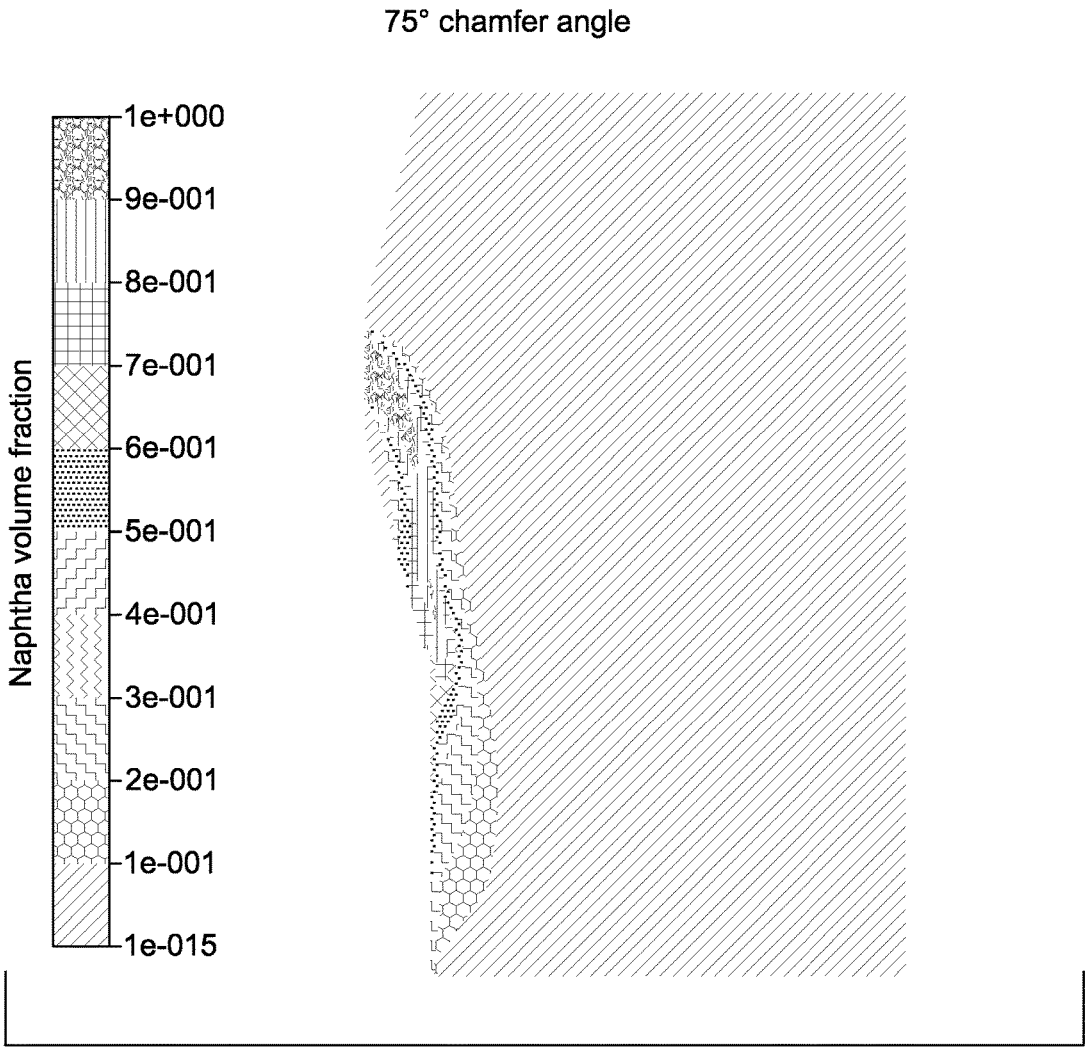
FIG. 16C is a cross-sectional view of an injection quill stem bisecting the stem along the length (L) and shows the effects of a chamfer angle (α) of 75° on the naphtha VF.
Figure 16D:
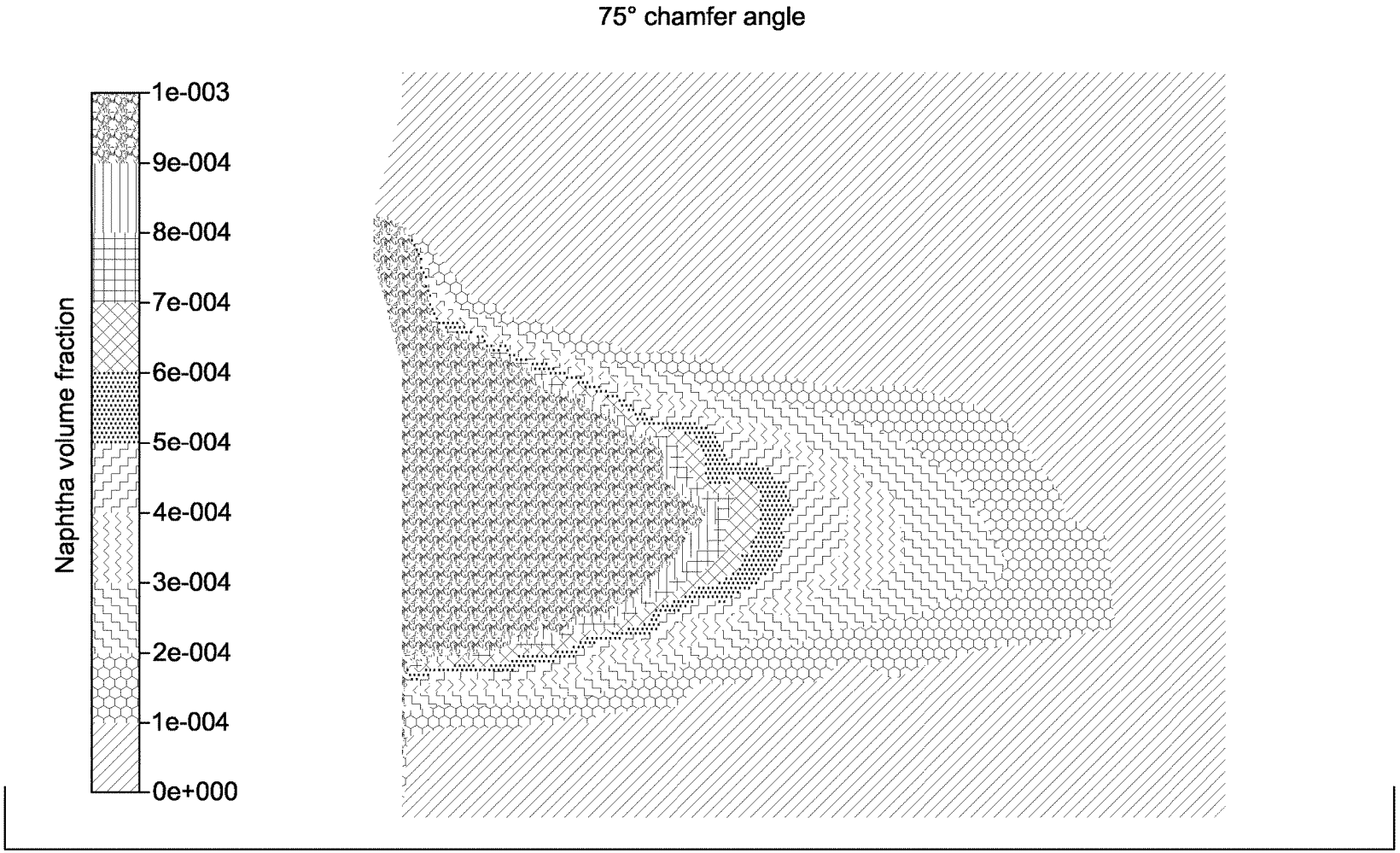
FIG. 16D is a cross-sectional view of an injection quill stem bisecting the stem along the length (L) and shows the effects of a chamfer angle (α) of 75° on the naphtha VF.
Figure 17A:
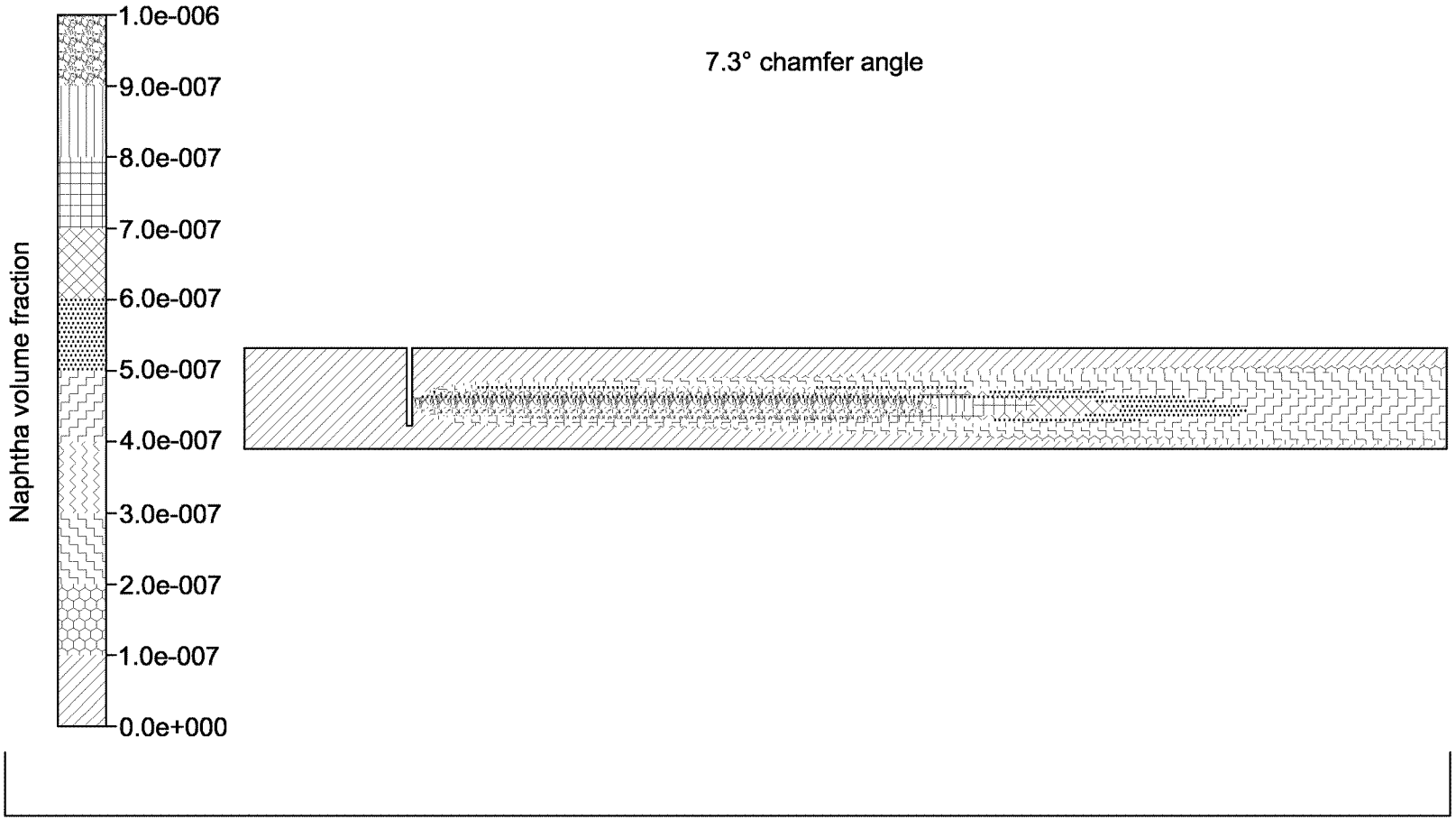
FIG. 17A is a cross-sectional view parallel to the direction of flow and shows the naphtha volume fraction (VF) when the orifice has a chamfer angle (α) of 7.3°.
Figure 17B:
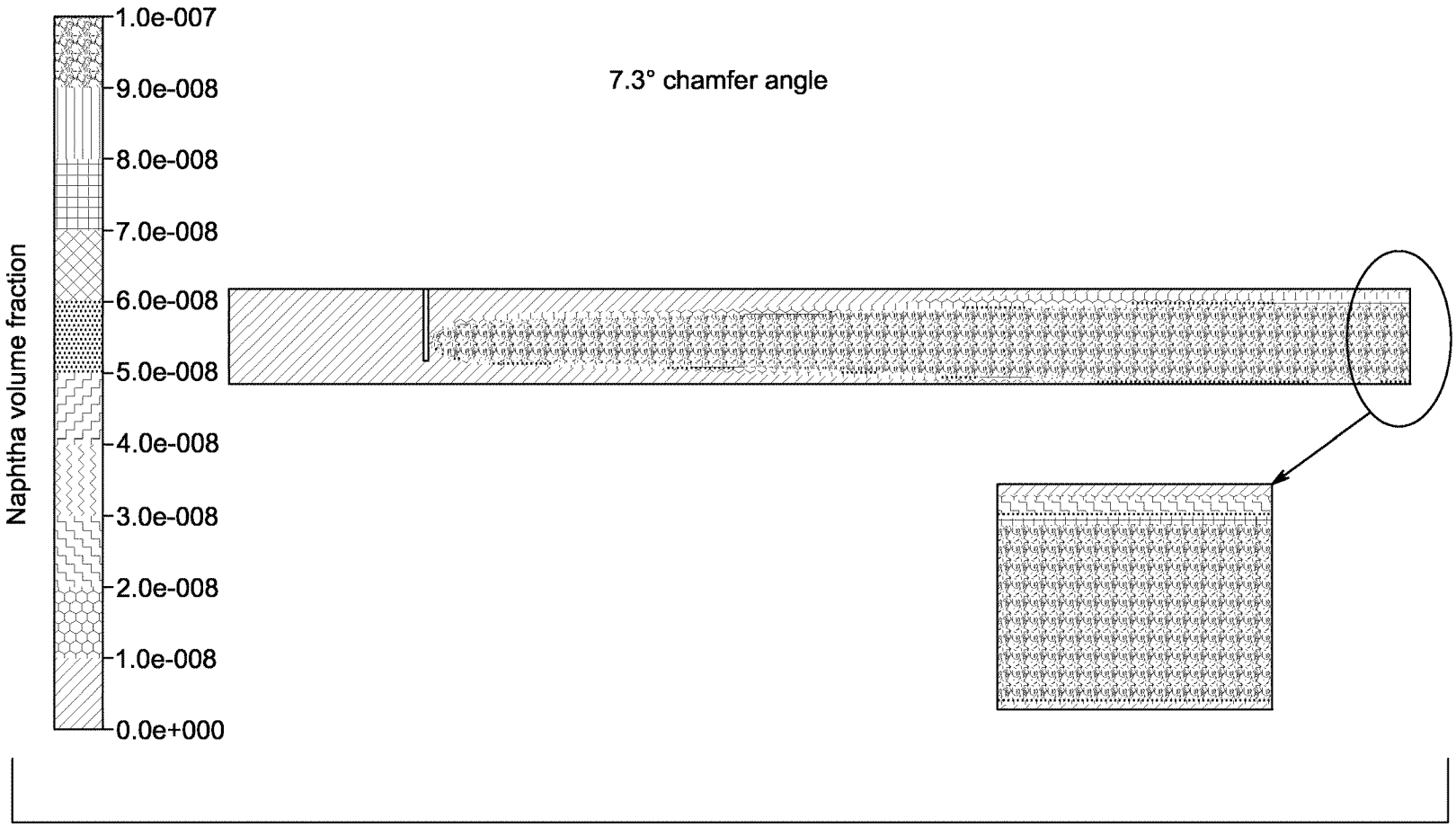
FIG. 17B is a cross-sectional view parallel to the direction of flow and shows the naphtha VF when (α) is 7.3°.
Figure 18A:
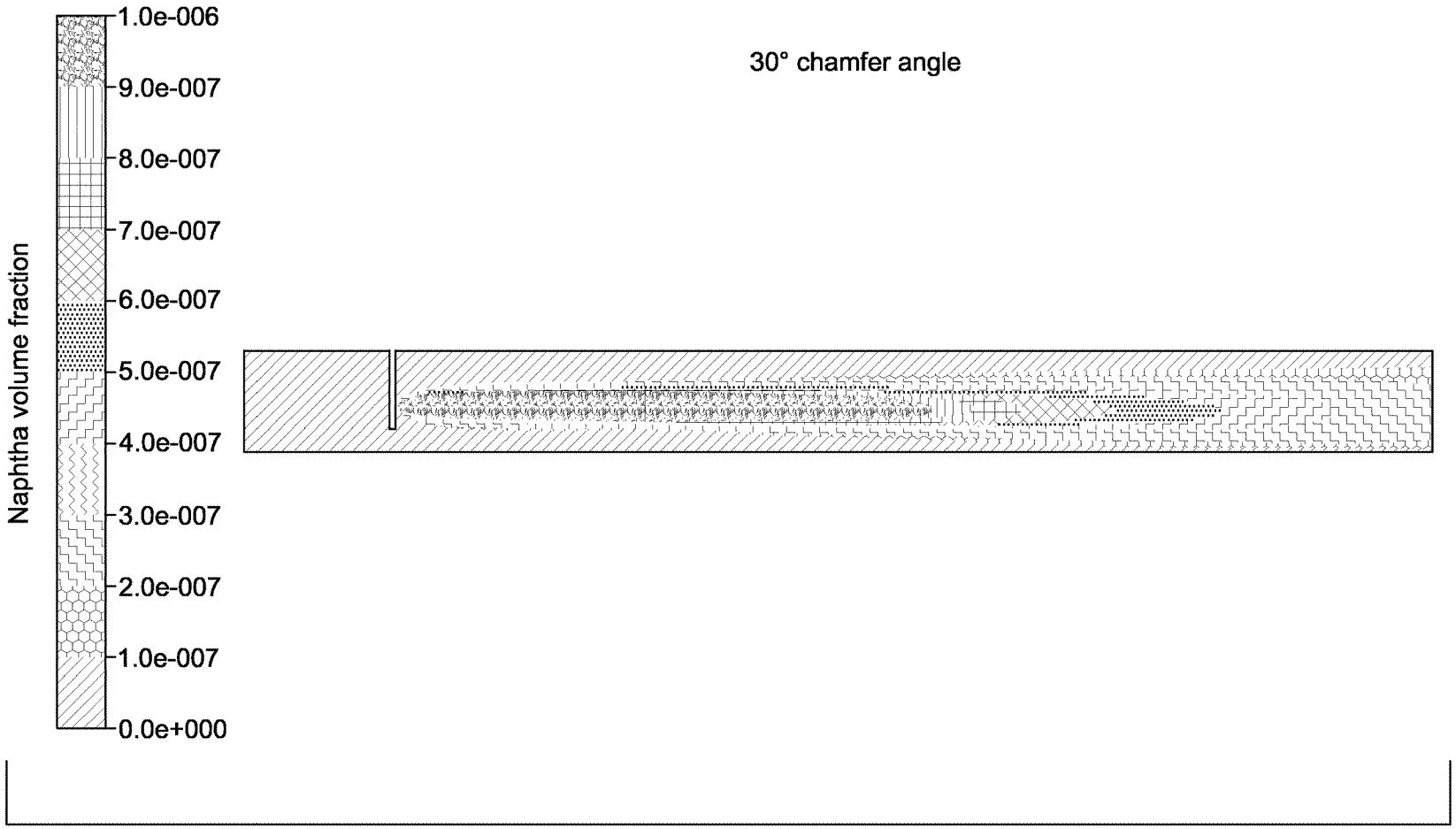
FIG. 18A is a cross-sectional view parallel to the direction of flow and shows the naphtha VF when (α) is 30°.
Figure 18B:
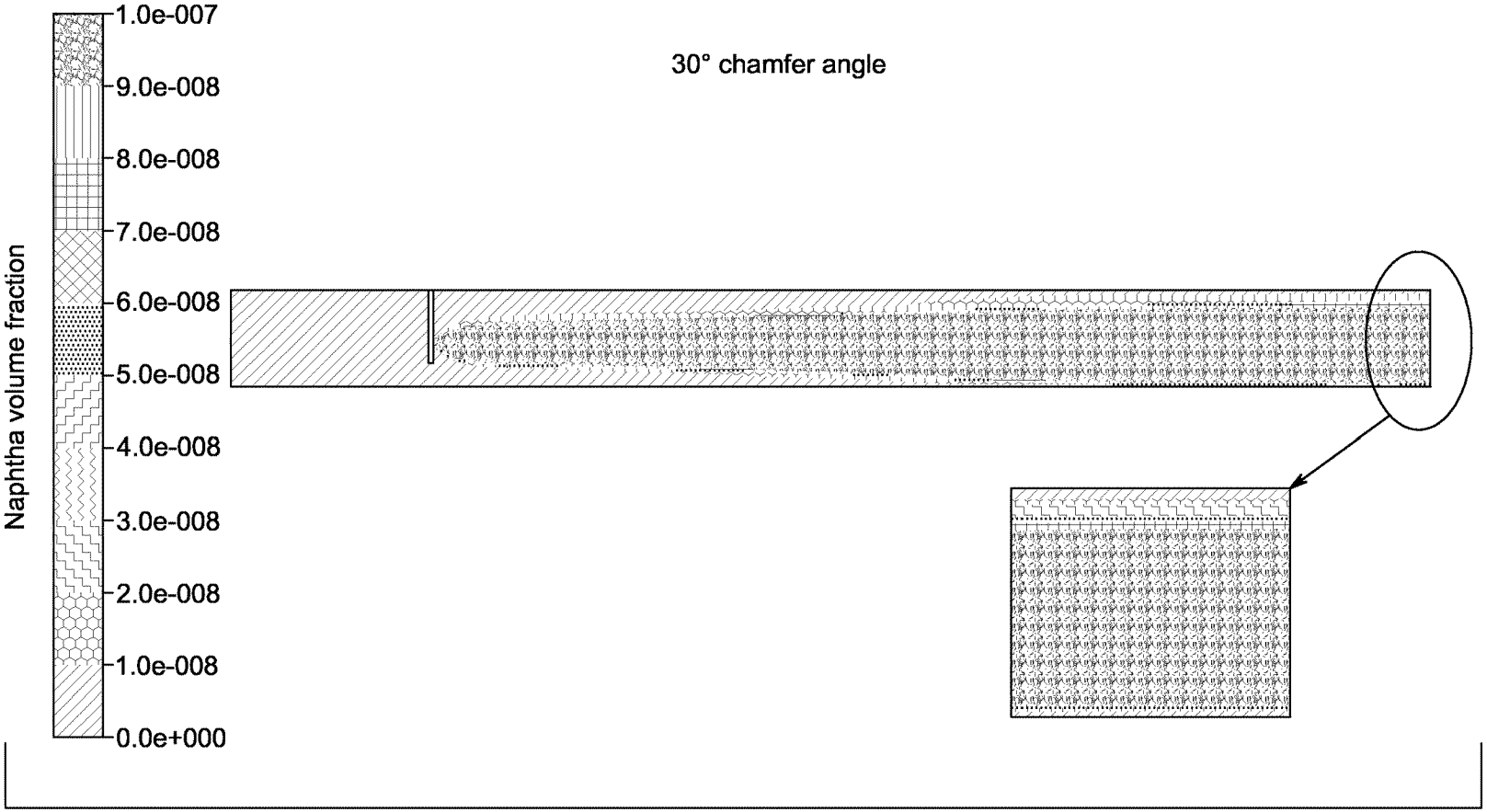
FIG. 18B is a cross-sectional view parallel to the direction of flow and shows the naphtha VF when (α) is 30°.
Figure 19A:
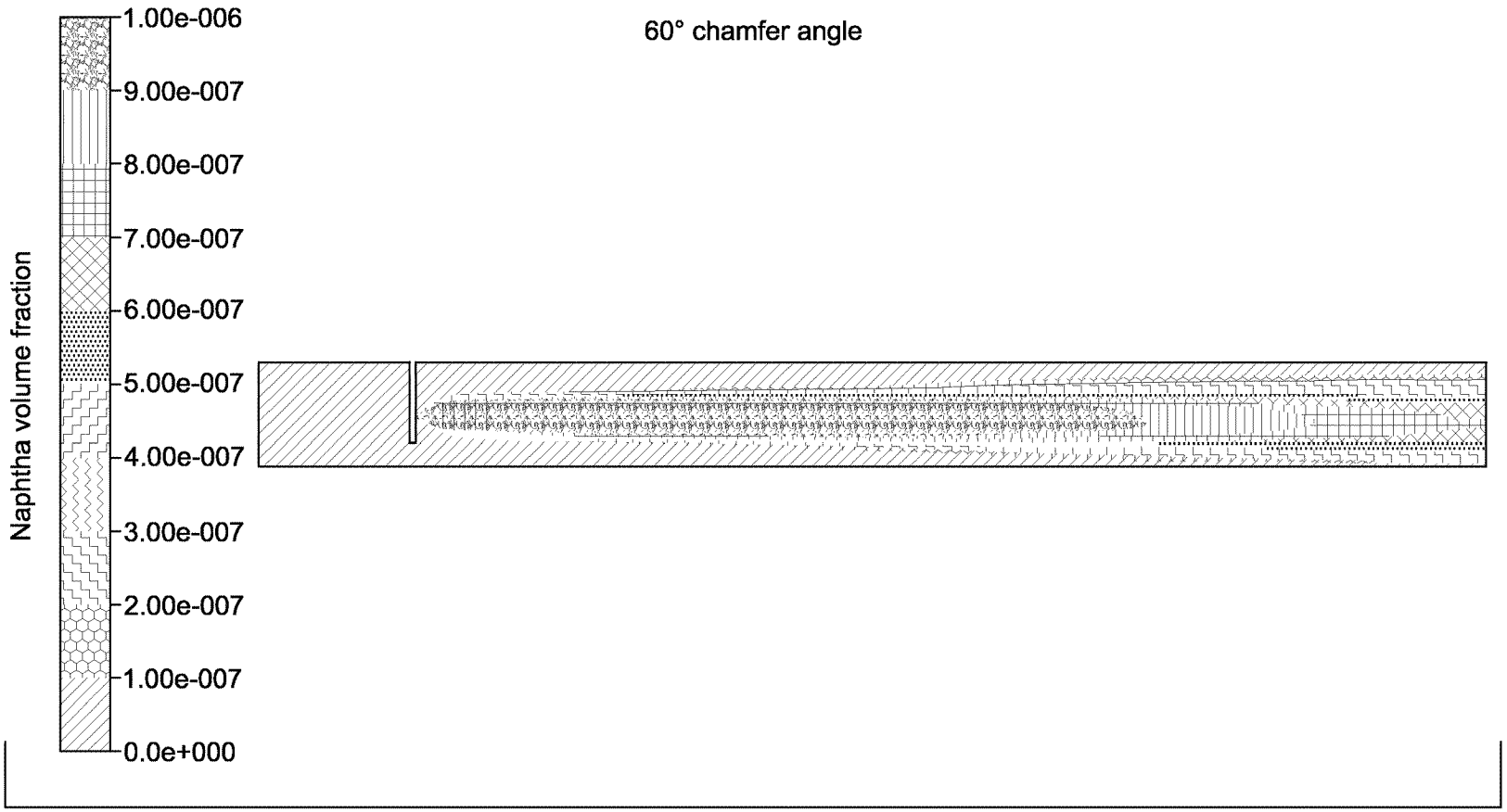
FIG. 19A is a cross-sectional view parallel to the direction of flow and shows the naphtha VF when (α) is 60°.
Figure 19B:
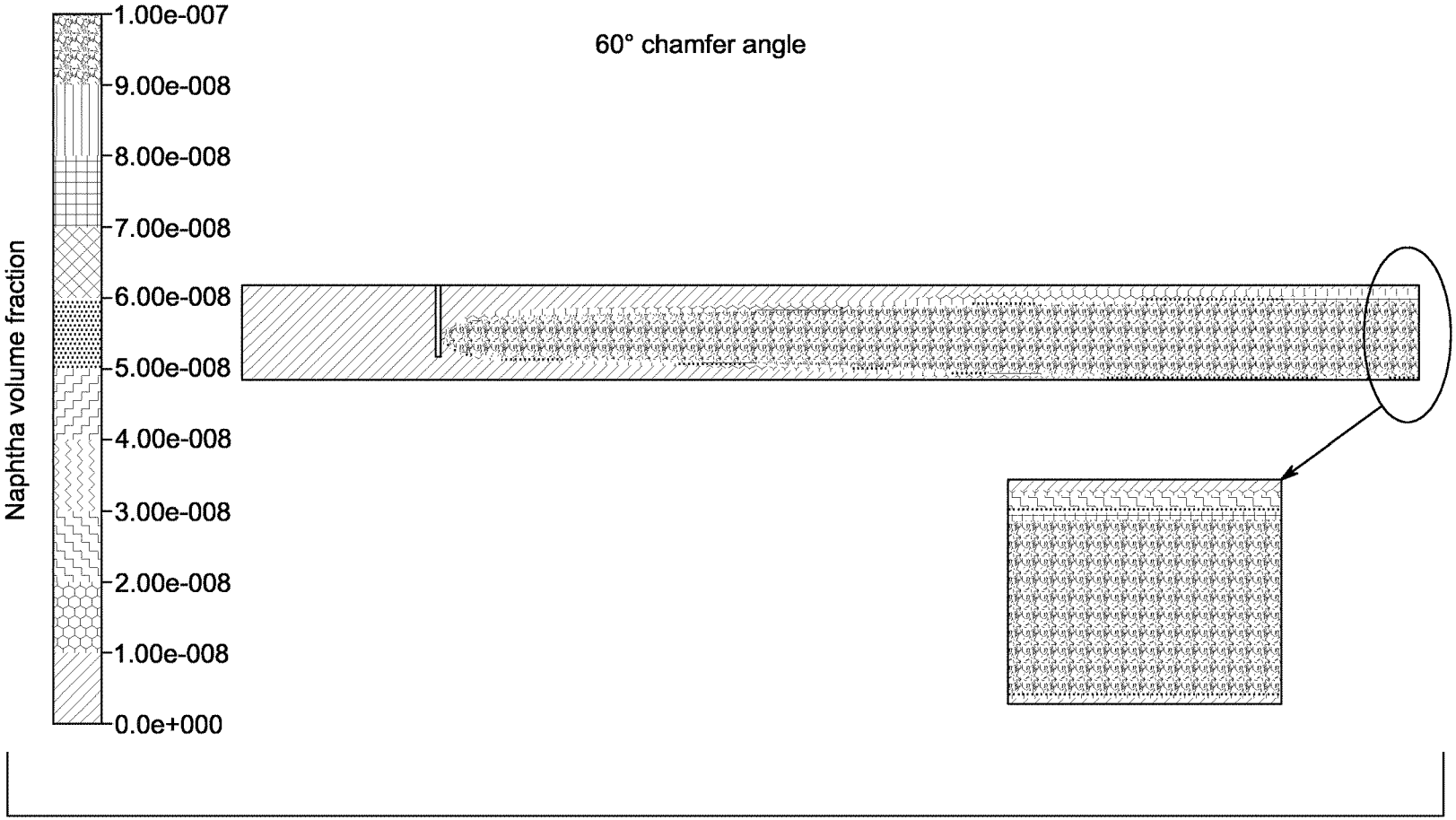
FIG. 19B is a cross-sectional view parallel to the direction of flow and shows the naphtha VF when (α) is 60°.
Figure 20A:
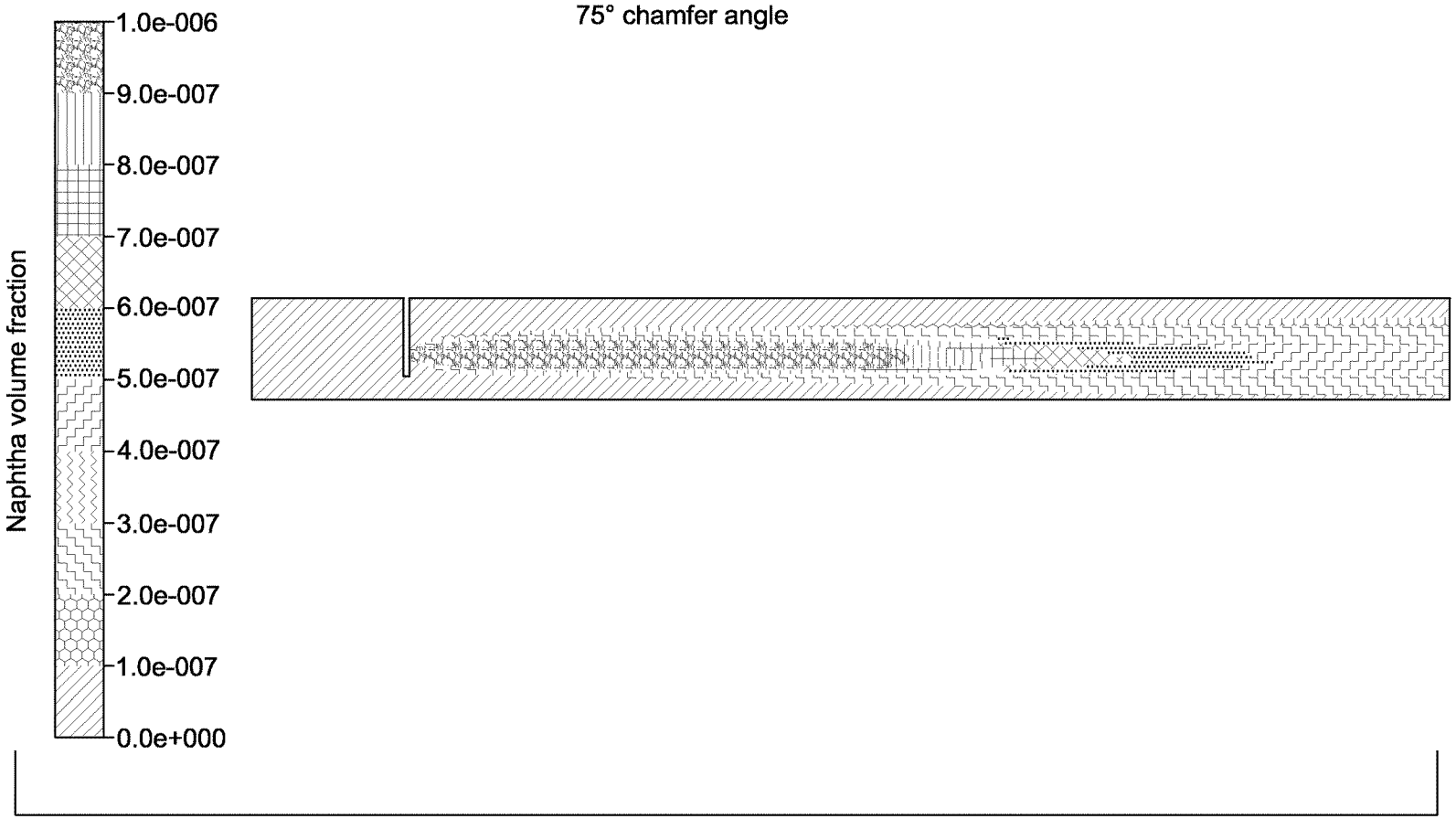
FIG. 20A is a cross-sectional view parallel to the direction of flow and shows the naphtha VF when (α) is 75°.
Figure 20B:
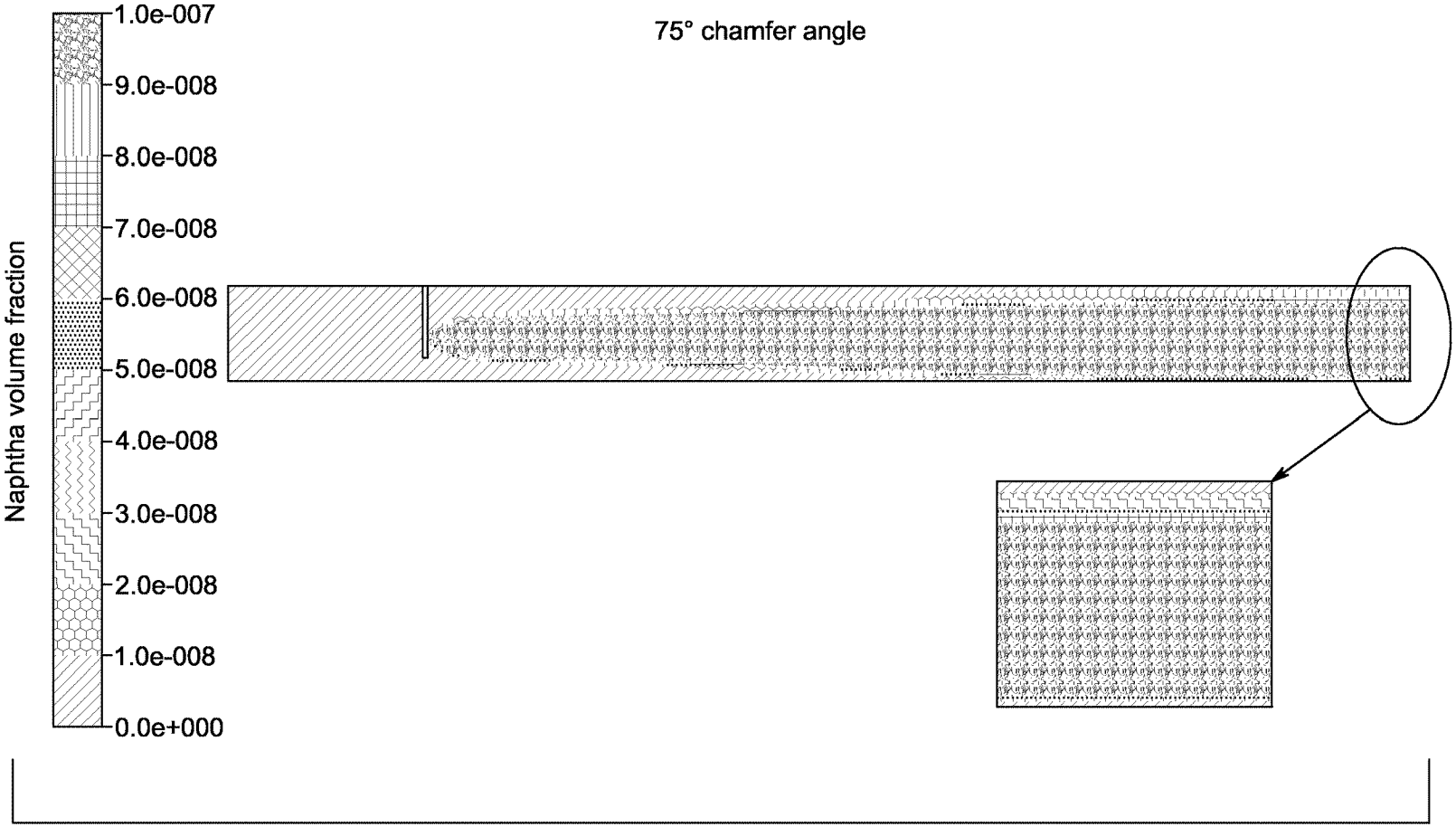
FIG. 20B is a cross-sectional view parallel to the direction of flow and shows the naphtha VF when (α) is 75°.
Figure 21:
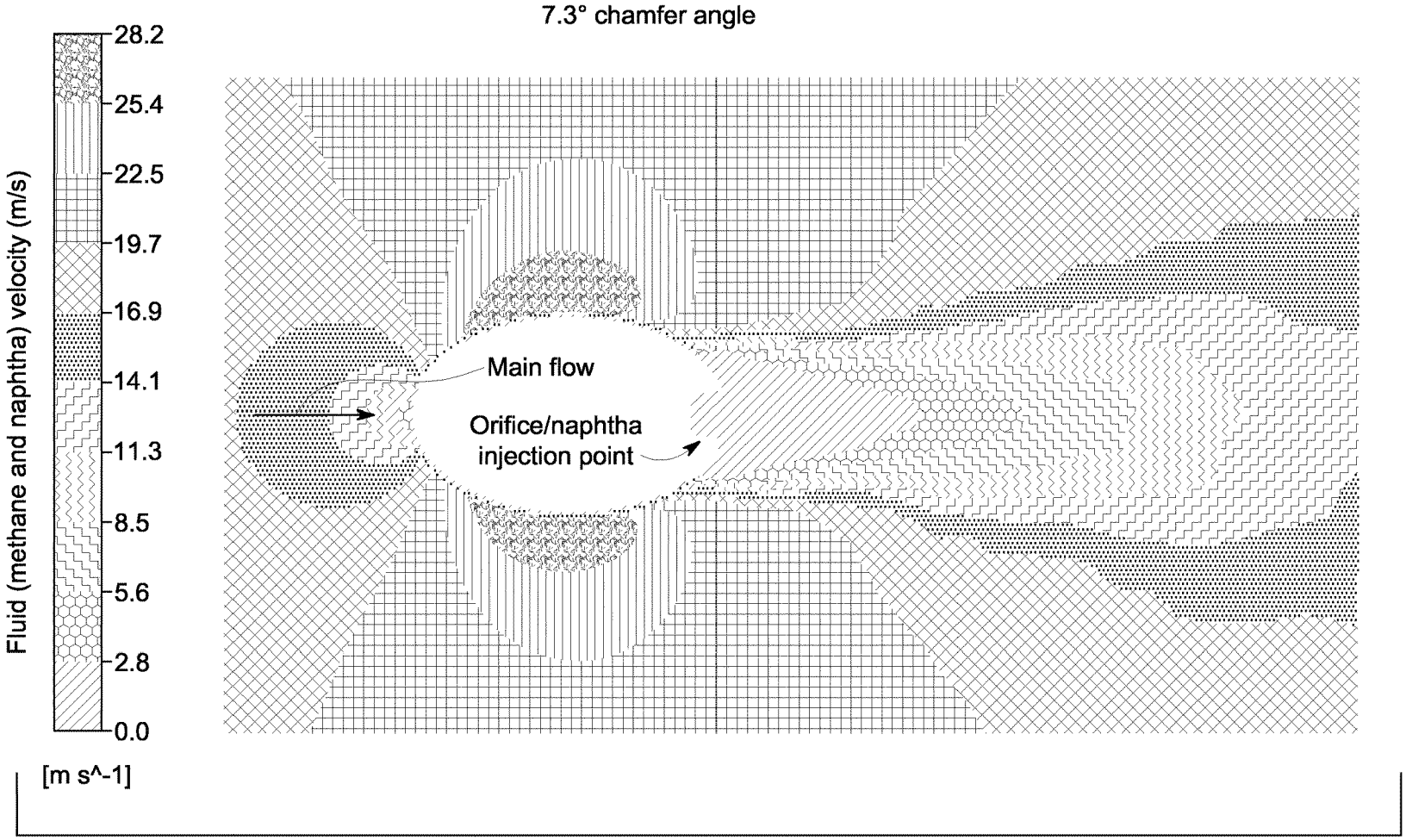
FIG. 21 is a cross-sectional view showing the fluid velocity profile when an injection quill has an orifice that has a chamfer angle (α) of 7.3°.
Figure 22:
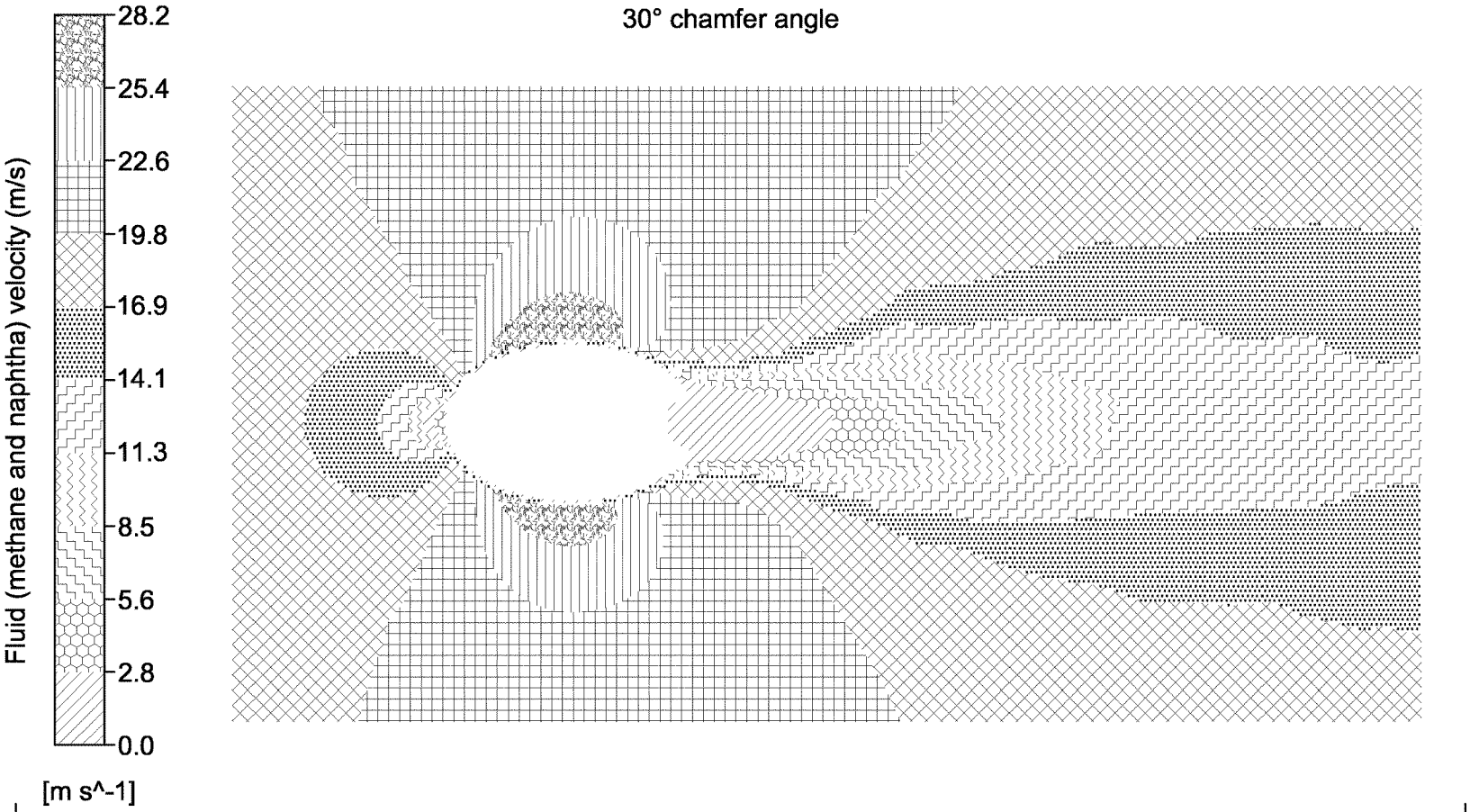
FIG. 22 is a cross-sectional view showing the fluid velocity profile when an injection quill has an orifice that has a chamfer angle (α) of 30°.
Figure 23:
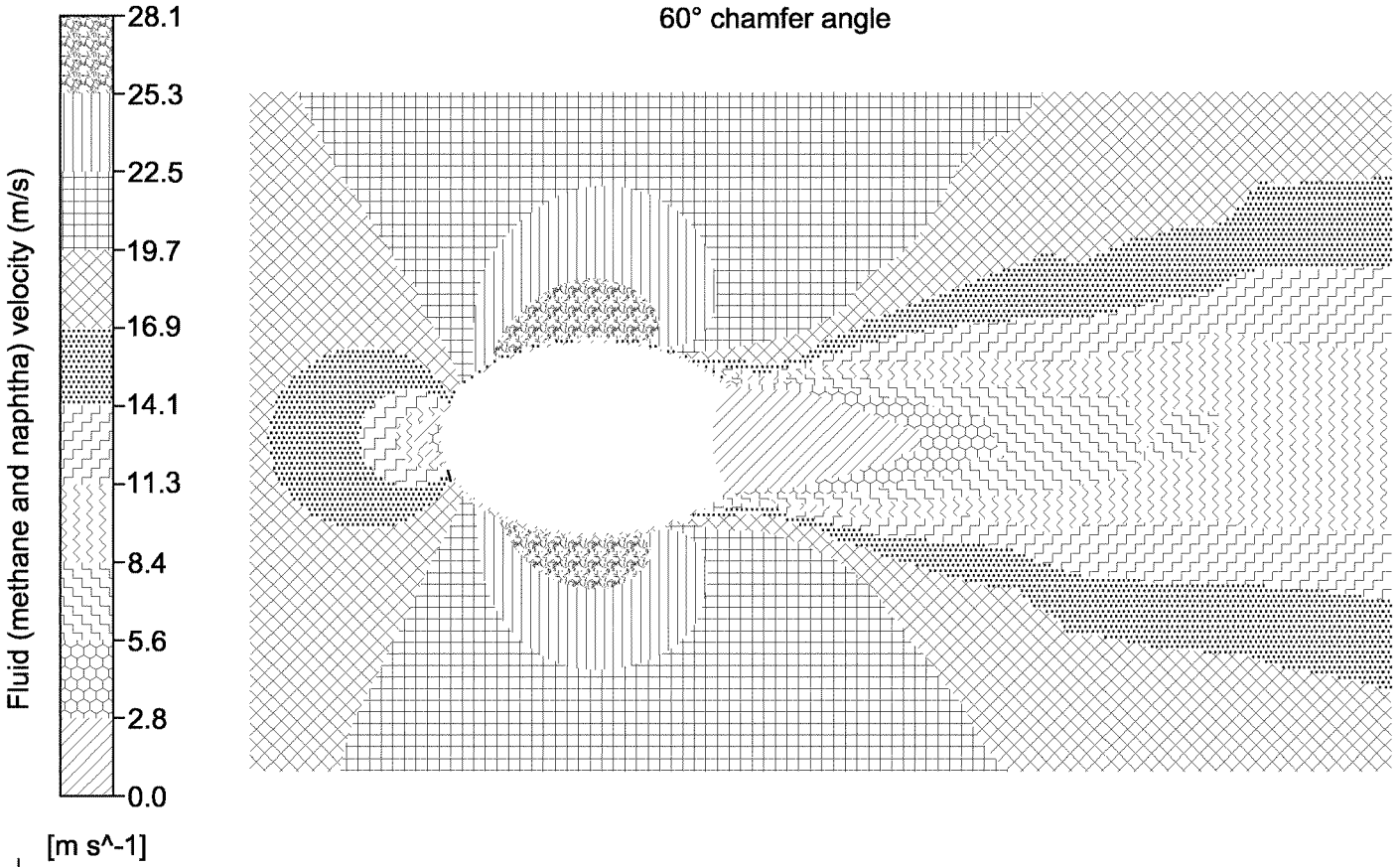
FIG. 23 is a cross-sectional view showing the fluid velocity profile when an injection quill has an orifice that has a chamfer angle (α) of 60°.
Figure 24:
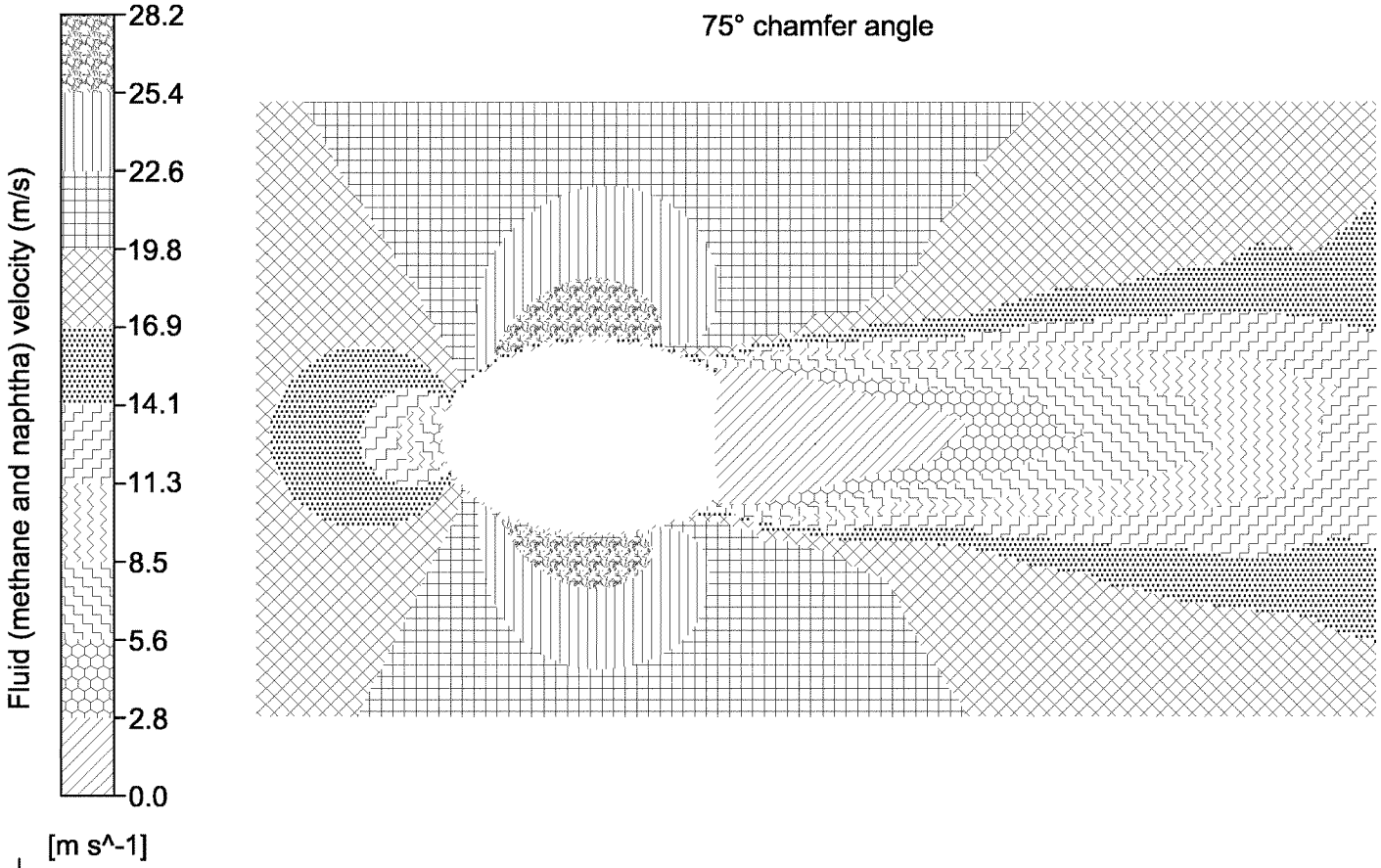
FIG. 24 is a cross-sectional view showing the fluid velocity profile when an injection quill has an orifice that has a chamfer angle (α) of 75°.

FIGS. 15A-16D show cross-sectional views of an injection quill stem bisecting the stem along the length (L) and major axis (A) and going through the cross-sectional center of the orifice at location angle (θ) of 0°. FIGS. 15A and 15B show the effects of a chamfer angle (α) of 7.3° on the naphtha volume fraction (VF) down the length of the pipe in the x-direction. FIGS. 15C and 15D show the effects of a 30° chamfer angle on naphtha VF. FIGS. 16A and 16B show the effects of a chamfer angle (α) of 60° on the naphtha volume fraction (VF) down the length of the pipe in the x-direction. FIGS. 16C and 16D show the effects of a 75° chamfer angle on naphtha VF.

Figure 25:
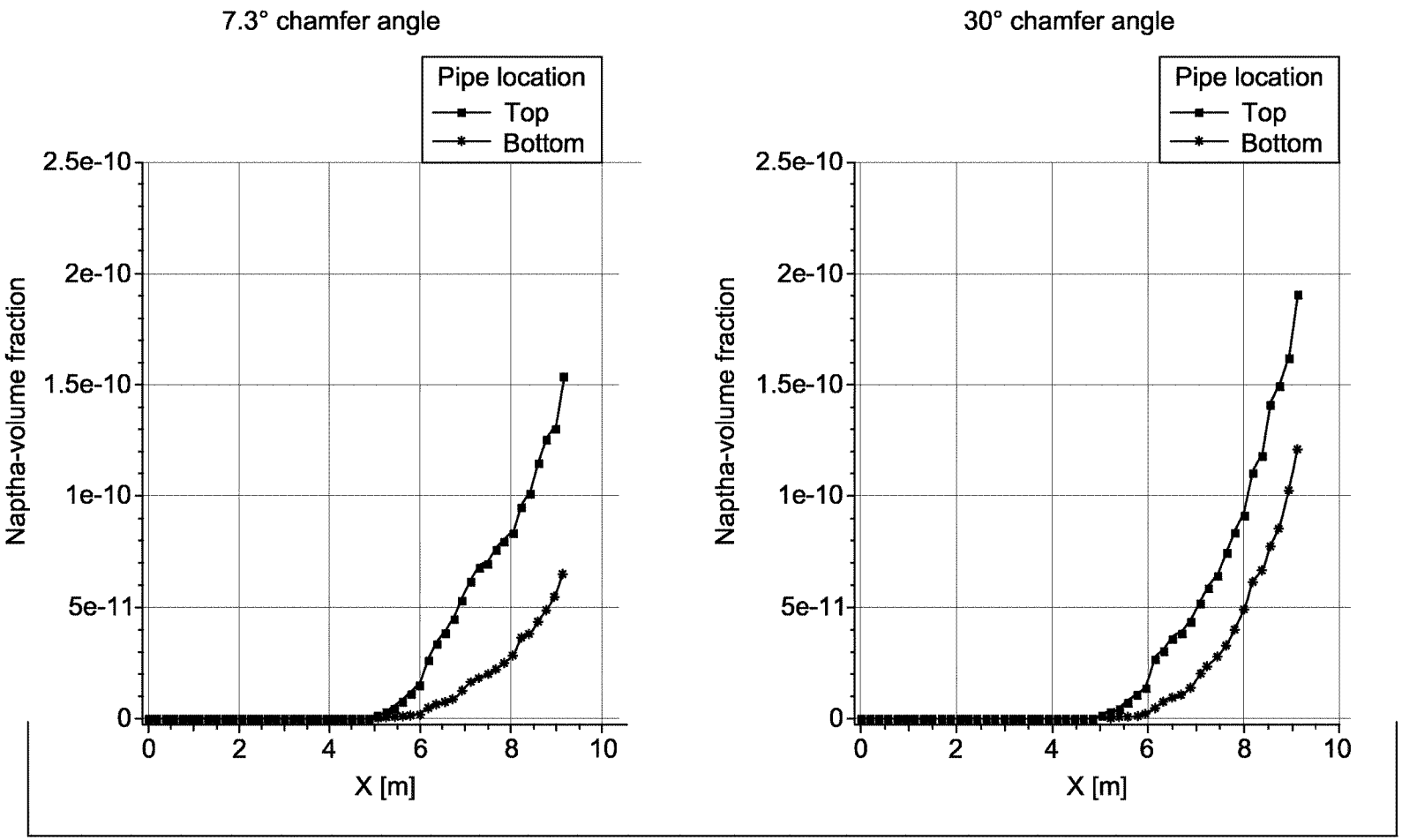
FIG. 25 shows two graphs of the naphtha volume fraction (VF) on a pipe wall. The graph on the left shows the naphtha VF when the orifice has a chamfer angle of 7.3° and the graph on the right shows the naphtha VF when the orifice has a chamfer angle of 30°.
Figure 26:
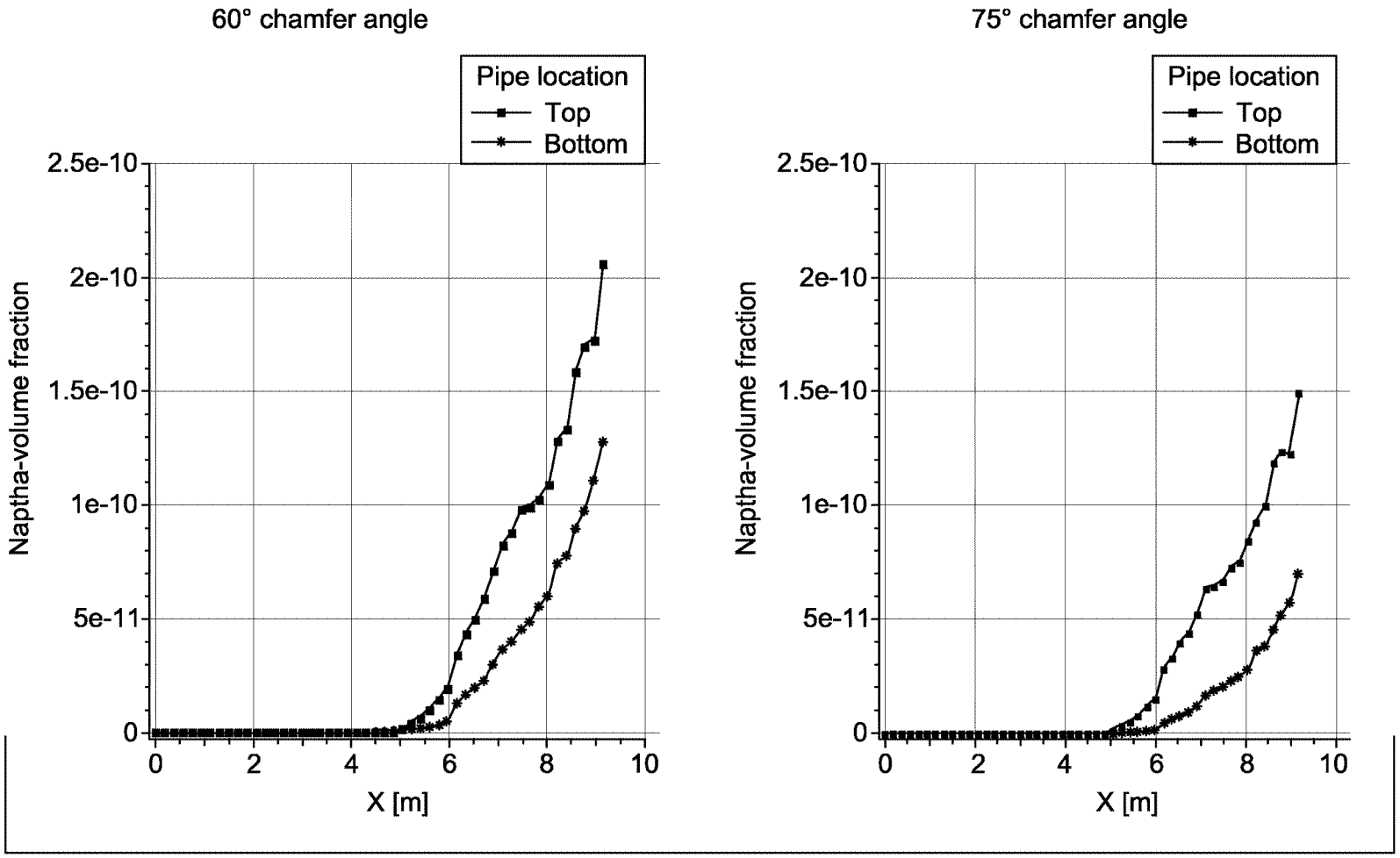
FIG. 26 shows two graphs of the naphtha volume fraction (VF) on a pipe wall. The graph on the left shows the naphtha VF when the orifice has a chamfer angle of 60° and the graph on the right shows the naphtha VF when the orifice has a chamfer angle of 75°.

FIGS. 17-20 are cross-sectional views of a pipe parallel to the second fluid's direction of flow and show the effect of the chamfer angle (α) (7.3° in FIGS. 17A-17B, 30° in FIGS. 18A-18B, 60° in FIGS. 19A-19B, and 75° in FIGS. 20A-20B respectively) on the naphtha volume fraction (VF) down the length of the pipe. FIGS. 21-24 are cross-sectional view of a quill stem that shows effects of the chamfer angle (α) (7.3°, 30°, 60°, and 75° respectively) on the velocity profile of the fluids (natural gas and naphtha) down the length of the pipe in the x-direction. FIG. 25 shows two line graphs of the naphtha VF at the top and the bottom of the pipe for chamfer angle (α) of 7.3° and 30° respectively. FIG. 26 shows two line graphs of the naphtha VF at the top and the bottom of the pipe for chamfer angle (α) of 60° and 75° respectively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An injection quill for injecting a first fluid into a second fluid, said injection quill comprising:

a hollow stem having a closed end and a sidewall, the stem having a curved cross-section defined by a major axis (A), and a minor axis (B), and at least one orifice for injecting the first fluid into the second fluid, wherein A>B and the orifice has an internal chamfer with a chamfer angle ($\alpha$) ranging from $7° \leq \alpha \leq 75°$.

2. The injection quill of claim 1, wherein said orifice extends through said sidewall.

3. The injection quill of claim 1, wherein the stem is made of metal, and wherein the injection quill further comprises first couplings to connect the quill to a pipe, wherein the couplings are optionally flanged or threaded.

4. The injection quill of claim 1, wherein a ratio of A to B ranges from about 1.1:1 to about 4:1.

5. The injection quill of claim 1, wherein said stem comprises at least two orifices.

6. The injection quill of claim 1, wherein at least one orifice is located at a location angle ($\theta$), wherein an origin of said location angle ($\theta$) is measured from said major axis (A) and wherein $-90° < \theta < 90°$.

7. The injection quill of claim 1, wherein an inner diameter of the orifice is from 1/32 inch to 3/8 inch in length.

8. A method of injecting a first fluid into a second fluid using an injection quill comprising:

a hollow stem having a closed end and a sidewall, the stem having a curved cross-section defined by a major axis (A), and a minor axis (B), wherein said major axis (A) of said stem is substantially parallel to a direction of flow of said second fluid, and at least one orifice for injecting the first fluid into the second fluid, wherein A>B and the orifice has an internal chamfer with a chamfer angle ($\alpha$) ranging from $0° \leq \alpha < 90°$.

9. The method of claim 8, wherein said orifice extends through said sidewall.

10. The method of claim 8, wherein a ratio of A to B ranges from about 1.1:1 to about 4:1.

11. The method of claim 8, wherein said stem comprises at least two orifices.

12. The method of claim 8, wherein at least one orifice is located at a location angle ($\theta$), wherein an origin of said location angle ($\theta$) is measured from said major axis (A) and wherein $-90° < \theta < 90°$.

13. The method of claim 8, wherein the second fluid moves from an upstream direction to a downstream direction relative to the stem, and wherein the orifice is on a portion of the sidewall which faces in the downstream direction.

14. The method of claim 8, wherein an inner diameter of the orifice is from 1/32 inch to 3/8 inch in length.

15. A method of injecting a first fluid into a second fluid using an injection quill comprising:

a hollow stem having a closed end and a sidewall, the stem having a curved cross-section defined by a major axis (A), and a minor axis (B), and at least one orifice for injecting the first fluid into the second fluid, wherein A>B and the orifice has an internal chamfer with a chamfer angle ($\alpha$) ranging from $7° \leq \alpha \leq 75°$.

16. The method of claim 15, wherein said chamfer angle ($\alpha$) ranges from $30° \leq \alpha \leq 60°$.

17. The method of claim 15, wherein said major axis (A) of said stem is substantially parallel to a direction of flow of said second fluid.

* * * * *